US009868220B2

(12) United States Patent
Moffat

(10) Patent No.: US 9,868,220 B2
(45) Date of Patent: Jan. 16, 2018

(54) SHAVING CARTRIDGE WITH ENHANCED RINSING

(71) Applicant: Brian Lee Moffat, Simi Valley, CA (US)

(72) Inventor: Brian Lee Moffat, Simi Valley, CA (US)

( * ) Notice: Subject to any disclaimer, the term of this patent is extended or adjusted under 35 U.S.C. 154(b) by 0 days.

(21) Appl. No.: 15/445,879

(22) Filed: Feb. 28, 2017

(65) Prior Publication Data

US 2017/0252934 A1 Sep. 7, 2017

Related U.S. Application Data

(60) Provisional application No. 62/301,680, filed on Mar. 1, 2016.

(51) Int. Cl.
*B26B 21/40* (2006.01)
*B26B 21/22* (2006.01)

(52) U.S. Cl.
CPC ..... *B26B 21/4012* (2013.01); *B26B 21/227* (2013.01); *B26B 21/4037* (2013.01)

(58) Field of Classification Search
CPC ..... B26B 21/227; B26B 21/4012; B26B 21/4037
USPC ..... 30/41, 41.5, 47–51
See application file for complete search history.

(56) References Cited

U.S. PATENT DOCUMENTS 1,852,708 A 4/1932 Stuart
1,938,481 A * 12/1933 Black ..... B26B 21/18 30/41
2,336,806 A * 12/1943 Schenk et al. ..... B26B 21/44 30/41.5
3,950,898 A * 4/1976 Bowen ..... B24B 1/00 30/41
4,177,556 A * 12/1979 Galli, Jr. ..... B26B 21/4062 30/41
4,205,441 A * 6/1980 Turner ..... B26B 21/446 30/41.5
4,228,586 A * 10/1980 Thierry ..... B26B 21/446 30/41

(Continued)

FOREIGN PATENT DOCUMENTS

CA 2383994 A1 * 4/2001 ..... B26B 21/4025
GB 2129732 A * 5/1984 ..... B26B 19/38

(Continued)

OTHER PUBLICATIONS

International Search Report for Serial No. PCT/US2017/020040 dated May 10, 2017.

*Primary Examiner* — Jason Daniel Prone
(74) *Attorney, Agent, or Firm* — Fulwider Patton LLP

(57) ABSTRACT

A razor that facilitates a user's removal of shaving lubricant, cut hairs, and other shaving-related debris, from around, and between, the razor's blade(s). A scoop at the upper portion of the razor's blade assembly funnels water to the blade channel in which the blades are affixed, and at least a portion of that water flows around and/or over the blade(s). The scoop captures, and directs through the razor's blades, a greater volume of water per unit time than can be achieved with an unmodified blade assembly. The cross-sectional area of the scoop's inflow mouth is greater than that of the blade channel's outflow mouth, thereby promoting a Venturi effect which increases the speed of the water's flow over the blades.

7 Claims, 40 Drawing Sheets

(56) References Cited

U.S. PATENT DOCUMENTS 4,480,387 A 11/1984 d'Alayer
4,640,012 A 2/1987 Thomas
4,733,468 A * 3/1988 Zadro ..... B26B 21/40 30/41.5
4,774,765 A * 10/1988 Ferraro ..... B26B 21/227 30/50
4,809,432 A * 3/1989 Schauble ..... B26B 21/446 30/41
4,941,492 A 7/1990 Morgan
4,995,155 A * 2/1991 Gentry ..... B26B 21/52 30/41.5
5,075,969 A * 12/1991 Jursich ..... B26B 21/52 30/41.5
5,177,870 A * 1/1993 Jursich ..... B26B 21/40 30/41
5,236,439 A 8/1993 Kozikowski
5,265,337 A 11/1993 Lowder
5,335,417 A 8/1994 Genero et al.
5,402,697 A * 4/1995 Brooks ..... B26B 19/40 30/41
5,518,114 A 5/1996 Kohring et al.
5,537,749 A 7/1996 Cacioppo
5,600,887 A 2/1997 Olson
5,673,485 A * 10/1997 Hill ..... B26B 21/52 30/41.5
6,006,760 A * 12/1999 Benzinger ..... A61K 8/97 30/41
6,009,622 A * 1/2000 Liedblad ..... A45D 27/46 30/41
6,112,412 A 9/2000 Richard
6,257,247 B1 * 7/2001 Benzinger ..... A61K 8/97 30/41
6,305,082 B1 10/2001 Troncoso
6,385,850 B1 * 5/2002 Coulthard, Jr. ..... B26B 21/22 30/41.5
6,499,218 B2 12/2002 Rocha
6,754,958 B2 * 6/2004 Haws ..... B26B 21/446 30/41
7,007,390 B2 * 3/2006 Mislove ..... B26B 21/446 30/41.5
7,043,842 B1 5/2006 Taylor et al.
7,788,810 B2 * 9/2010 Noble ..... B26B 21/44 30/41
8,117,753 B2 * 2/2012 Gilder ..... B26B 21/22 30/50
2002/0144404 A1 * 10/2002 Gilder ..... B26B 21/22 30/50
2004/0060176 A1 * 4/2004 Gilder ..... B26B 21/22 30/50
2005/0108882 A1 * 5/2005 Gilder ..... B26B 21/22 30/41.5
2006/0101647 A1 * 5/2006 Gilder ..... B26B 21/22 30/50
2006/0225286 A1 10/2006 Tomassetti
2006/0272154 A1 * 12/2006 Brevard ..... B26B 21/446 30/41
2009/0126196 A1 * 5/2009 Gilder ..... B26B 21/22 30/50
2010/0064521 A1 * 3/2010 Delong ..... B26B 21/52 30/41
2010/0095528 A1 * 4/2010 Hawes ..... B26B 21/446 30/41.5
2011/0289776 A1 * 12/2011 Hawes ..... B26B 21/446 30/41
2012/0311863 A1 * 12/2012 Bennik ..... B26B 21/446 30/41
2013/0160297 A1 * 6/2013 Coleman ..... B26B 21/446 30/41
2015/0266189 A1 * 9/2015 Alsalameh ..... B26B 21/446 30/41

FOREIGN PATENT DOCUMENTS

GB 2354474 A * 3/2001 ..... B26B 21/4025
WO WO 0123150 A1 * 4/2001 ..... B26B 21/4025
WO 2002100609 A1 12/2002

* cited by examiner

FIG. 36
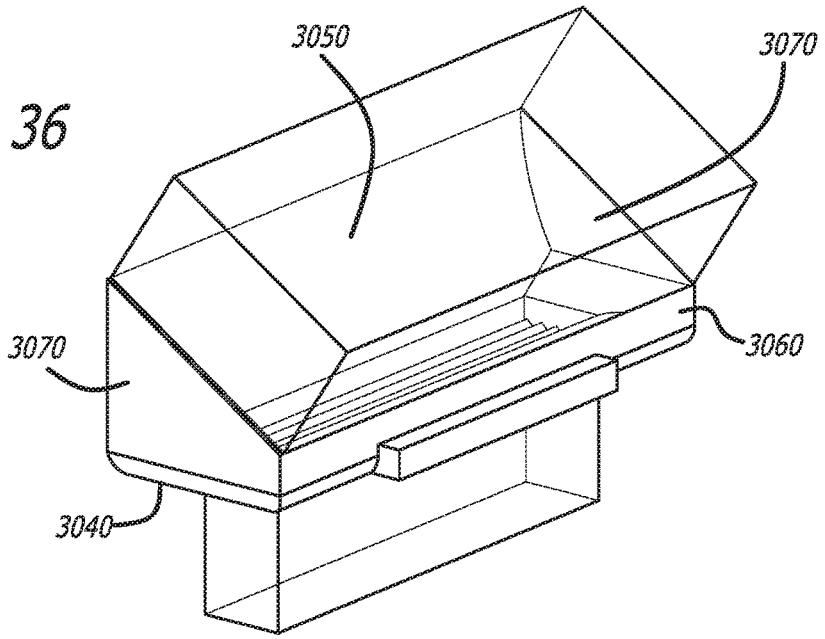
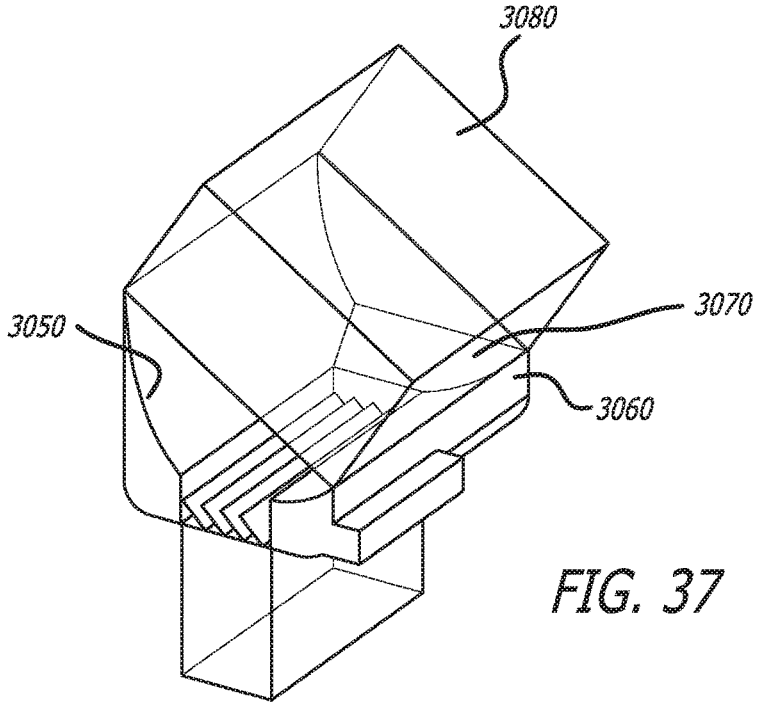
FIG. 37

SHAVING CARTRIDGE WITH ENHANCED RINSING

CROSS-REFERENCE TO RELATED APPLICATIONS

This application claims the filing date benefit of provisional application Ser. No. 62/301,680, filed Mar. 1, 2016, and whose contents are hereby incorporated by reference.

BACKGROUND

Many men and women use razors to superficially remove (i.e. trim) unwanted hair. Some women use razors to shave their legs, to remove hair from their armpits, etc. Some men use razors to shave their faces, their scalps, their chests, etc. Razors typically utilize "blades" to cut unwanted hairs. The blades of a razor cut hairs as a user pulls the razor across his/her skin at the location to be shaved.

Users of manual multi-bladed razors, e.g. the kind with a handle and a blade assembly, typically apply a lubricant to their skin prior to shaving to minimize the friction between the blades and their skin, and to thereby minimize the frequency and/or severity of unwanted cuts, and/or other types of collateral damage, to their skin that can result from one or more blades cutting their skin and/or bumps or other imperfections on the surface of their skin instead of, or in addition to, the hairs to be cut.

During the process of shaving with a manual multi-bladed razor, some of the cut hairs and lubricant may be pushed into the gaps between and around the blades. The presence of this hair and lubricant mixture blocks the gaps between the blades and must be removed to prevent fragments of cut hairs from interfering with and/or blocking the appropriate contact between those blades and a shaver's skin. It must also be removed so that a path exists through which newly scraped hairs and lubricant can escape so as to prevent the razor from effectively "pushing" an aggregate of lubricant across the surface of the user's skin and obstructing the user's view of the skin to be shaved.

While a completely soluble shaving lubricant would help ameliorate the flushing of surplus lubricant from between a razor's blade, most, if not all, shaving lubricants are not completely, and some are not even easily, dissolved in water. In fact, in order to increase their lubricating effectiveness, many shaving lubricants are formulated with hydrophobic ingredients that make them difficult to dissolve in, and/or to remove with, water.

Not only is it often necessary for a shaver to attempt to force the hairs and lubricant from between a cartridge's blades through the sustained application of a very energetic stream of water, many shaver's feel compelled to "bang" their razors against a hard surface (e.g. their sink countertop) in an attempt to physically dislodge the debris from between the blades. Other users sometimes attempt to clear such debris by sliding a finger nail between the blades often with undesirable consequences.

Removing "used" lubricant and cut hairs from between the blades of a twin-bladed or multi-bladed razor is a difficult and frustrating process. It is often difficult, if not impossible, to generate enough water volume, speed and/or force in the water discharged from the tap of a bathroom sink, such that the kinetic energy of the water successfully remove the debris stuck between a razor's blades.

A user of a manual razor possessing a typical blade assembly will usually hold the cartridge (via its attached handle) under water running from a tap in order to attempt to "flush" accumulated lubricant, hair, and debris, from between the cartridge's blades. This is an ineffective and frustrating process. And, only a relatively small "slice" of a stream of water impacting an unmodified blade assembly will actually impinge upon and/or pass between the blades

SUMMARY

An unmodified razor blade assembly (e.g. an unmodified razor cartridge) typical of the prior art has a relatively planar upper surface. Most of the water directed toward the blades of an unmodified blade assembly will hit the "frame" of the assembly, i.e. the perimeter within which the blades are affixed and by which the blades are surrounded, and splash to one side or the other. Only a relatively narrow "slice" of the water directed toward the assembly's blades will actually strike the space between two blades and thereby help to "flush" away any lubricant and/or cut hairs lodged therebetween.

However, by effectively surrounding the blades of the assembly with a multi-walled chamber, channel, or scoop, most, if not all, of an incident stream of water can be directed into a blade channel and therethrough forced to pass over and/or through the blades therein. The constriction of a relatively wide incident stream of water, pursuant to the present disclosure, results in its speeding up via a Venturi effect. And, a flushing of a razor's blades with a faster flow of water more effectively dislodges and removes debris from between and/or around those blades.

There are many variations in the design of the scoops and/or barriers that may be used to achieve the benefit of the present disclosure. Basically, a structure and/or a structural modification is added to or incorporated within a twin-razor, a multi-bladed razor, and/or a razor cartridge, which results in a more effective flushing of the space(s) between adjacent razor blades than was possible in the prior art.

This increase in the effectiveness of the flushing can be achieved through the modified structure's capture of a greater volume (i.e. volume per unit time) of water, than that typical of known blade assemblies. This increase may be enhanced through the direction of that increased volume of water toward the blades, and the spaces therebetween, and/or through the reduction in the volume (per unit time) of water which is able to leave a blade assembly through a path that is not adjacent to one or more of a razor's blades.

The increase in the effectiveness of the flushing thereby enabled is, at least in part, achieved through the creation of a Venturi effect in the water flowing through it. Wherein the Venturi effect increases the speed with which the water incident upon a razor's blade assembly travels through the blades therein. The Venturi effect results from the introduction of water to the "collector" (e.g. scoop) through an aperture whose cross-sectional area is greater than that of the aperture available for its exit (i.e. through the blade channel).

The scope of this disclosure can be extended to any razor design, cartridge design, supporting structure, and/or structural modification, which increases the effectiveness of the flushing of lubricant and/or hairs from between the blades of a twin- or multi-bladed razor, and/or a razor cartridge:

1) through its capture of a volume (per unit time) of water, which is directed toward the razor's blades, through an aperture whose cross-sectional area is greater than the cross-sectional area of the aperture in which the razor's blades are embedded and through which the water may exit the razor's blade assembly;

2) through its relative increase in the volume (per unit time) of water that it directs toward those blades, with respect to an equivalent unmodified razor and/or razor blade assembly;
3) through its relative reduction in the volume (per unit time) of water that is allowed to escape the razor's blade assembly without flowing over and/or between the cartridge's blades; and/or
4) through its tendency to increase the speed with which water flows over and/or between the blades of the blade assembly by means of an induced Venturi effect.

A razor apparatus is disclosed which includes a razor cartridge having an aperture, and a plurality of razor blades mounted longitudinally in the aperture and positioned in the aperture parallel to one another and at an angle relative to a longitudinal axis of the blade channel and thereby forming angled gaps. The plurality of razor blades and the aperture define a blade channel having a channel inlet and a channel outlet. The blade channel has a channel cross-sectional area. A scoop is attached to the cartridge and defines a scoop channel. The scoop can have a rectangular shape and is formed by at least three walls of a rectangle. The scoop channel includes an entry mouth having a mouth cross-sectional area. The mouth cross-sectional area is at least 20% larger (or at least twice or three times larger) than the channel cross-sectional area. The scoop channel is configured to direct water flowing in through the mouth into the channel inlet.

A razor apparatus is disclosed including a razor cartridge having an aperture and at least one razor blade mounted longitudinally in the aperture, and the at least one razor blade and the aperture defines a blade channel having a channel inlet and a channel outlet. The blade channel has a channel cross-sectional area. A scoop is attached to the razor and defines one or more scoop channels. Each of the one or more scoop channels includes an entry mouth having a mouth cross-sectional area, and the sum of the mouth cross-sectional areas is at least as large as the channel cross-sectional area. Each of the one or more scoop channels is configured to direct water flowing in through the mouth into the channel inlet.

The blades can be angled forming angled gaps and the scoop can direct the water into the blade channel at an angle of between fifteen and sixty degrees relative to the angled gaps or between five and forty-five degrees. A partition in the scoop can be between 0 and 5 mm above a top of the blade(s). The razor cartridge can be at least partially enclosed in a container.

Embodiments disclosed herein for a multi-bladed razor, and/or razor cartridge provide an efficient means for the removal of lubricant and cut hairs from between its blades in conjunction with, and/or as a consequence of, the direction of a free-flowing stream of water (e.g. as from a bathroom faucet) into a razor's blade channel (i.e. the channel within a razor head or cartridge in which one finds the blades of the razor head or cartridge, and into the walls of which those blades are embedded and/or affixed).

Embodiments disclosed herein allow shavers to complete their shaves more quickly, thereby saving them time. They spare the shavers frustration, thereby improving their health and their attitude. They spare them the cost of replacing razors damaged as a consequence of being struck against sinks, countertops, and other hard objects in a desperate attempt to clear the gaps between the blades of the razors.

Embodiments disclosed herein allow the manufacturers and/or sellers of razor(s) which incorporate the same to foster greater customer satisfaction, customer appreciation, customer loyalty, and profits.

Razor cartridges (or complete razors) that incorporate on their upper side, and/or adjacent to their blade channels, a funnel, scoop, or other water-capturing structural element are disclosed herein. The funnel or scoop captures water when a user places the cartridge under a tap. Because it captures more water than would normally directly impact the blades in a manual razor of the prior art, the funnel or scoop on top of this manual razor passes more water through the blades, creates a Venturi effect that speeds up that water, and thereby rinses away shaving lather and cut hairs more efficiently and more quickly than would a cartridge of the prior art.

The funnel or scoop is attached to the side of the razor opposite to the side from which the blades protrude and against which the user's skin comes in contact. Because of its orientation, and its expected light weight, the disclosed funnel does not interfere with shaving. And, any visual obstruction of the area being shaved can be further minimized by fabricating the funnel with transparent or translucent material(s).

Embodiments herein can include:

1. Those which capture water through a funnel and direct it into the relatively constricted aperture of the razor or cartridge's blade channel in which the blades are embedded.
2. Those which obstruct, and thereby divert toward the blades of a razor, portions of a stream of water adjacent to the portion falling directly upon the blades of a razor, thus increasing the volume and speed of the water flowing through the razor's blades.
3. Those which are integral modifications to the razor as well as those which are designed to "clip on" or otherwise attach to razors or cartridges including those of the prior art.
4. Those which are manifested through permanent structural elements as well as those which are "collapsible."

BRIEF DESCRIPTION OF THE DRAWINGS

FIG. 36 is a side perspective view of a razor head of a razor of the present disclosure, illustrating a scoop connected to a top portion of the razor head.

FIG. 37 is a cross-sectional view of the razor head of FIG. 36.

DETAILED DESCRIPTION

For a fuller understanding of the nature and objects of the disclosure, reference should be made to the following detailed description, taken in connection with the accompanying drawings.

For the sake of brevity, the description and/or discussion of the present disclosure, and/or to embodiments thereof, may utilize references to razors, and/or to razor cartridges (i.e. "cartridges"). However, unless specifically contradicted by word or structure, all such descriptions, discussions, and/or embodiments, apply with equal force to both, even if only disclosed, and/or discussed, in reference to one or the other. The preference herein is to discuss this disclosure and embodiments of the same with respect to cartridges, although such discussions, disclosures, and embodiments, unless specifically contradicted by word or structure, apply with equal force to "non-cartridge" and/or "integral" razors (e.g. those possessing a rigidly attached handle).

Figure 1:
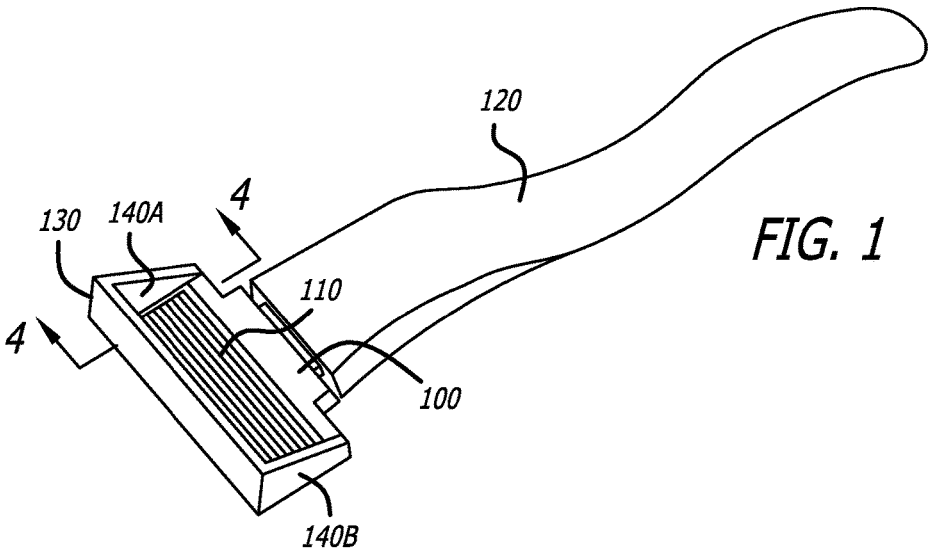
FIG. 1 is a top perspective view of a razor of the present disclosure.

FIG. 1 is an illustration of an embodiment herein. Illustrated is a "cartridge" razor that has a cartridge 100 in which a plurality of blades 110 are affixed. It has a handle 120 that a user grasps when shaving with the razor's blades 110. A razor cartridge is a module containing, typically in a fixed or unmovable fashion, one or more parallel razor blades (each of which is a sharp-edged block of hard material, typically steel, capable of cutting other, typically softer, material in conjunction with the application of a relatively small force).

A cartridge is typically used in conjunction with a razor handle, and may be removably attached and/or connected thereto.

However, unlike razors typical of the prior art, this embodiment surrounds the "entry mouth of the blade channel," i.e. the opening of the channel defined within a cartridge through which water flows over the blades 110, and within which the blades are affixed, with a barrier 130 and 140. The upper perimeter of this barrier defines a new upper mouth to the channel through which water can flow to and through the blades 110. This new upper mouth, or "entry mouth of scoop," has a cross-sectional area that exceeds the cross-sectional area of the "exit mouth of the blade channel," i.e. the mouth through which water exits the cartridge after having flowed between or around the blades 110.

This entry scoop mouth accepts a greater volume of water per unit time than does the entry mouth of an unmodified blade channel. This expanded entry mouth allows an incident stream of water to accumulate, to be directed towards the blades, and, because of its constricting cross-sectional area, to speed up, before reaching the blades. The effective constriction in the cross-sectional area of the channel through which water flows to the blades causes the flow of water to increase in speed and to manifest a Venturi effect.

Figure 2:
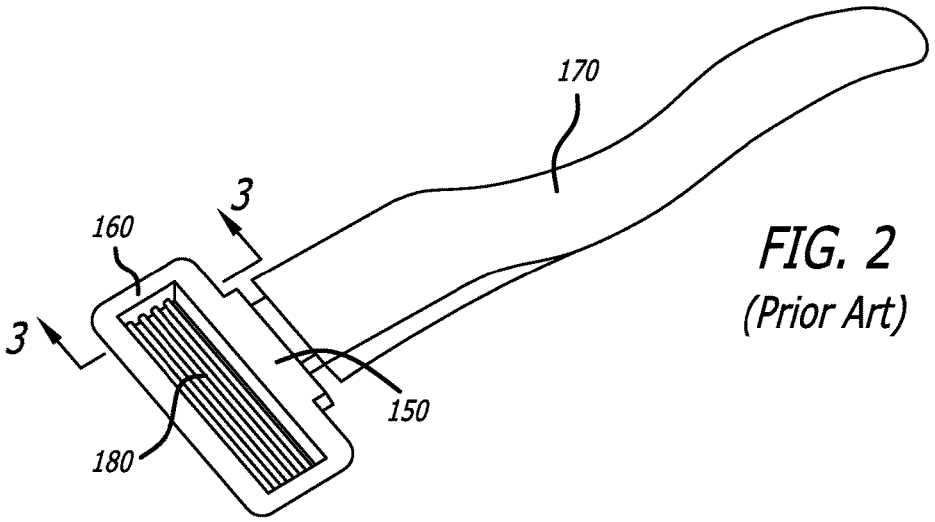
FIG. 2 (Prior Art)
FIG. 2 is a top perspective view of a razor of the prior art.

FIG. 2 illustrates an example of a cartridge razor typical of the prior art in which a multi-bladed razor cartridge 150 and 160 is attached to a handle 170. The blades 180 of the cartridge 150 are located within a tubular channel, i.e. within a "blade channel," both mouths of which have approximately equal cross-sectional areas.

Figure 3:
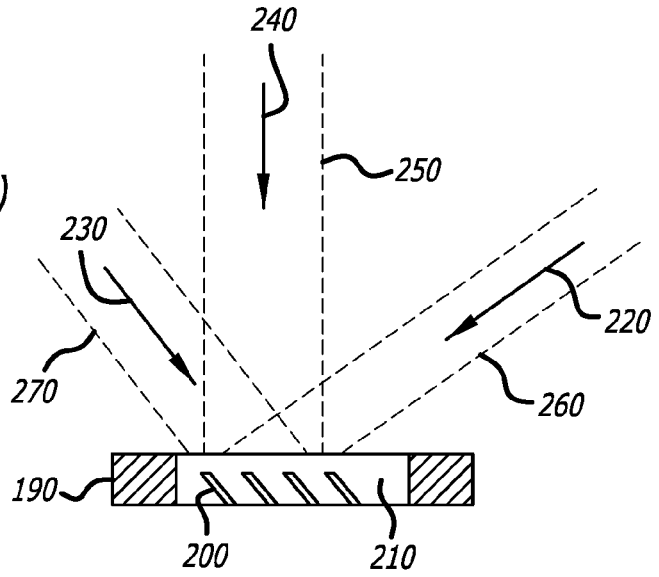
FIG. 3 (Prior Art)
FIG. 3 is a cross-sectional view taken on line 3-3 through the cartridge of the razor of FIG. 2.

FIG. 3 is cross-sectional view of a "classic" cartridge 190 typical of the prior art. The blades 200 affixed within the cartridge 190 are enclosed within a shallow "blade channel" 210 in which the walls of the cartridge 190 that surround the blades define the interior surfaces of the channel. The channel has mouths on top and bottom, i.e. the "entry" and "exit" mouths.

A shaver using a cartridge like the one illustrated in FIG. 3 might attempt to flush used lubricant and cut hairs from between and around the blades 200 by directing water into the upper mouth of the blade channel 210 (a typical blade-rinsing orientation).

Three potential directions 220, 230 and 240 of water flow are included in this figure. The portion of the incident stream that will enter the gaps between the blades 200 varies with its "angle of attack." The maximal "effective" width 250 of the slice of the stream, and the maximal volume and rate of water flow through the blade channel, and through the gaps between the blades 200 therein, is achieved by a stream that impinges on the channel parallel (arrow 240) to the longitudinal axis of the blade channel. The "effective" stream width 260 and 270, as well as the volume and rate of water flow through the blade channel, and through the gaps between the blades 200 therein, decreases as the angle between the stream's flow 220 and 230, and the longitudinal axis of the "blade channel" 210, increase.

Figure 4:
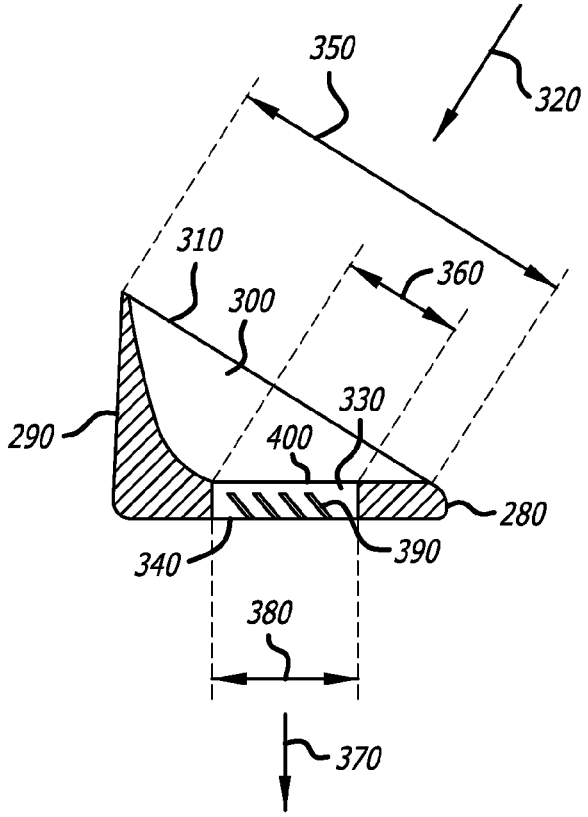
FIG. 4 is a cross-sectional view taken on line 4-4 of FIG. 1.

FIG. 4 is a cross-sectional view of an embodiment herein in which a razor cartridge 280 incorporates a scoop 290 and 300 like the one illustrated in FIG. 1. This scoop has three walls (one 290 distal to the user, and one on either side, e.g. 300). When an incident stream of water 320 enters the entry mouth of the scoop 310 normal to its cross-sectional plane, its only exit point (aside from splashing back up through the entry mouth) is through the blade channel 330, and, in particular, through the exit mouth 340 of the blade channel.

In this embodiment, the scoop 300 is composed of three walls or barriers: a wall 290 distal to the user, and one wall on either side of the cartridge, e.g. 300. The third wall of the scoop is composed of the bottom wall of the cartridge, i.e. the one in which the blade channel is embedded.

Water 320 entering the scoop normal to its cross-sectional plane 310 will have a portion of its stream equal in width 350 to enter the scoop. In the absence of the scoop, only a relatively narrow portion of the stream, i.e. with a width 360, would enter the blade channel as a consequence of the same incident stream of water 320.

Regardless of how much water enters the scoop, and/or the blade channel, the output stream 370 will have a width 380.

The excess of water entering the scoop will often, if not always, create a "Venturi effect". The result of which is that the speed of the water passing through the blade channel will increase by a factor equal to the ratio of the cross-sectional area of the stream of water entering the scoop to the cross-sectional area of the stream of water leaving the blade channel. In the case of the example illustrated in FIG. 4, and assuming that the "depth" of a stream (with a rectangular cross-section) entering the scoop is the same as the depth of the stream (with a rectangular cross-section) exiting the blade channel, the increase in the speed of the water passing through the blades 390 will approximately equal the ratio of the width 350 of the stream entering the scoop to the width 380 of the stream exiting the blade channel. In the illustrated embodiment, this means that the water between the blades 390 may be traveling as much as 2.6× faster than the water entering the scoop.

The actual increase in the speed of the water flowing between the blades in an embodiment may be less than the theoretical maximum as a result of many practical factors, some of which are related to the actual cross-section of the stream impinging on the scoop (e.g. if the stream is thin then the benefit of the scoop may not be maximal, etc.). Another example of sub-optimal performance would be if the stream impinging on the scoop were not flowing normal to the scoop's cross-sectional plane (at its mouth).

With respect to cartridges of the prior art, such as the one illustrated in FIG. 3, even with an optimal orientation of the incident stream with respect to the blade channel (i.e. a stream flowing normal to the plane at the entry mouth of the channel), the speed of the water is not increased by a Venturi effect. And, in the more likely case, where the incident stream is not flowing parallel to the normal of the plane at the entry mouth of the blade channel, the width of the stream entering the blade channel, may be substantially less than the width of the stream exiting the blade channel. In that case, the water may actually slow during its passage between and around the blades.

The embodiments disclosed herein, at a minimum, provide for improved volume and speed of flow between the cartridge blades in most, if not all, circumstances.

Figure 5:
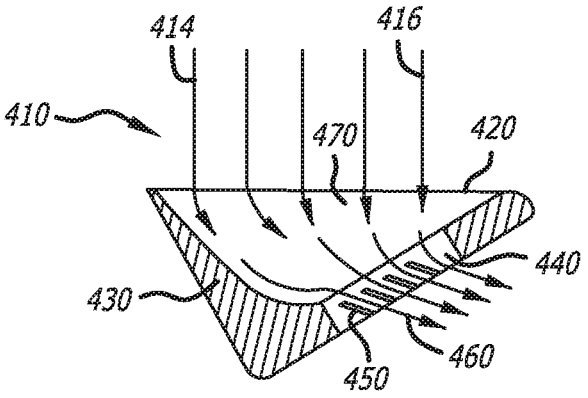
FIG. 5 is a cross-sectional view of fluid flow through a razor head of a razor of the present disclosure.

FIG. 5 is a cross-sectional view of the same embodiment as is illustrated in, and discussed in relation to FIG. 4. FIG. 5 illustrates the manner and directions in which water may flow through a razor head and scoop of the present disclosure. Water flows 410 into the scoop 420 and 430 and is diverted, at least in part, by the curved inner surface 430 of the scoop so as to flow into and through the blade channel 440 at an angle that is approximately parallel to the blades 450, therein. Water flowing 460 out of the blade channel 440 will tend to retain a degree of lateral velocity and flow out energetically (e.g. instead of just "dribbling" down vertically). In an embodiment, the inside 470 of the scoop is designed so as to minimize turbulence and efficiently direct a substantially laminar flow through the blade channel 440 and between the blades, e.g. 450, therein. A portion 416 of the incident water will tend to flow directly into the blade channel 440. While other portions, e.g. 414, will tend to encounter an inner surface 430 of the scoop and be directed toward the blade channel 440. The inflowing stream of water will tend to converge within the constriction, and produce laminar flow into and through the blade channel 440.

Figure 6:
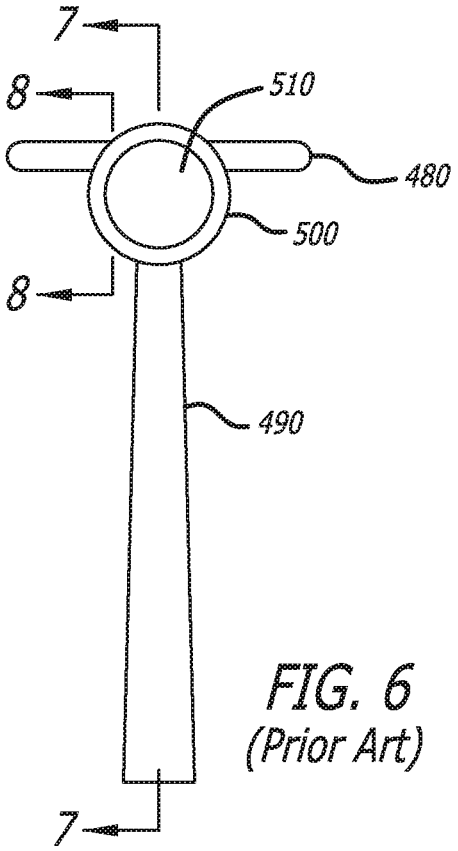
FIG. 6 (Prior Art)
FIG. 6 is the top view of a razor embodiment as illustrated in FIG. 3 of the disclosure of prior art U.S. Pat. No. 5,335,417 (Genero).

FIG. 6 is a top view of the razor 480 disclosed in U.S. Pat. No. 5,335,417 (Genero). A razor head 480 is attached to a handle 490. Adjacent to the junction between the handle and the razor head is a circular cup 500 characterized by an uppermost circular aperture 510. When water is directed into the aperture 510, at least a portion thereof hits the bottom of the cup 500 and then flows laterally toward the razor head 480 and then into the blade channel therein.

Figure 7:
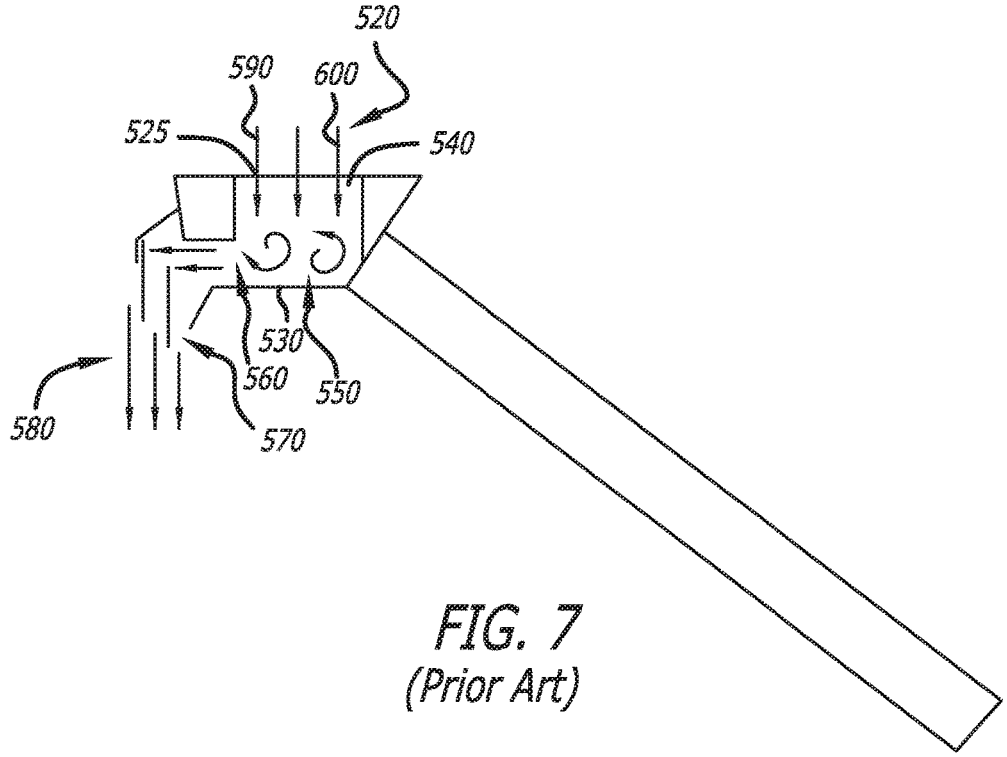
FIG. 7 (Prior Art)
FIG. 7 is a cross-sectional view taken on line 7-7 of FIG. 6.

FIG. 7 is a cross-sectional view of the razor disclosed in Genero, and illustrated in FIG. 6, taken on line 7-7 in FIG. 6.

Water flowing 520 into the circular aperture 525 of Genero will tend to collide with the bottom 530 of the cup. Because of this, the water inside 540 the cup will tend to manifest significant turbulence 550. When the water flows 560 laterally toward the blades 570, it will tend to flow 560 into the blades normal to their broad surfaces, thereby tending to dissipate at least a portion of their speed and energy. After colliding with the blades 570, the water will tend to flow 580 downward.

Figure 8:
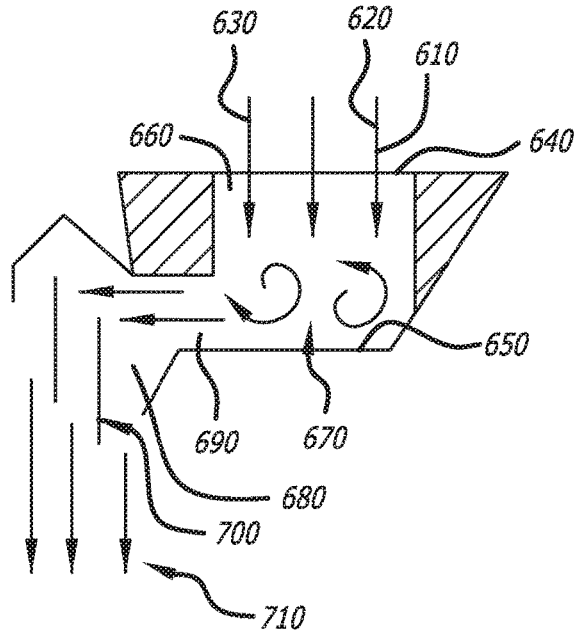
FIG. 8 (Prior Art)
FIG. 8 is a cross-sectional view taken on line 8-8 of FIG. 6.

FIG. 8 is a second cross-sectional view of the razor disclosed by Genero, and illustrated in FIG. 6 and taken on line 8-8 in FIG. 6.

Water flowing 610, 620, and 630 into the circular aperture 640 of Genero will tend to collide with the bottom 650 of the cup. Because of this, the water inside 660 the cup will tend to manifest significant turbulence 670. When the water flows 680 laterally through a connecting channel 690 toward the blades, e.g. 700, it will tend to flow 680 into the blades normal to their broad surfaces, thereby tending to dissipate at least a portion of their speed and energy. After colliding with the blades, the water will tend to flow 710 downward.

Because the aperture of Genero is circular, the more lateral cross-section at line 8-8 reveals a significantly smaller cup cross-sectional area than does the central cross section at line 7-7. At this position in the cup, the inflowing water must also travel further laterally, i.e. through channel 690, in order to reach the blades, e.g. 700.

Figure 9:
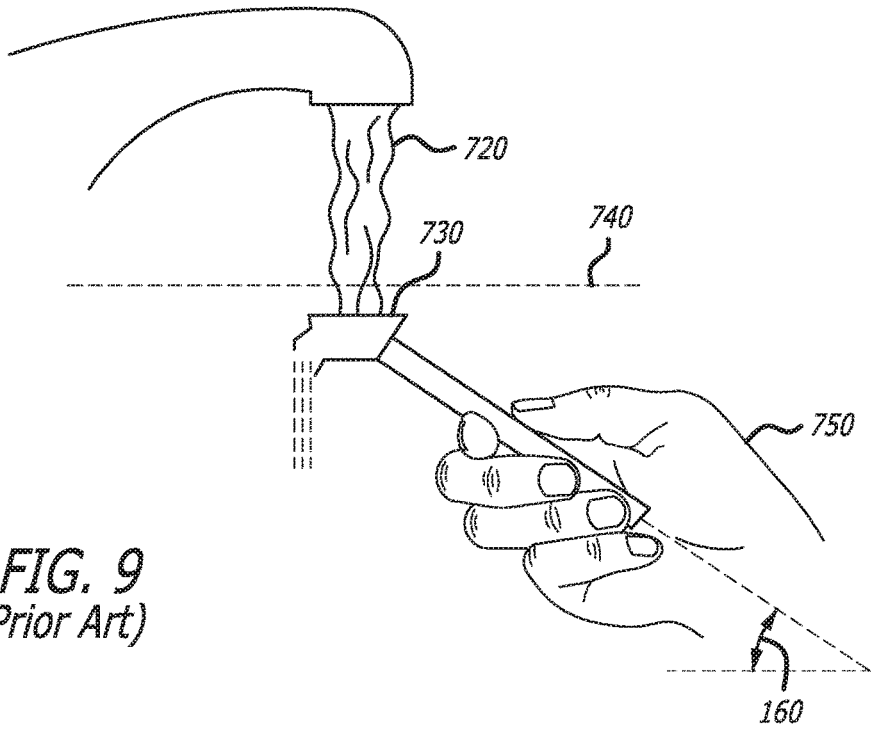
FIG. 9 (Prior Art)
FIG. 9 is a side view of a razor embodiment accepting a free flow of water from a faucet, as illustrated in FIG. 6 of the disclosure of Genero.

FIG. 9 is derived from Genero's FIG. 5, in which Genero discloses the introduction of free flowing water 720, flowing out of the end of a faucet, into the upper aperture 730 of his device (as opposed to the coupling of the upper aperture with the bottom of a faucet as illustrated in Genero's FIG. 4). Because the upper aperture 730 of Genero will tend to be positioned below, or at least adjacent to, the top, e.g. 740, of the corresponding sink (into which the faucet typically disperses water), and because a horizontal positioning and/or alignment of the upper aperture requires an angularly downward orientation of the razor's handle, a user 750 holding the razor in a position so as to receive water 720 freely flowing out of a faucet will tend to be required to position his hand 750 within the bowl of the sink, perhaps even proximate to the sink's bottom. The user may be required to hold the razor of Genero at an upward angle 760, while bending his wrist to as to allow his hand to be extended into the confines of the sink's bowl. This may require an uncomfortable bending of his wrist.

Figure 10:
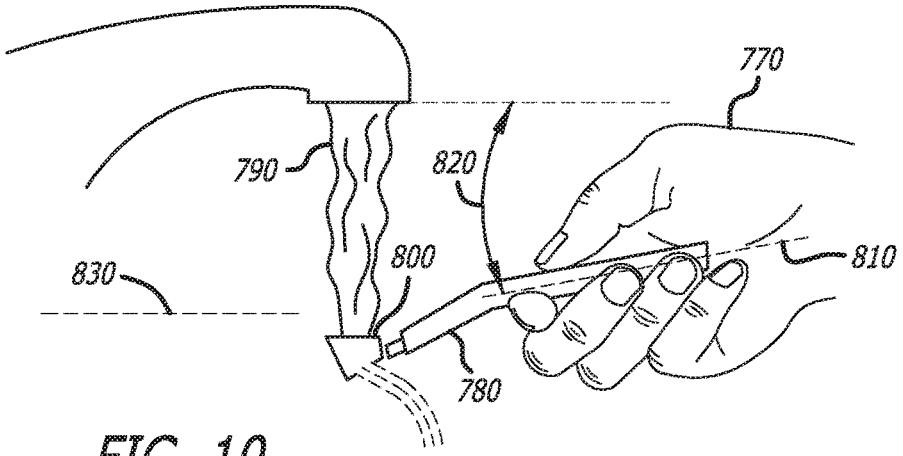
FIG. 10 is a side view of a razor of the present disclosure receiving a free flow of water from a faucet.

FIG. 10 illustrates the manner in which a user 770 of a razor 780 of the present disclosure might be expected to hold the razor so as to introduce water 790 freely flowing out of the end of a faucet. Most, if not all, embodiments of the disclosure include a scoop 800 configured so as to receive water at an optimal angle of ingress when the razor is held in an approximately horizontal 810 and 820 orientation, or in an approximately downward orientation (in contrast to the upward orientation required by users of a Genero razor). A user 770 of a razor of the present disclosure would not typically need to extend his hand below the top, e.g. 830, of a sink, and/or into the bowl of that sink, and should be able to hold the razor at an angle 820 and orientation that is comfortable.

Figure 11B:
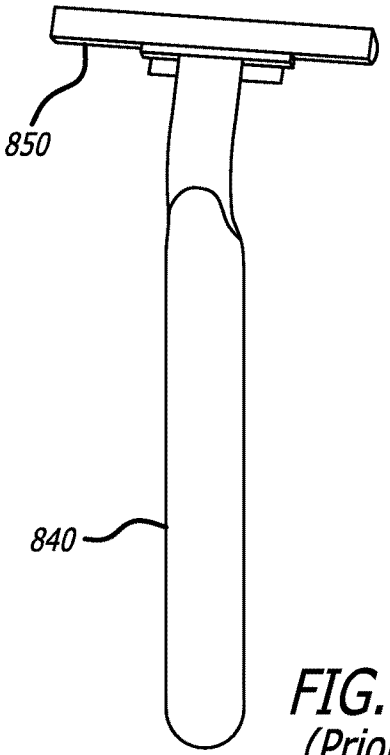
FIG. 11B (Prior Art)
FIG. 11B is a top view of a three-bladed disposable razor of the prior art which includes a rigidly-attached razor head.
Figure 11A:
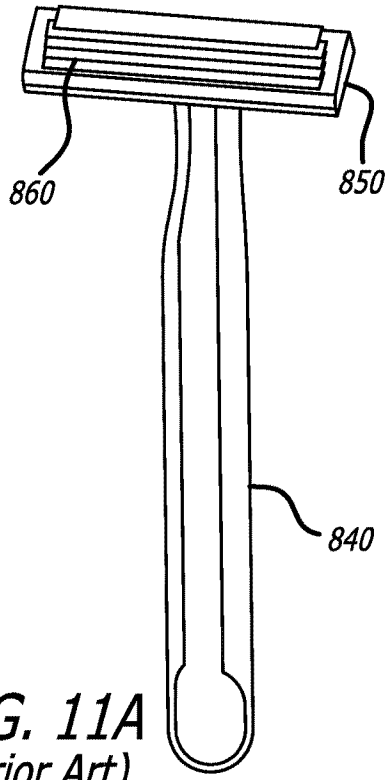
FIG. 11A (Prior Art)
FIG. 11A is a bottom view of a three-bladed disposable razor of the prior art which includes a rigidly-attached razor head.

FIGS. 11A and 11B are bottom and top views, respectively, of a multi-bladed solid razor (i.e. without a detachable cartridge and/or handle) from the prior art. These razors typically include a handle 840, a razor head 850, and a plurality of blades 860. The razor head 850 is rigidly and permanently attached to, and/or integral with, the respective razor handle 840.

Figure 12B:
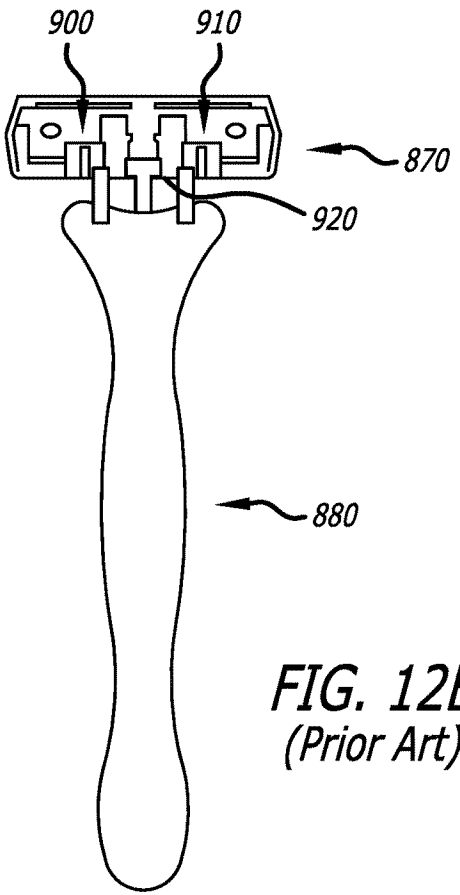
FIG. 12B (Prior Art)
FIG. 12B is a top view of a three-bladed cartridge razor of the prior art which includes a detachable "cartridge" razor head.
Figure 12A:
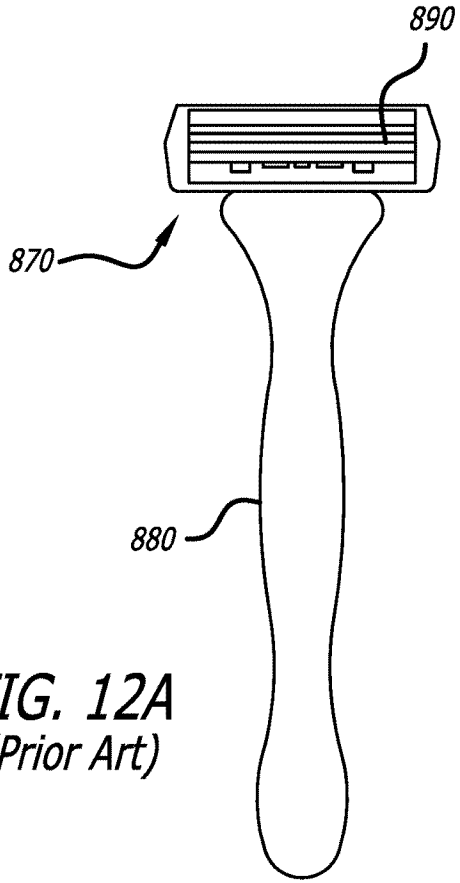
FIG. 12A (Prior Art)
FIG. 12A is a bottom view of a three-bladed cartridge razor of the prior art which includes a detachable "cartridge" razor head.

FIGS. 12A and 12B are illustrations of a multi-bladed razor from the prior art which incorporates a detachable cartridge 870 and/or handle 880. With respect to this category of prior art razors, a handle 880 attaches to a "cartridge" 870 in which the razor's blades 890 are embedded. The cartridge 870 is attached to the handle by connectors 900, 910, and 920. After a period of use, a user can remove the "used" cartridge 870, and replace it with a new cartridge.

Figure 13:
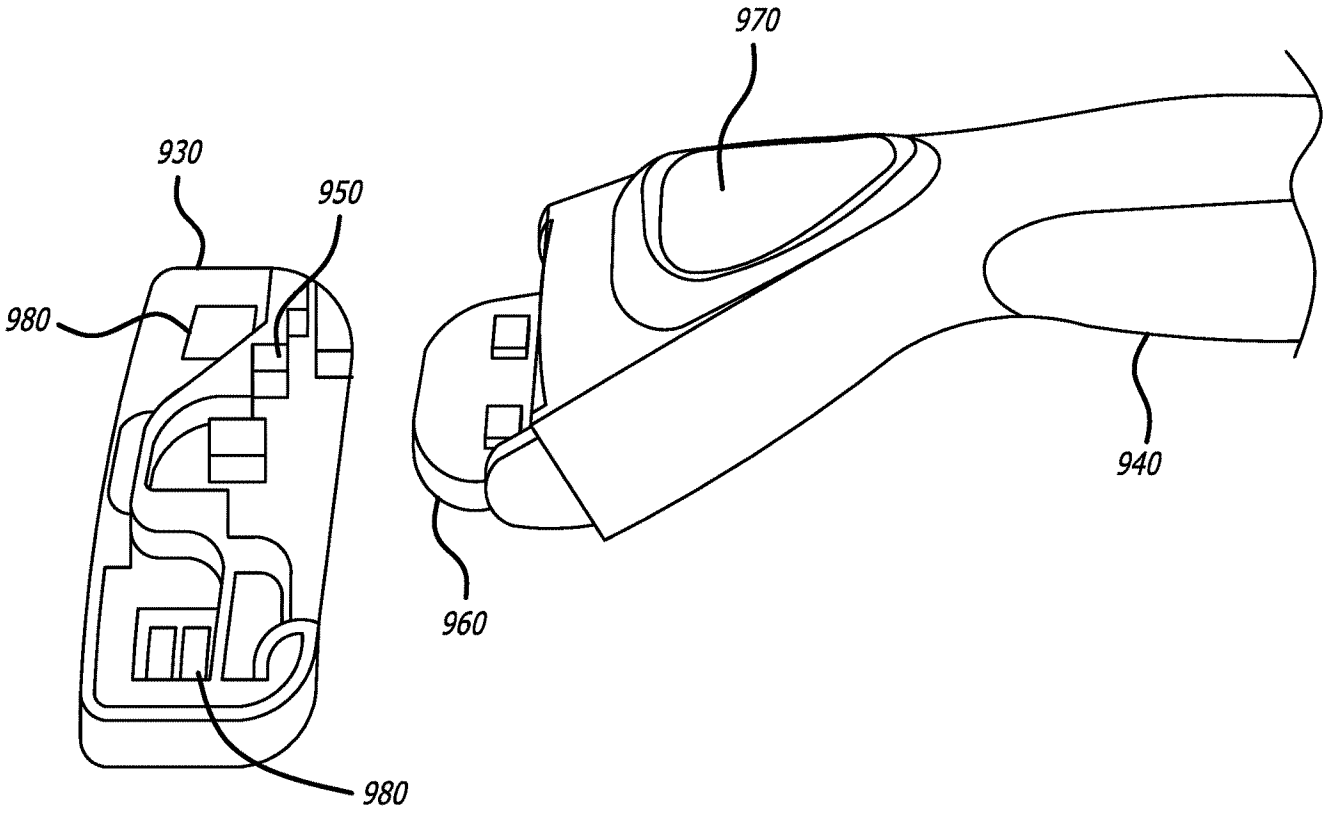
FIG. 13 (Prior Art)
FIG. 13 is a side perspective view of a cartridge razor of the prior art, with its cartridge detached, and illustrating a cartridge connection mechanism.

FIG. 13 illustrates an example from the prior art of a mechanism by which a cartridge 930 can attach to, and be detached from, its corresponding handle 940. A connection assembly 950 on the cartridge will "mate" with a complementary connector 960 in the handle 940. When a button 970 on the handle 940 is pushed, the cartridge is pushed away from the handle and its connector 960, causing the cartridge 930 to detach.

Note the very limited openings 980 through which water may be introduced to the blade channel. With respect to the cartridge 930 shown, the amount of water that can flow into the blade channel is substantially less than the amount of water that can flow out of the channel. This would be expected to result in a slow flow of water through the blade channel, and in inefficient and poor flushing of used lubricant and cut hairs from between the blades of the cartridge.

Figure 14:
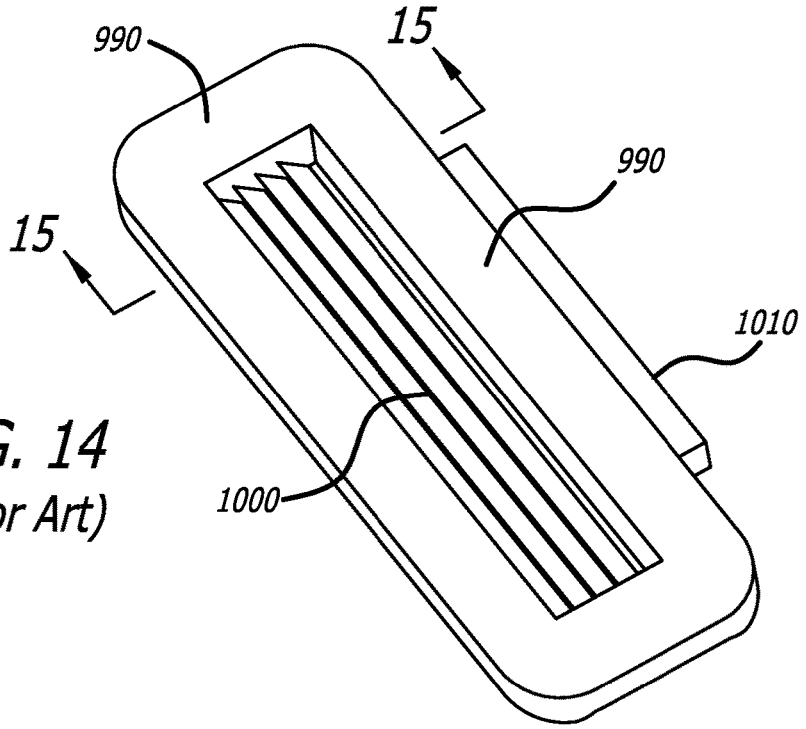
FIG. 14 (Prior Art)
FIG. 14 is a top perspective view of a cartridge typical of the prior art.

FIG. 14 is an illustration of a multi-bladed cartridge 990 from the prior art. In this example, the cartridge has four blades 1000. The connector port 1010 is where a razor handle might connect to this cartridge (corresponding to the connector 950 discussed with respect to FIG. 13 above).

In much of the remainder of this disclosure only a razor cartridge is discussed and/or illustrated. This is done for the sake of efficiency. That is, the redundant illustration of razor handles is unnecessary when the disclosure herein does not typically involve features attached to, or manifested within, the razor handle. The symbolic "connector port" 1010 is provided on cartridge illustrations to provide the reader with a proper orientation for the features illustrated within prototypical cartridges. However, this symbolic connector port is only referenced by number here, and redundant numeric references are not provided for the additional applicable illustrations and figures herein.

All embodiments illustrated and/or discussed with respect to razor cartridges will, unless explicitly stated to the contrary, apply with equal force and validity to "solid" one-piece integral razors (i.e. those without detachable cartridges). This will be clear to those skilled in the art.

Figure 15:
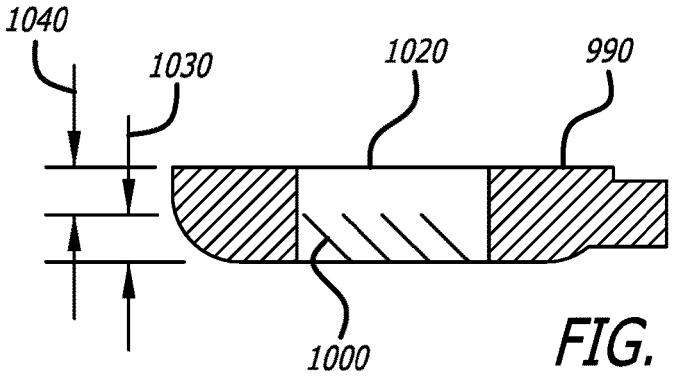
FIG. 15 (Prior Art)
FIG. 15 is a cross-sectional view taken on line 15-15 of FIG. 14.

FIG. 15 is an illustration of the cross-sectional view of the prior art cartridge illustrated in FIG. 14 (taken on line 15-15 of FIG. 14). The blade channels of cartridges in the prior art typically contain the blades 1000. In the example illustrated in FIG. 15, the entry mouth of the cartridge's 990 blade channel 1020 is significantly above the upper ends of the blades 1000. The portion 1030 of the blade channel containing the blades 1000 is below an upper portion 1040.

Figure 16:
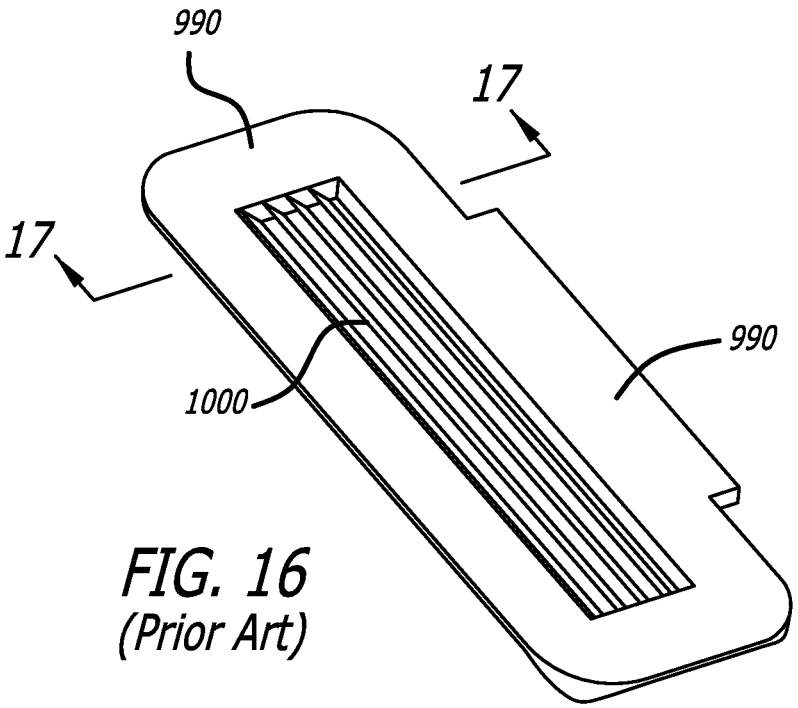
FIG. 16 (Prior Art)
FIG. 16 is a top perspective view of a cartridge typical of the prior art.

FIG. 16 illustrates the lower portion of the prior art cartridge of FIGS. 14 and 15. This is the portion corresponding to the portion of the blade channel 1020 that contains the blades 1000, and is illustrated in FIG. 15 at 1030.

Figure 17:
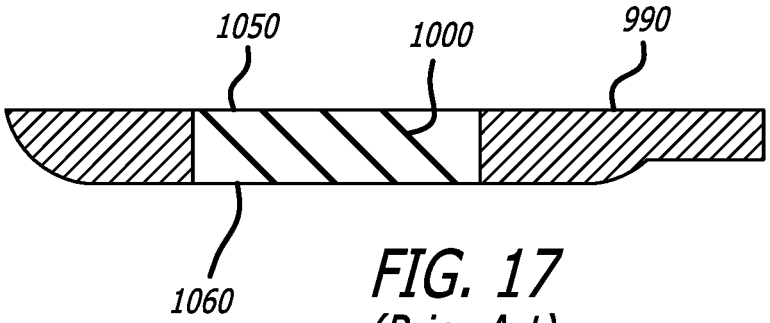
FIG. 17 (Prior Art)
FIG. 17 is an enlarged cross-sectional view taken on line 17-17 of FIG. 16.

FIG. 17 is a cross-sectional view of the portion of a prior art cartridge of FIG. 16 (taken on line 17-17 of FIG. 16). This cross-sectional view is the same as the cross-sectional view of FIG. 15 except that it includes only the lower portion of the cartridge 990, wherein the upper and lower edges of the blades 1000 are contiguous with, and/or contained within, the upper 1050 and lower 1060 horizontal surfaces of the sectioned cartridge illustrated in FIG. 16, and denoted by the vertical range 1030 specified in FIG. 15.

This horizontal slice of the cartridge 990 is flush at its top and bottom with the upper and lower edges, respectively, of the cartridge blades 1000. The exit mouth 1060 of the blade channel is the portal through which water must exit after flowing from top-to-bottom over and between the blades 1000.

Figure 18:
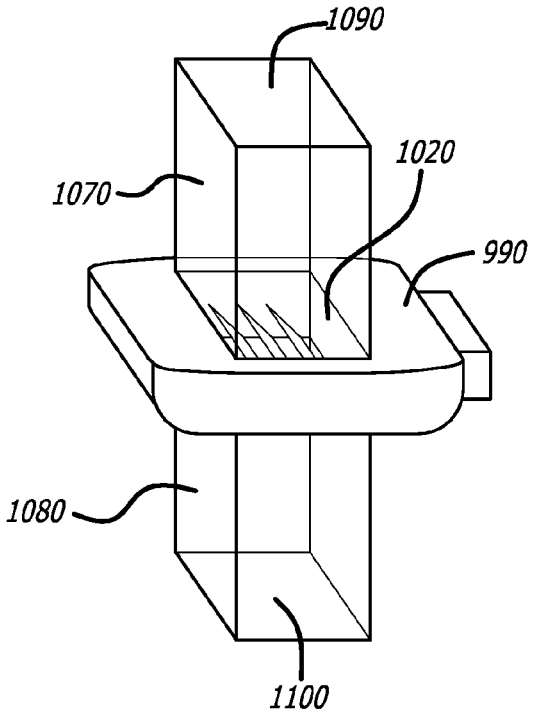
FIG. 18 (Prior Art)
FIG. 18 is a side perspective view of a cartridge of the prior art illustrating the passage of a stream of water through the cartridge blade channel along a path coaxial with the blade channel.

FIG. 18 illustrates the relationship between the maximally-voluminous stream 1070 that may enter a typical prior art cartridge 990, and the stream 1080 that will be discharged by the cartridge in response. With respect to the illustrated cartridge 990, the maximum stream 1070 that can enter the blade channel 1020 enters the blade channel parallel to the channel's longitudinal (vertical) axis and has a cross-sectional area 1090 equal to the cross-sectional area of the blade channel's 1020 entry mouth.

With respect to the illustrated cartridge 990, the effluent stream 1080 that exits the blade channel 1020 has a cross-sectional area 1100 equal to the cross-sectional area of the blade channel's entry mouth 1020.

In many cartridges of the prior art, the cross-sectional area of the blade channel's entry mouth is no greater than the cross-sectional area of the blade channel's exit mouth. And, in many cartridges of the prior art, including the razor of Genero, the cross-sectional area of the blade channel's entry mouth is actually significantly less than the cross-sectional area of the blade channel's exit mouth.

The ratio of the cross-sectional areas of the inflowing and outflowing streams of water with respect to the embodiment of the prior art illustrated in FIG. 18 can be 1.0.

Figure 19:
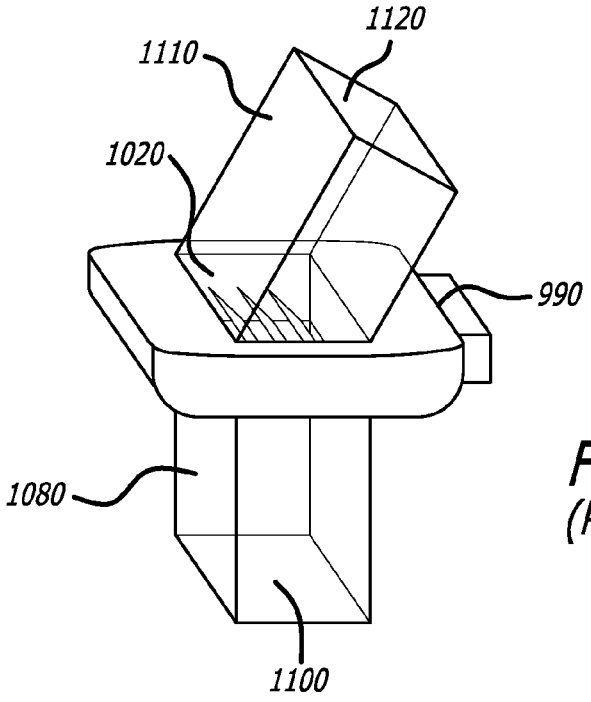
FIG. 19 (Prior Art)
FIG. 19 is a side perspective view of a cartridge typical of the prior art illustrating the passage of a stream of water through the cartridge blade channel along a path not coaxial with the blade channel.

FIG. 19 illustrates the relationship between a stream 1110 of water that may enter the blade channel 1020 of a typical prior art cartridge 990 from an off-axis direction and the stream 1080 discharged by the cartridge. With respect to the illustrated cartridge 990, because the stream 1110 enters the blade channel 1020 off-axis, with respect to the longitudinal axis of the blade channel 1020, it has a cross-sectional area 1120 which is less than the cross-sectional area 1090 of the stream 1070 entering the cartridge 990 in FIG. 18 parallel to the longitudinal axis of the cartridge's blade channel 1020.

With respect to the illustrated cartridge 990, the effluent stream 1100 that exits the blade channel 1020 has a cross-sectional area 1100 equal to the cross-sectional area of the blade channel's exit mouth.

With respect to cartridges typical of the prior art, like the one illustrated in FIG. 19, the off-axis entry of water into the cartridge's blade channel results in the opportunity for the water flowing therethrough to exit more slowly than it entered, thereby reducing the rate and efficiency with which debris is removed therefrom.

The ratio of the cross-sectional areas of the inflowing 1120 and outflowing 1100 streams of water with respect to this embodiment can be 0.85.

Figure 20:
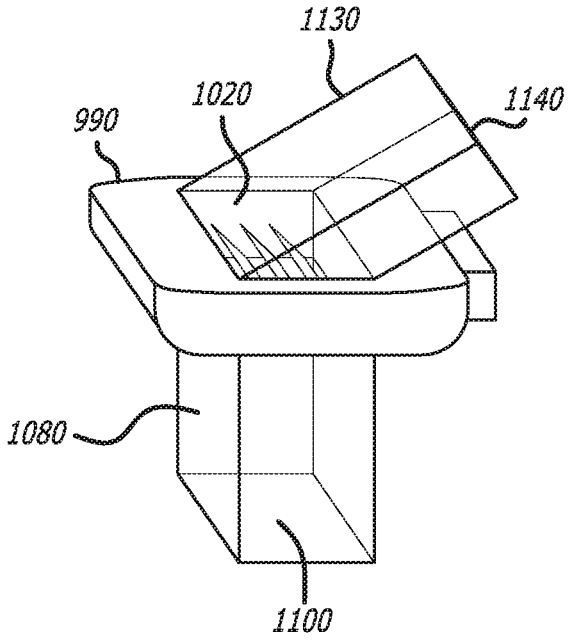
FIG. 20 (Prior Art)
FIG. 20 is a side perspective view of a cartridge typical of the prior art illustrating the passage of a stream of water through the cartridge blade channel along a path not coaxial with the blade channel.

FIG. 20 illustrates the relationship between an off-axis stream 1130 that may enter a typical cartridge 990 of the prior art at an even less advantageous angle than that illustrated in FIG. 19. In this case, the cross-sectional area 1140 of that portion of the incipient stream that enters the upper mouth of the blade channel 1020 is even less than the cross-sectional area 1120 of the stream 1110 that enters the cartridge 990 in FIG. 19, and the ratio of the cross-sectional area 1140 of the influent stream 1130 to the cross-sectional area 1100 of the effluent stream 1080 will be even lower than the corresponding ratio characteristic of the arrangement illustrated in FIG. 19.

The ratio of the cross-sectional areas of the inflowing and outflowing streams of water with respect to this embodiment can be 0.5.

Figure 21:
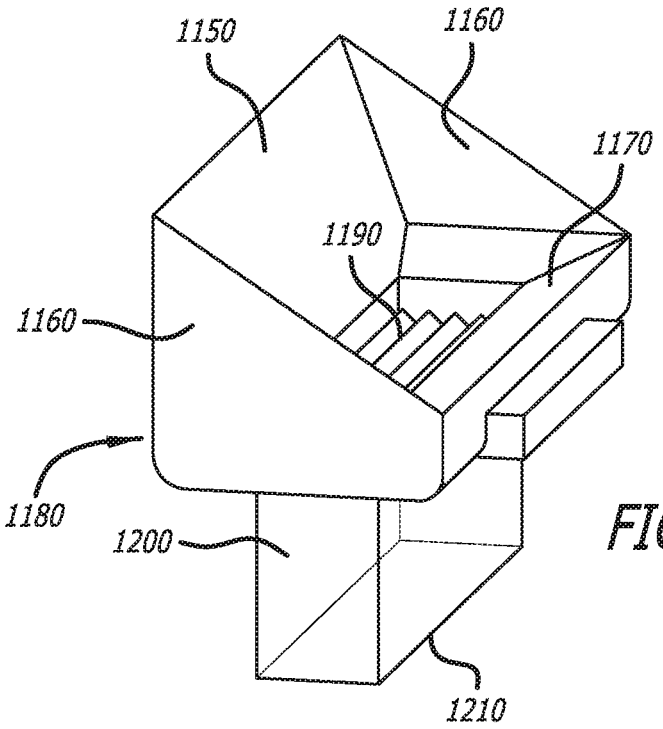
FIG. 21 is a side perspective view of a razor head of a razor of the present disclosure, illustrating a scoop incorporated within a top portion of the razor head.

FIG. 21 is an illustration of an embodiment of the present disclosure in which a scoop having sides 1150, 1160, and 1170 collects a relatively voluminous flow of water, and directs that flow through the cartridge's 1180 blades 1190 and blade channel. The effluent stream 1200 that exits the blade channel has a cross-sectional area 1210 significantly smaller than the cross sectional area of the scoop's opening (which is defined by the top edges of the scoop's four sides 1150, 1160, and 1170).

The ratio of the cross-sectional areas of the inflowing (not shown) and outflowing streams of water with respect to this embodiment can be 3.53, which is significantly greater than the ratio associated with prior art razors.

Figure 22:
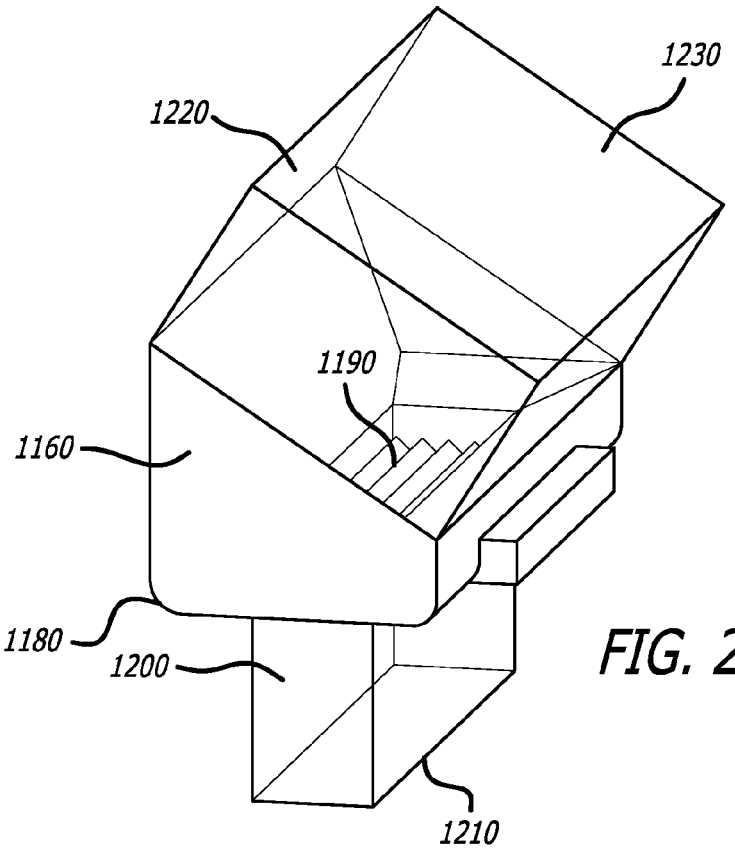
FIG. 22 is a side perspective view of the razor head of FIG. 21, illustrating a scoop incorporated within a top portion of the razor head, and further illustrating the entry of a flow into the scoop of significantly greater cross-sectional area than the cross-sectional area of the flow out of the blade channel.

FIG. 22 is the same embodiment as in FIG. 21 but with the maximal stream 1220 that can enter the scoop 1160 illustrated. The cross-sectional area 1230 of this maximal input stream is significantly greater than the cross-sectional area 1210 of the effluent stream 1200. The ability of this embodiment to divert a volume and rate of water flow into the blade channel 1190 is significantly greater than the corresponding volume and rate of flow that is able to escape the blade channel which provides many advantages.

The greater volume and rate of flow entering the scoop of the razor illustrated in FIG. 22 causes more water to flow over and through the blades 1190 therein per unit time. This expedites the dissolution and dislodging of used lubricants and cut hairs in an obvious fashion, i.e. more water, faster water, and more thorough and faster cleaning.

Moreover, the greater volume and rate of water entering the scoop 1160 also means that this embodiment creates flow conditions that tend to lead to the manifestation of a Venturi effect. The water flowing through the scoop, and into the smaller entry mouth of the blade channel 1190, speeds up so that the greater volume and rate of water flow can still exit through the blade channel's 1190 exit mouth of relatively smaller cross-sectional area. By flowing more quickly, the water flowing through the blade channel 1190, and over and between the blades therein, will more forcefully impact any residue of lubricant and/or cut hairs and thus flush them out more effectively and more efficiently.

As with the similar embodiment illustrated in FIG. 21, the ratio of the cross-sectional areas of the inflowing and outflowing streams of water with respect to this embodiment can be 3.53.

Figure 23:
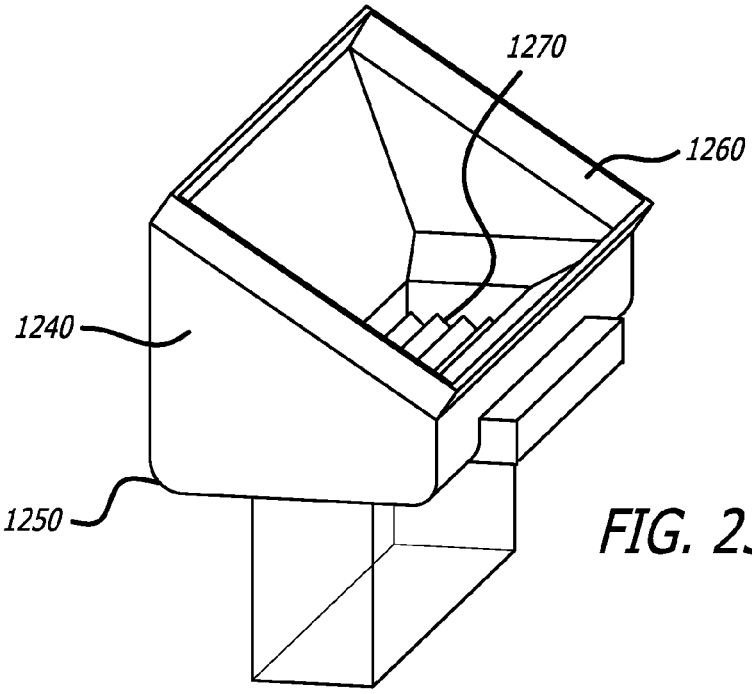
FIG. 23 is a side perspective view of a razor head of a razor of the present disclosure, illustrating a scoop incorporated within a top portion of the razor head.

FIG. 23 illustrates an embodiment of the present disclosure similar to the ones illustrated in FIGS. 21 and 22. However, in this case, the scoop 1240 of the embodiment 1250 has been modified to include a "collar" 1260, namely, a square cylindrical channel attached to the original entry mouth of the scoop 1240. Collar 1260 is oriented such that its walls are normal to the plane of the scoop's 1240 entry mouth, thus the collar will not block a stream entering the scoop (and collar) parallel to their longitudinal axes.

The presence of the collar 1260 may allow additional water to accumulate in the scoop thus providing increased pressure to drive the water through the blade channel 1270, and providing improved distribution of water when the input flow is unable to fill the cross-sectional area of the scoop's entry mouth, i.e. when the stream entering the scoop is not uniform and/or of insufficient diameter to simultaneously cover all parts of the entry mouth with an influx of water.

As with the similar embodiments illustrated in FIGS. 21 and 22, the ratio of the cross-sectional areas of the inflowing and outflowing streams of water with respect to this embodiment can be 3.53.

Figure 24:
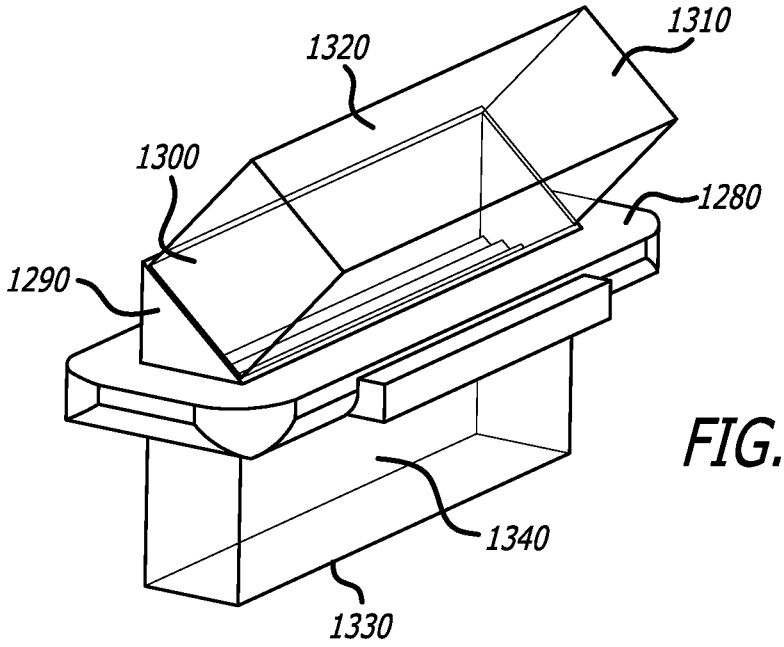
FIG. 24 is a side perspective view of a razor head of a razor of the present disclosure, illustrating a scoop incorporated within a top portion of the razor head.

FIG. 24 illustrates an embodiment 1280 of the present disclosure in which the scoop 1290 has a diagonally-oriented scoop entry mouth 1300 which directs water into the blade channel. In this embodiment, the blade channel is actually contiguous with, and/or integrated with, the scoop. This embodiment's scoop is composed of extensions of three of the blade channel's walls (i.e. the distal and side walls, e.g. 1290). By presenting an off-axis mouth to the otherwise rectangular blade channel, the cross-sectional area 1310 of the entry mouth 1300 and of the maximally-voluminous water stream 1320 that may therein enter, is increased by a factor of 1.414×, i.e. the relative length of the hypotenuse on a right triangle, wherein the lengths of the sides forming the right angle are of equal lengths, relative to the cross-sectional area 1330 of the exit mouth, and the maximally-voluminous water stream 1340 that may therefrom exit the blade channel.

The ratio of the cross-sectional areas of the inflowing and outflowing streams of water with respect to this embodiment can be 1.32.

Figure 25:
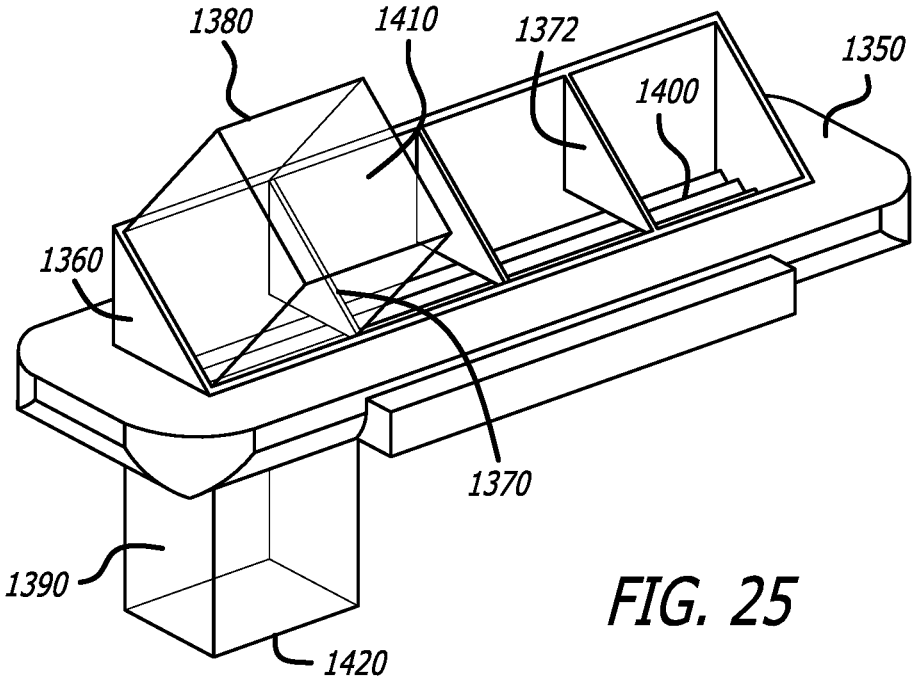
FIG. 25 is a side perspective view of a razor head of a razor of the present disclosure, illustrating a scoop incorporated within a top portion of the razor head, and including vertical partitions within the scoop.

FIG. 25 illustrates an embodiment similar to the one illustrated in FIG. 24. However, this embodiment 1350 includes a scoop 1360 that includes "sub-dividing" partitions, e.g. 1370 and 1372. These partitions divide the scoop into what are effectively multiple separate adjacent scoops. And, the water, e.g. 1380, that flows into any one scoop will tend to primarily flow, e.g. 1390, out of the corresponding portion of the blade channel 1400.

For example, water 1380 flowing into the leftmost sub-division in the illustrated embodiment, i.e. the sub-divided portion of the scoop delineated by partitions 1360 and 1370, will have a cross-sectional area 1410. However, most, if not all, of that water 1380 will pass through a corresponding sub-division of the blade channel. That water 1390, after perhaps dislodging, dissolving and/or otherwise freeing used lubricant and/or cut hairs from between that portion of the blades located within the corresponding sub-division of the blade channel, then flows out of that corresponding portion of the blade channel 1400.

While the cross-sectional area of 1410 of the maximal stream 1380 able to flow into the leftmost sub-division is less than the area of the maximal stream that would have been able to flow into an undivided scoop (e.g. 1310 of FIG. 24), so too the cross-sectional area 1420 of the effluent stream 1390 is less than the area (e.g. 1330 of FIG. 24) of the effluent stream (e.g. 1340 of FIG. 24) that would have been able to flow out of an undivided blade channel (or, equivalently, out of a blade channel in communication with an undivided scoop). The ratio of the inflowing and outflowing cross-sectional areas remains, at least approximately, equal to the ratio that characterized the similar undivided embodiment (e.g. 1290 of FIG. 24).

The embodiment illustrated in FIG. 25 incorporates subdividing partitions 1360, 1370, and 1372 that do not extend down into the blade channel 1400 so far as to cause their lower edges to be contiguous with the upper edges of the blades within the channel 1400. This allows a relatively small portion of the water impinging upon any particular sub-division of the scoop to flow laterally as well as downwardly, thus permitting debris lodged between those portions of the blades directly beneath a partition to be removed.

The use of a sub-divided scoop, like the one illustrated in FIG. 25, offers many advantages and some drawbacks. If a user must clear the blades of his razor using only a relatively weak stream of water (e.g. low water pressure, defective faucet, corroded water pipes, etc.) then that process will be more effective if the available stream of water can be used to sequentially "saturate" the relatively smaller scoop subdivisions, rather than a relatively expansive undivided scoop. On the other hand, when used in conjunction with an incident stream of water that would otherwise be sufficiently voluminous and/or rapid to fill an undivided scoop, the presence of sub-dividing partitions may require the user to move the razor head laterally while flushing debris from the blades so as to ensure that the stream impinges upon all portions of the blade channel and blades.

A fully saturated scoop, and/or scoop sub-division, has the greatest opportunity to fully flush out lubricants, cut hairs and/or other undesirable contaminants from around and/or between a razor's blades. It is the flow condition most likely to reach every space between and around a razor's blades, and the flow condition least likely to leave any portion of the blade channel "un-flushed."

And, a fully saturated scoop, and/or scoop sub-division, has the greatest potential to develop an accelerated flow through the blades through the manifestation of a Venturi effect, and an accelerated flow will more efficiently and more completely remove blade contaminants.

A user may find that it takes more time to flush each sub-division individually, than it does to flush them all by means of a single, undivided scoop.

As with the similar embodiment illustrated in FIG. 24, the ratio of the cross-sectional areas of the inflowing and outflowing streams of water with respect to each subdivision of the scoop of this embodiment can be 1.32.

Figure 26:
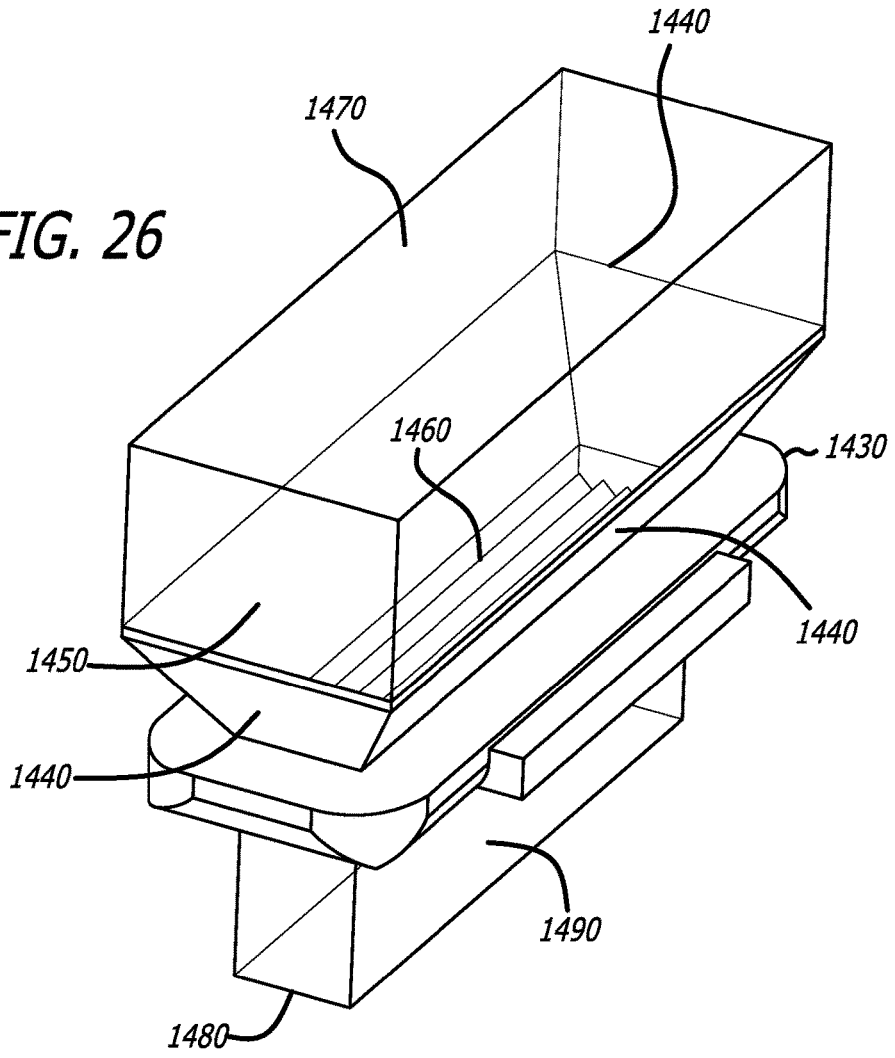
FIG. 26 is a side perspective view of a razor head of a razor of the present disclosure, illustrating a scoop connected to a top portion of the razor head.

FIG. 26 illustrates an embodiment 1430 of the present disclosure in which an upward-facing scoop 1440 acts as a scoop or "funnel," accepting and/or accumulating a relatively large volume and rate of water flow 1450 and directing it into an adjacent blade channel 1460. This scoop 1440 is formed by four angled walls that form a rectangular funnel shape. The cross-sectional area 1470 of the maximally-sized stream 1450 able to enter the scoop 1440 and flush debris from between and around the blades 1460 in the blade channel is significantly greater than the cross-sectional area 1480 of the maximally-sized stream 1490 able to exit the blade channel 1460. This is expected to create a Venturi effect, and accelerate the water flowing through the blade channel 1460, providing for a more efficient cleansing of the blades therein.

The ratio of the cross-sectional areas of the inflowing and outflowing streams of water with respect to this embodiment can be 3.01.

Figure 27:
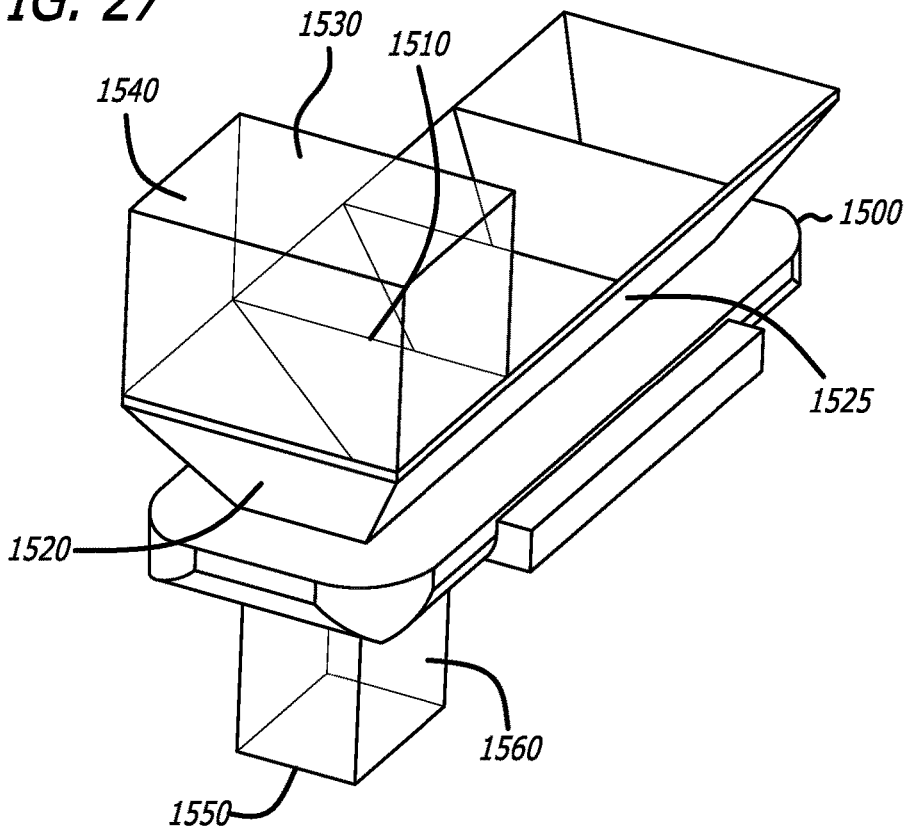
FIG. 27 is a side perspective view of a razor head of a razor of the present disclosure, illustrating a scoop connected to a top portion of the razor head, and including vertical partitions within the scoop.

FIG. 27 illustrates an embodiment 1500 of the present disclosure similar to the one illustrated in FIG. 26. This embodiment has partitions 1510 within the scoop 1520 and 1525 which effectively divide the scoop into a set of adjacent, smaller scoops. As was discussed in relation to FIG. 25, the division of the scoop offers useful advantages, especially in certain circumstances (e.g. lack of user access to an adequate water source).

While the cross-sectional area 1530 of the maximal stream 1540 able to flow into the leftmost sub-division (i.e. between walls 1520 and 1510) is less than the area of the maximal stream that would have been able to flow into an undivided scoop (e.g. 1470 of FIG. 26), so too the cross-sectional area 1550 of the effluent stream 1560 is less than the area (e.g. 1480 of FIG. 26) of the effluent stream (e.g. 1490 of FIG. 26) that would have been able to flow out of an undivided blade channel (or, equivalently, out of a blade channel in communication with an undivided scoop). The ratio of the inflowing and outflowing cross-sectional areas remains, at least approximately, equal to the ratio that characterized the similar undivided embodiment (e.g. 1430 of FIG. 26).

As with the similar embodiment illustrated in FIG. 26, the ratio of the cross-sectional areas of the inflowing and outflowing streams of water with respect to each subdivision of the scoop of this embodiment can be 3.01.

Figure 28:
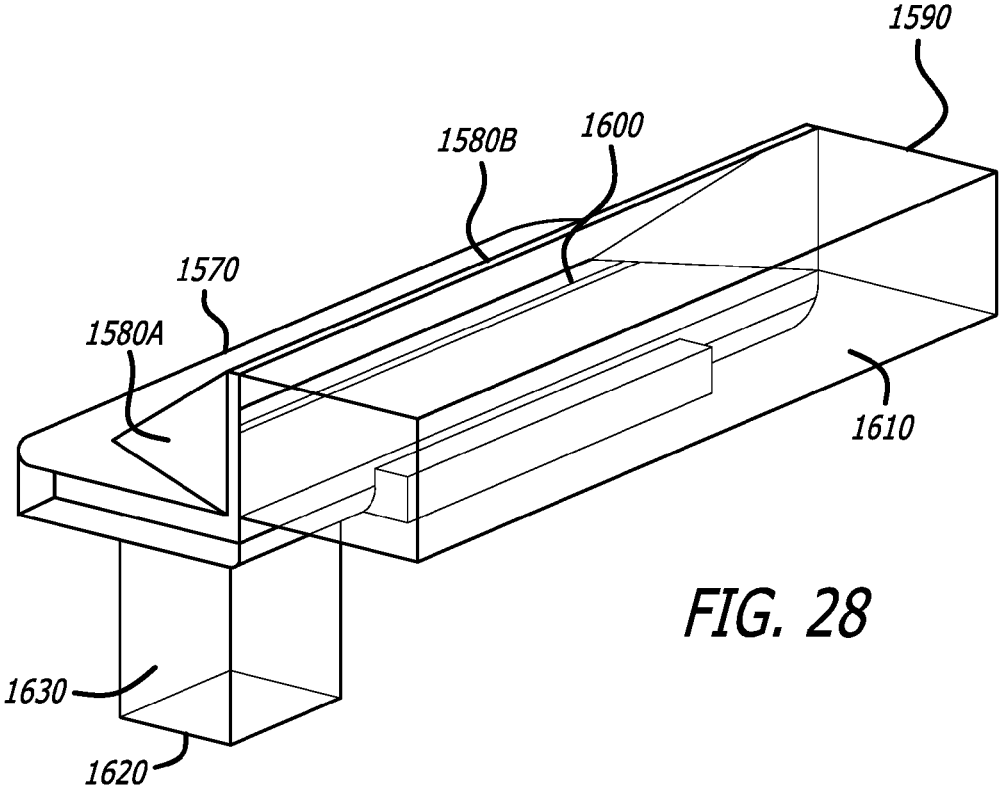
FIG. 28 is a side perspective view of a razor head of a razor of the present disclosure, illustrating a scoop connected to a top portion of the razor head.

FIG. 28 is an illustration of an embodiment 1570 in which the scoop 1580 opens horizontally and/or laterally, in a direction facing the user's typical position (i.e. to the right of the illustrated cartridge embodiment).

When this embodiment is rotated, so as to orient the scoop mouth within a horizontal plane, and then moved into a stream of water issuing from the tap on a sink, it tends to "reflect" the inflowing stream 1590 of water off the primary wall 1580B of the scoop, through a ninety degree change in direction, and into the adjacent blade channel 1600. The flow of water through the blade channel 1600 will not only benefit from the scoop's ability to capture a stream 1590 of water greater in volume and rate of flow (i.e. greater in cross-sectional area 1610) than that which the blade channel 1600 could directly capture; and it will not only benefit from an acceleration in the speed of flow of the water through the blade channel 1600 caused by a Venturi effect; the flow through the blade channel in this embodiment will also benefit from the redirection of at least a portion of the kinetic energy of the incoming stream 1590 directly into the blade channel 1600.

Because of the scoop's 1580 greater lateral extent than the blade channel 1600, and its height of equal or greater extent than the corresponding width of the blade channel, the cross-sectional area of the maximally-voluminous water stream 1590 will be significantly greater than the cross-sectional area 1620 of the effluent water stream 1630.

The ratio of the cross-sectional areas of the inflowing and outflowing streams of water with respect to this embodiment can be 1.46.

Figure 29:
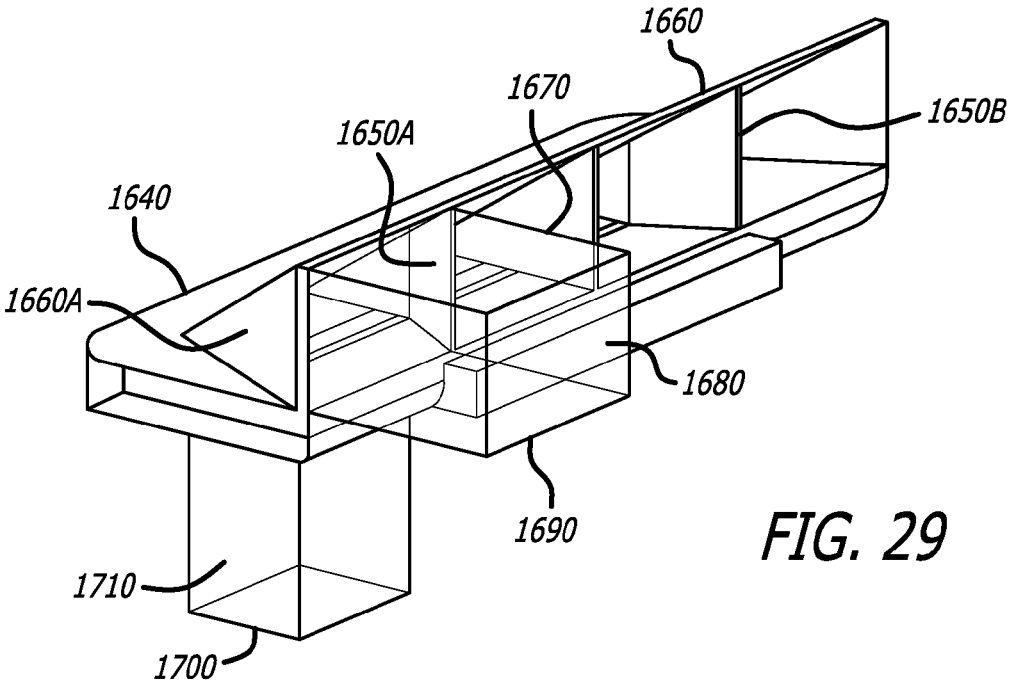
FIG. 29 is a side perspective view of a razor head of a razor of the present disclosure, illustrating a scoop connected to a top portion of the razor head, and including vertical partitions within the scoop.

FIG. 29 is an illustration of an embodiment 1640 of the present disclosure that is similar to the embodiment 1570 illustrated in FIG. 28. However, embodiment 1640 uses partitions, e.g. 1650, to sub-divide the scoop 1660 into an adjacent set of smaller scoops.

As with the similar embodiment illustrated in FIG. 28, the ratio of the cross-sectional areas of the inflowing and outflowing streams of water with respect to each sub-division of the scoop of this embodiment can be 1.46.

Figure 30:
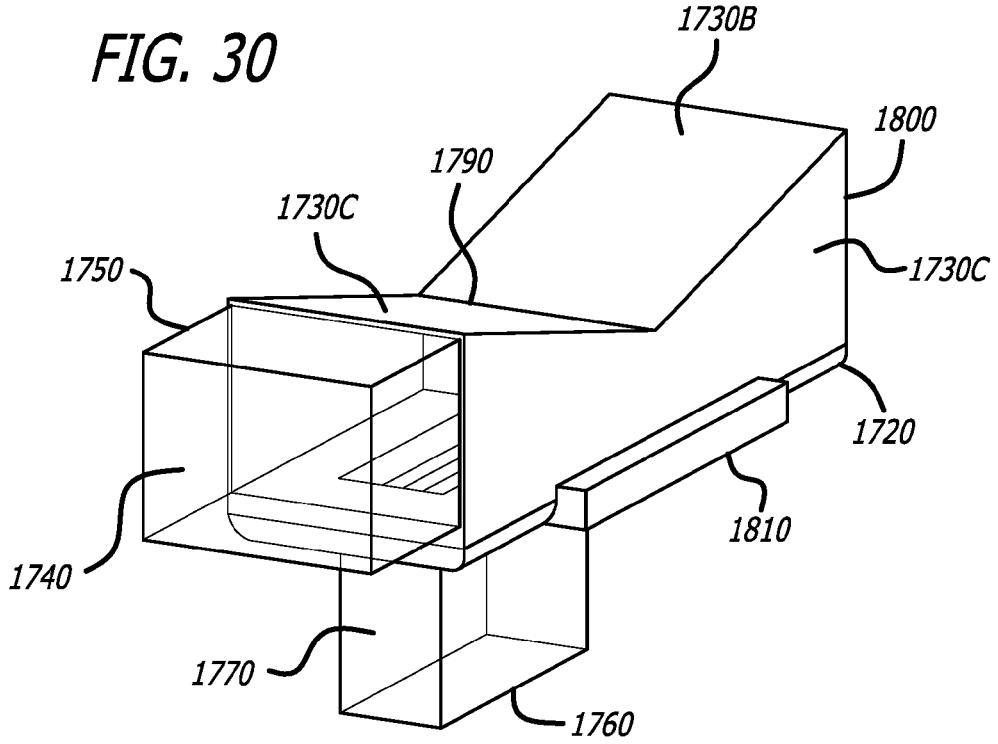
FIG. 30 is a side perspective view of a razor head of a razor of the present disclosure, illustrating a bifurcated scoop connected to a top portion of the razor head.

FIG. 30 is an illustration of an embodiment 1720 of the present disclosure. This embodiment accepts water from the sides, one side at a time, and a central partition divides the scoop 1730 into left and right halves.

The cross-sectional area 1740 of water 1750 entering the left side 1730A of the embodiment is greater than the cross-sectional area 1760 of the water 1770 that will pass through and then exit the blade channel 1780. As was the case with the embodiments illustrated in FIGS. 28 and 29, the inflowing water 1750 in this embodiment 1720 will tend to strike the angled upper wall 1730A and be reflected, at least partially, directly into the corresponding portion of the underlying blade channel 1780.

A vertical wall, and/or central partition, (i.e. beneath seam 1790) separates the two side-facing scoop sub-divisions so that water entering one side will tend to pass through, and flush debris from, only the corresponding side of the blade channel 1780. The lower edge of the central partition in the scoop 1730 of the embodiment illustrated in FIG. 30, does not contact the upper edges of the blades 1780, thereby allowing water passing through either half of the scoop to move laterally while passing through the blades 1780 to a sufficient extent so as to remove any debris trapped between the blades in the area below the central partition.

The ratio of the cross-sectional areas of the inflowing and outflowing streams of water with respect to this embodiment can be 1.42.

Figure 31:
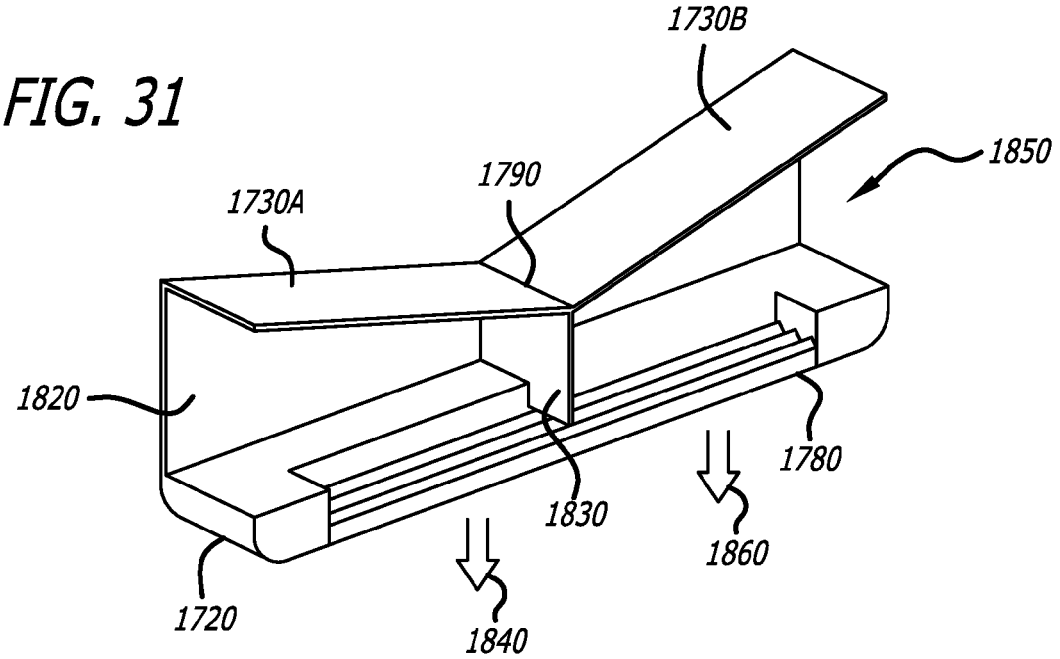
FIG. 31 is a cross-sectional view of the razor head of FIG. 30, and including a bifurcated scoop.

FIG. 31 provides a cross-sectional view of embodiment 1720 of FIG. 30.

Referring thereto, water entering 1820 the left-facing sub-division 1730A of the scoop is constrained by the vertical wall 1830 to pass down and through that portion of the blade channel 1780 underlying the scoop sub-division 1730A and exit at 1840. By contrast, water entering 1850 the right-facing sub-division 1730B of the scoop is constrained by the vertical wall 1830 to pass down and through that portion of the blade channel 1780 underlying the scoop sub-division 1730B and exit at 1860.

Figure 32:
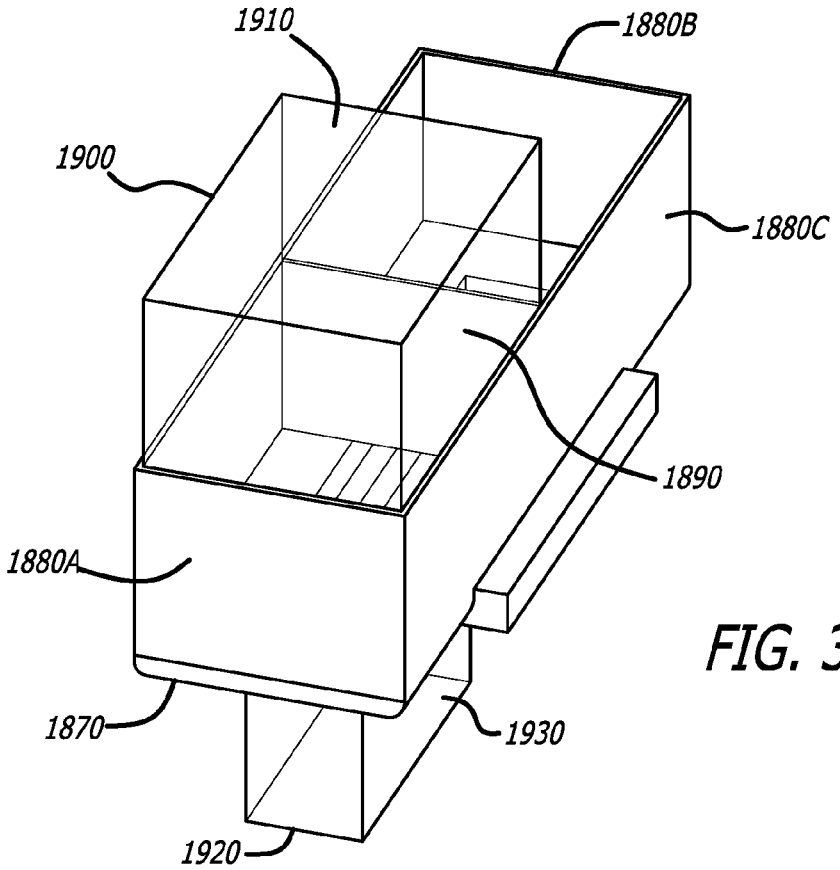
FIG. 32 is a side perspective view a razor head of a razor of the present disclosure, illustrating a bifurcated scoop connected to a top portion of the razor head.

FIG. 32 illustrates an embodiment 1870 that accepts water from and/or through two sub-divisions of an upward-facing box-like scoop 1880. The outer walls, e.g. 1880, are divided into two sub-divisions by a partition 1890. Water 1900 entering the left-most sub-division (i.e. between 1880A and 1890) has a cross-sectional area 1910 that is greater than the cross-sectional area 1920 of the water 1930 that passes through and exits the complementary, left-most portion of the blade channel. The same is true of the right-side sub-division of the scoop and complementary, right-most portion of the blade channel.

The ratio of the cross-sectional areas of the inflowing and outflowing streams of water with respect to each sub-division of the scoop of this embodiment can be 2.84.

Figure 33:
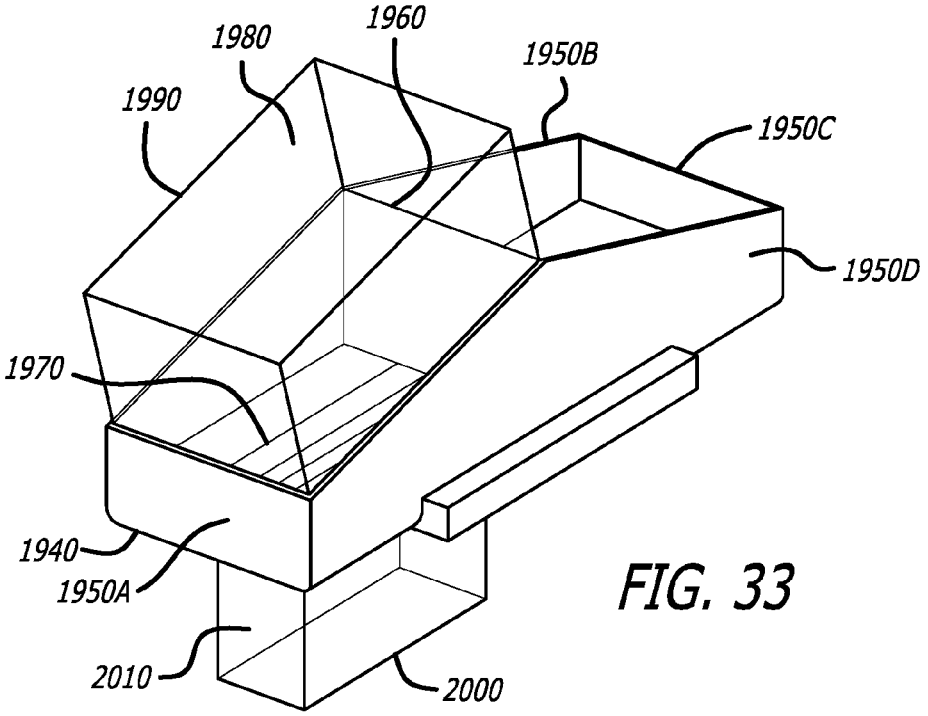
FIG. 33 is a side perspective view of a razor head of a razor of the present disclosure, illustrating a bifurcated scoop connected to a top portion of the razor head.

FIG. 33 is an illustration of an embodiment 1940 of the present disclosure. As was true for the embodiment 1870 illustrated in FIG. 32, this embodiment also accepts water from two sub-divisions of an upward-facing, box-like scoop 1950. The two sub-divisions are separated by a vertical partition 1960. However, unlike the embodiment 1870 illustrated in FIG. 32, the scoop sub-divisions in embodiment 1940 are tapered such that the partition wall 1960 is taller than the opposing outer side walls 1950A and 1950C.

The ratio of the cross-sectional areas of the inflowing and outflowing streams of water with respect to each sub-division of the scoop of this embodiment can be 2.95.

Figure 34:
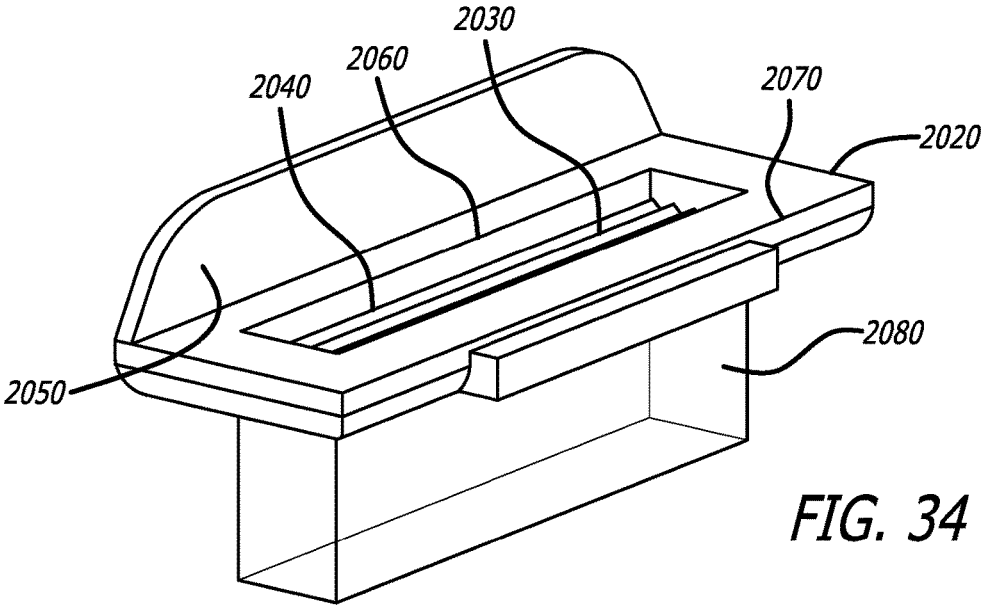
FIG. 34 is a side perspective view of a razor head of a razor of the present disclosure, illustrating a distal wall connected to a top portion of the razor head, wherein the distal wall creates a scoop with an irregular and/or non-planar inflow mouth.

FIG. 34 illustrates an embodiment 2020 of the present disclosure in which water is still able to directly enter 2030 the blade channel 2040. However, a single barrier 2050, or "wall", at the distal end of the cartridge (or razor) provides a block that redirects 2060 some water, such as that approaching on an angle 2060, that would have otherwise missed the blade channel 2040 and/or been deflected off its upper surface, or missed the cartridge 2020 entirely, back towards the blade channel 2040.

This embodiment uses an "open channel" rather than a "closed channel." And, while some incident water may still escape to, off, and/or over, the sides of the cartridge (i.e. in the absence of side walls and/or a complete scoop channel), this embodiment will nonetheless increase the amount of water from an incident stream that can be directed into the blade channel and therein remove debris from between and around the blades.

This embodiment illustrates a scoop possessing an irregular mouth and/or channel edge. The effective cross-sectional area of such an irregular scoop channel will vary with the angle at which water impinges upon the cartridge. With respect to the illustrated embodiment 2020, the maximally-voluminous incident stream will be achieved by a stream entering the irregular scoop mouth at an angle approximately normal to the plane that passes through the upper edge of the distal wall 2050 and the upper edge 2070 of the cartridge 2020 furthest from the distal wall 2050.

This embodiment is simpler in construction and may be easier to package efficiently than embodiments with relatively large scoops, and/or scoops with three or more walls.

Figure 35:
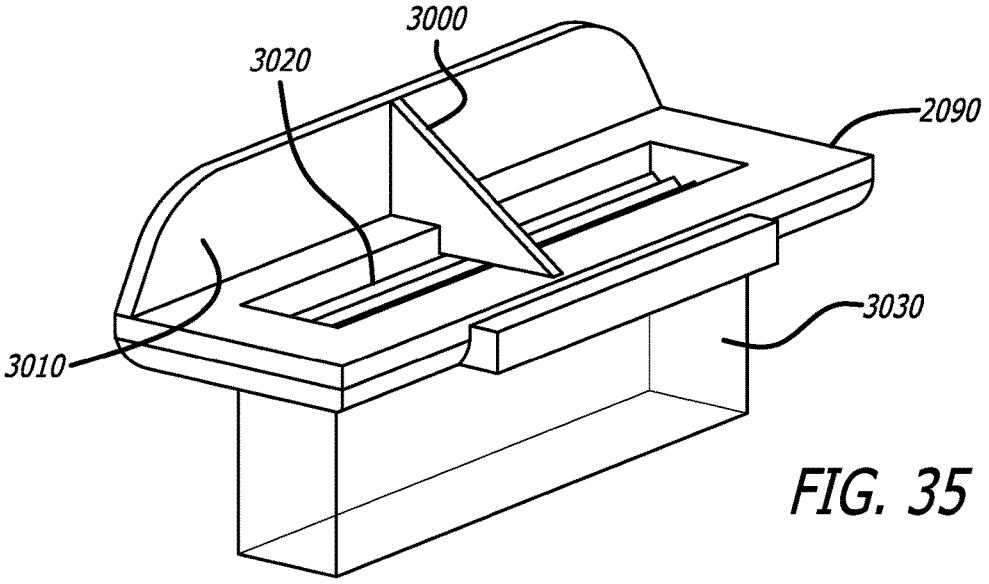
FIG. 35 is a side perspective view of a razor head of a razor of the present disclosure, illustrating a distal wall connected to a top portion of the razor head, wherein the distal wall creates a scoop with an irregular and/or non-planar inflow mouth, and including a vertical partition.

FIG. 35 illustrates an embodiment 2090 that is similar to embodiment 2020 of FIG. 34. However, this embodiment includes a partition 3000, in addition to a distal barrier 3010. This will further improve the efficiency of the cartridge's rinsing by blocking some of an inflowing stream that might have otherwise been deflected off the side of the cartridge. The partition 3000 helps increase the amount of an inflowing stream of water that is deflected into the blade channel 3020. And, the optimal angle at which water may be introduced to either half of the partitioned irregular scoop will be the same as that for the embodiment 2020 illustrated in FIG. 34, but tilted so as to slightly raise the side of the scoop and/or cartridge being flushed.

FIG. 36 is an illustration of an embodiment 3040 that is similar to the embodiments illustrated in FIGS. 21 and 22. However, this embodiment incorporates distal 3050 and proximal 3060 walls that are "sculpted" and/or contoured so as to better and/or more smoothly redirect an inflowing stream through, and thereby reduce the frequency and/or severity of turbulence, and thereby promote a laminar flow. In this embodiment, portions of the side walls, e.g. 3070, most proximate to the blade channel are similarly contoured.

FIG. 37 is a cross-sectional view of the embodiment of FIG. 36. Referring thereto the contoured and/or sculpted interior surfaces of the distal 3050 and proximal 3070 walls of the scoop can be seen. When a stream of water 3080 enters the scoop normal to the scoop mouth, the shapes of the interior surfaces of the distal 3050 and proximal 3070 walls help to smoothly direct the water into the blade channel with a minimum of turbulence, thereby enhancing the strength and/or magnitude of the Venturi effect that will speed the water through the blade channel and between and around the blades therein.

Figure 38:
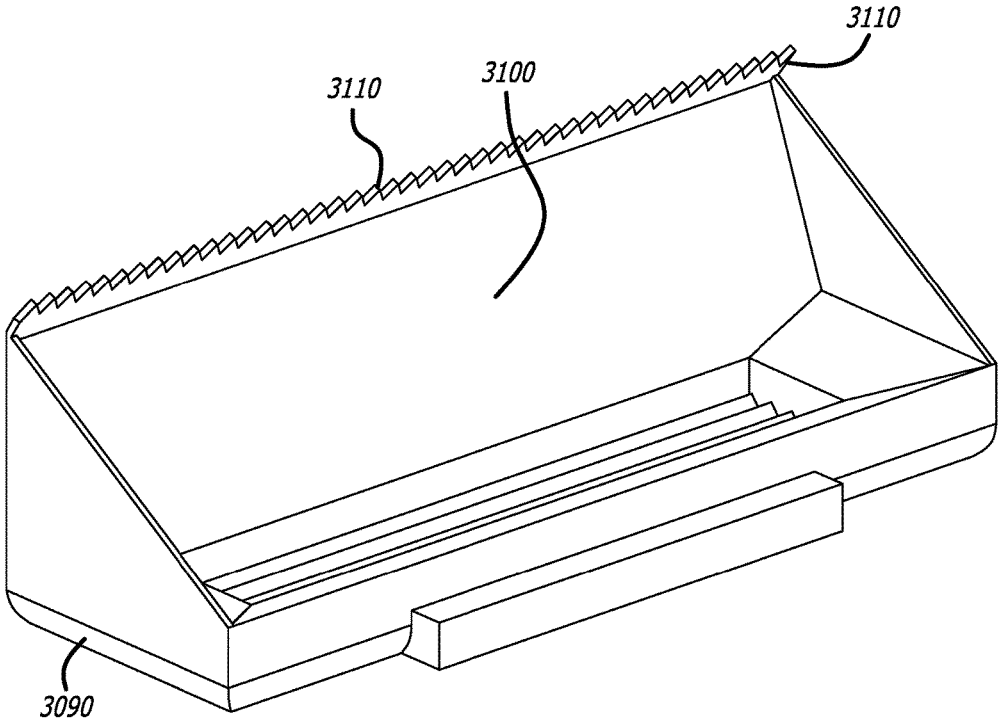
FIG. 38 is a side perspective view of a razor head of a razor of the present disclosure, in which an upper and/or distal edge of the scoop includes a serrated edge.

FIG. 38 illustrates an embodiment 3090 that is similar to those in FIGS. 21 and 22. However, this embodiment incorporates at the upper edge of the distal wall 3100 of its scoop a "toothed comb" 3110 which may be useful to some users, e.g. for preparing a set of hairs for an efficient trimming or for removing shaving-related debris from at least a portion of their skin after having shaved.

Figure 39:
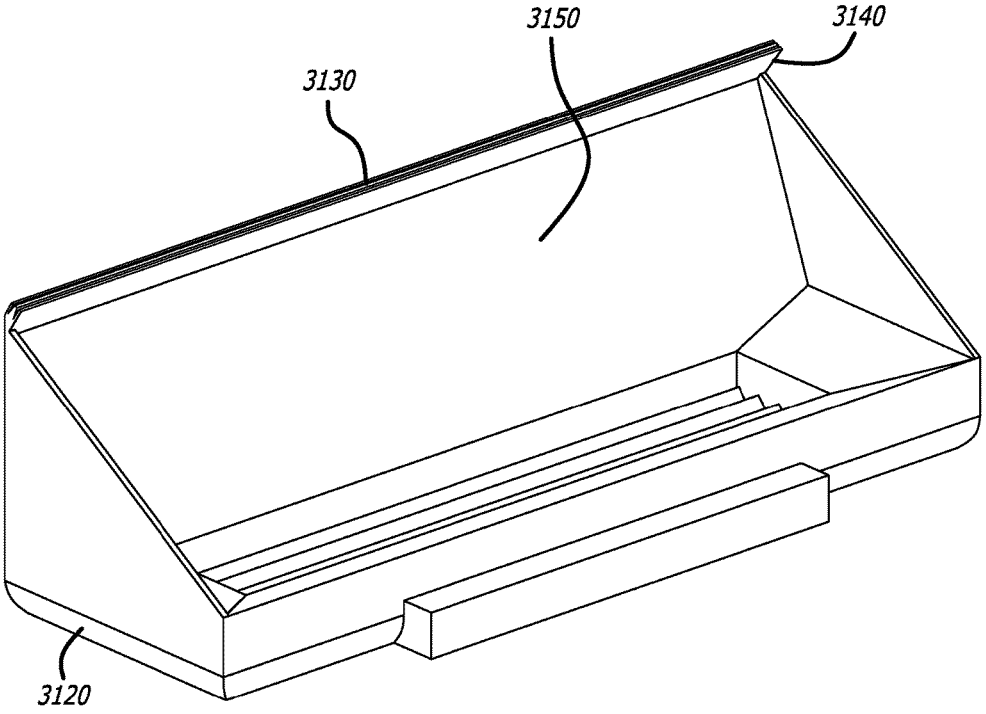
FIG. 39 is a side perspective view of a razor head of a razor of the present disclosure, in which an upper and/or distal edge of the scoop includes a razor blade.

FIG. 39 illustrates an embodiment 3120 of the present disclosure in which a separate "trimming" blade 3130 is provided at the upper edge 3140 of the distal wall 3150 of the scoop. The user's access to a separate single blade (i.e. in addition to the one or more blades within the blade channel used for shaving) allows the user to create linear edges in regions of shaved hairs, such as for providing a linear bottom edge to a man's sideburns.

Figure 40:
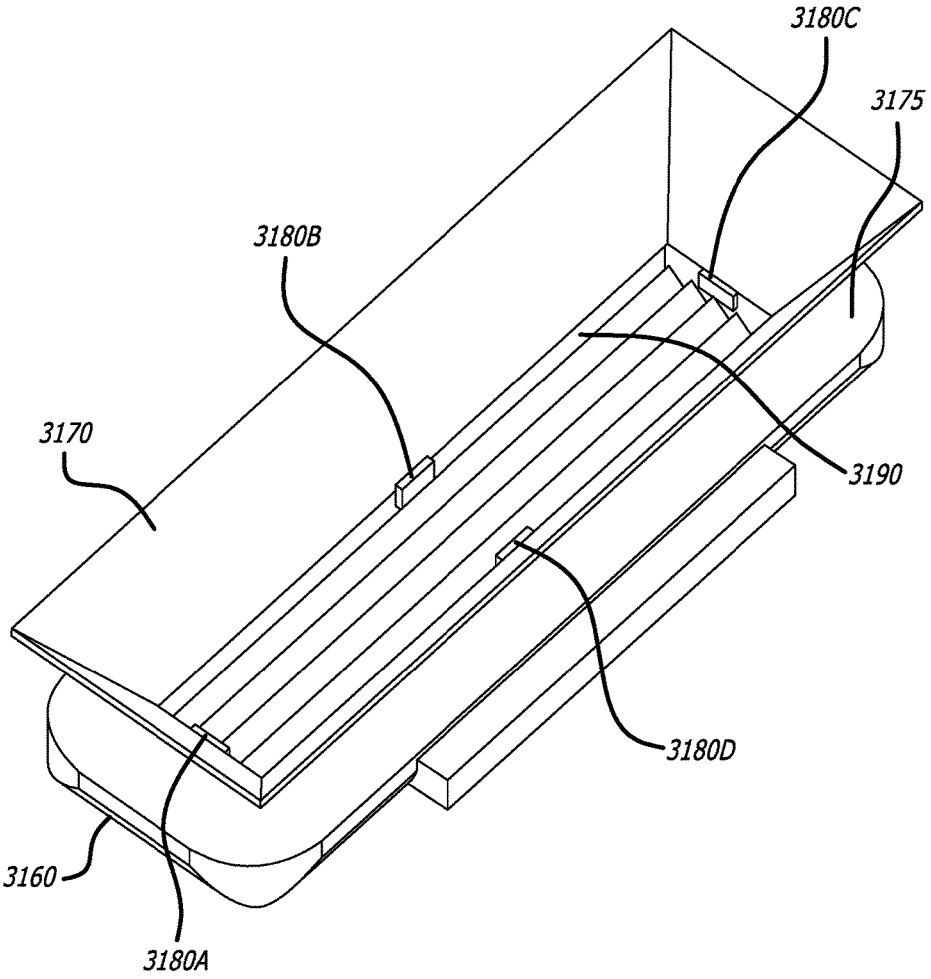
FIG. 40 is a side perspective view a razor head of a razor of the present disclosure, illustrating a detachable scoop removably connected to a top portion of the razor head by clips connecting to a surface within the blade channel.

FIG. 40 is an illustration of an embodiment 3160 of the present disclosure. In this embodiment, the scoop 3170 attaches to, and may be removed from (and potentially reused on other cartridges), an upper surface 3175 of the cartridge, and/or a surface adjacent to that upper surface, by means of "clips" 3180 that latch onto and/or otherwise attach to, at least one interior surface and/or point on the interior wall(s), e.g. 3190, and/or perimeter of a cartridge's blade channel. The clips can be integral to the detachable scoop and mate, by means of complementary interlocks and/or friction, to at least one interior surface of a cartridge's blade channel.

Figure 41:
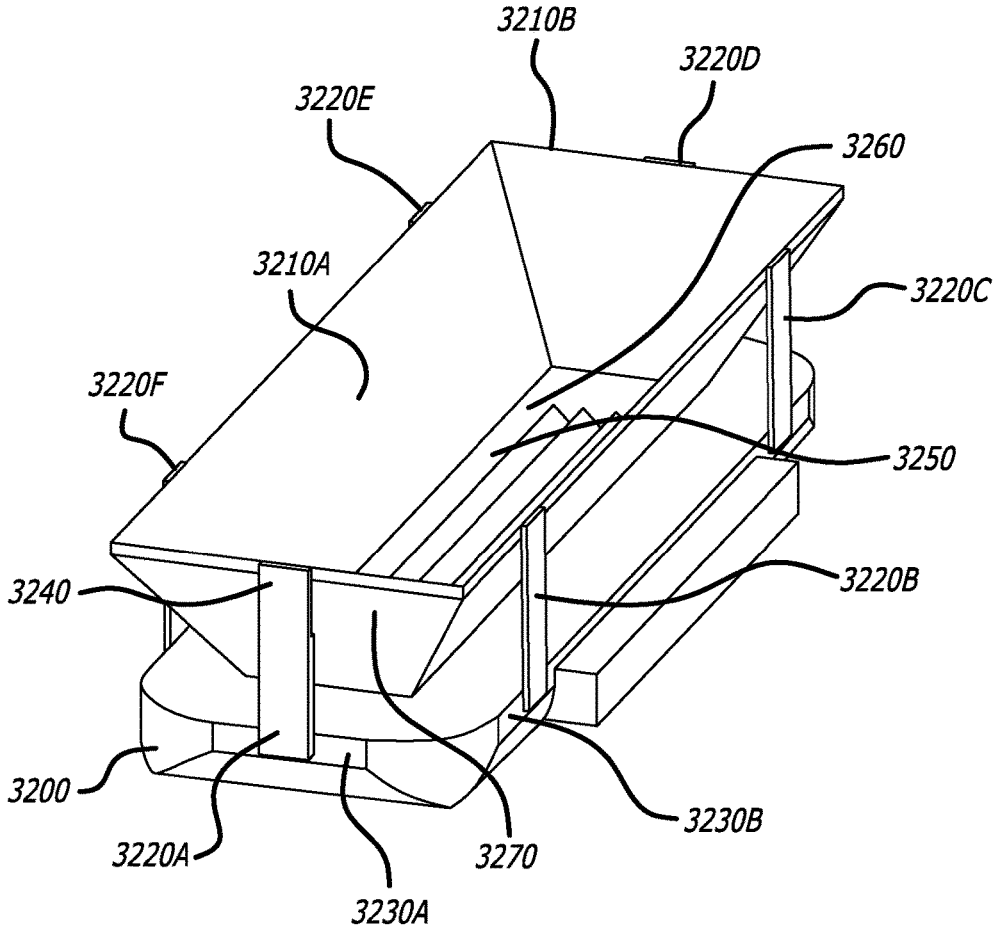
FIG. 41 is a top perspective view of a razor head of a razor of the present disclosure, illustrating a detachable scoop removably connected to a top portion of the razor head by clips connecting to an outer surface of the razor head.

FIG. 41 is an illustration of an embodiment 3200 of the present disclosure. In this embodiment, the scoop 3210 attaches to, and may be removed from (and potentially reused on other cartridges), by means of "clips" 3220 that latch onto and/or otherwise attach to, at least one exterior surface and/or point on the side wall(s), e.g. 3230, and/or perimeter of a cartridge 3200. These clips are integral to the detachable scoop and mate, by means of complementary interlocks and/or friction, to at least one exterior surface of the cartridge 3200.

Figure 42:
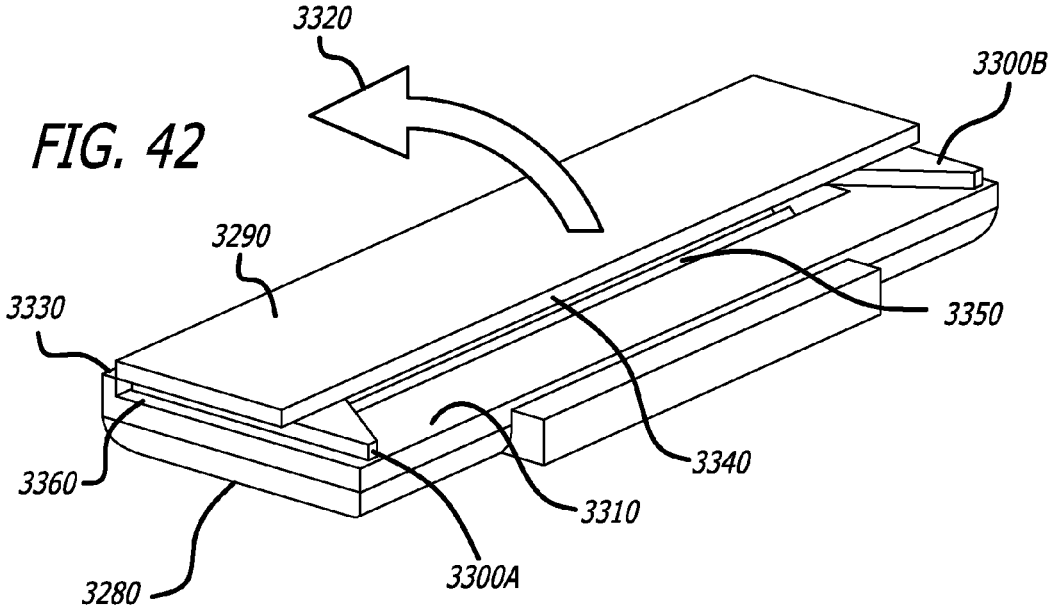
FIG. 42 is a side perspective view of a razor head of a razor of the present disclosure, illustrating a collapsible scoop attached to a top portion of the razor head, and in a fully collapsed configuration.

FIG. 42 illustrates an embodiment 3280 in which the walls 3290 and 3300 of a scoop fold down to positions adjacent to an upper surface 3310 of the cartridge 3280. The distal wall 3290 can first be rotated 3320 (by a user) back along its "hinge" 3330 leading to a configuration illustrated in FIG. 43.

Figure 43:
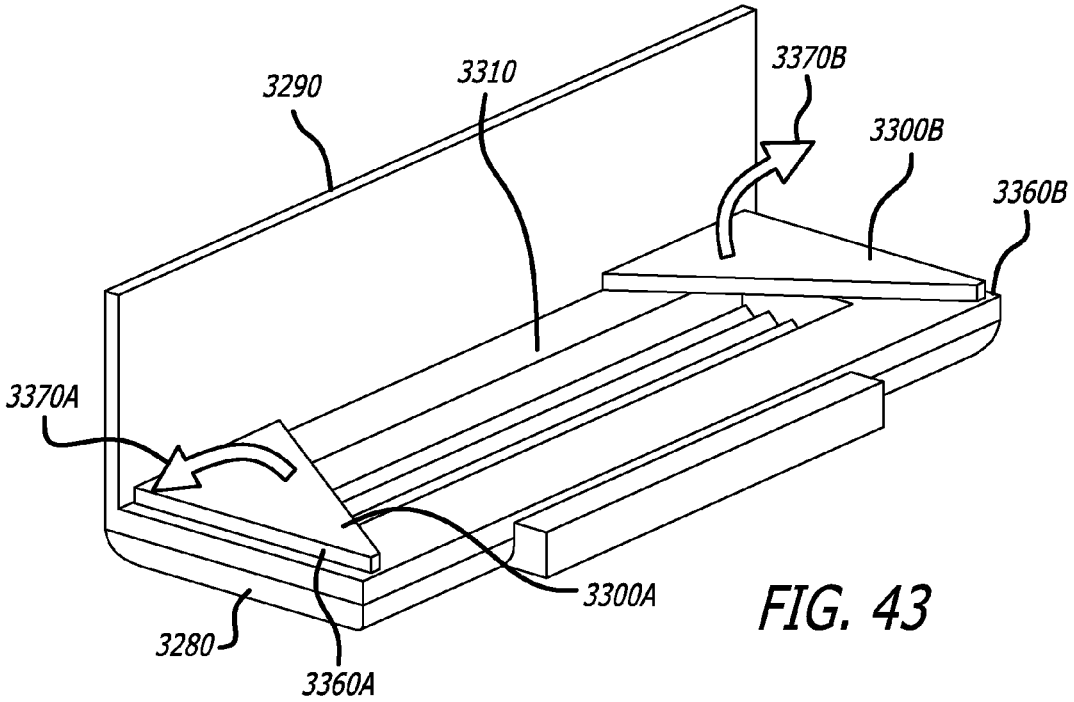
FIG. 43 is a side perspective view of the razor head of FIG. 42, illustrating the collapsible scoop in a partially erect configuration.

FIG. 43 is the same embodiment as that in FIG. 42. However, in this figure and in this configuration of the embodiment, the distal wall 3290 has been rotated (by a user) back along its "hinge" to a fully-erect orientation. In this configuration, two side walls 3300A and 3300B remain folded down against the upper surface 3310 of the cartridge 3280. A user can rotate 3370A and 3370B these side walls 3300A and 3300B, respectively, up about their hinges 3360A and 3360B, respectively, to the configuration of FIG. 44.

Figure 44:
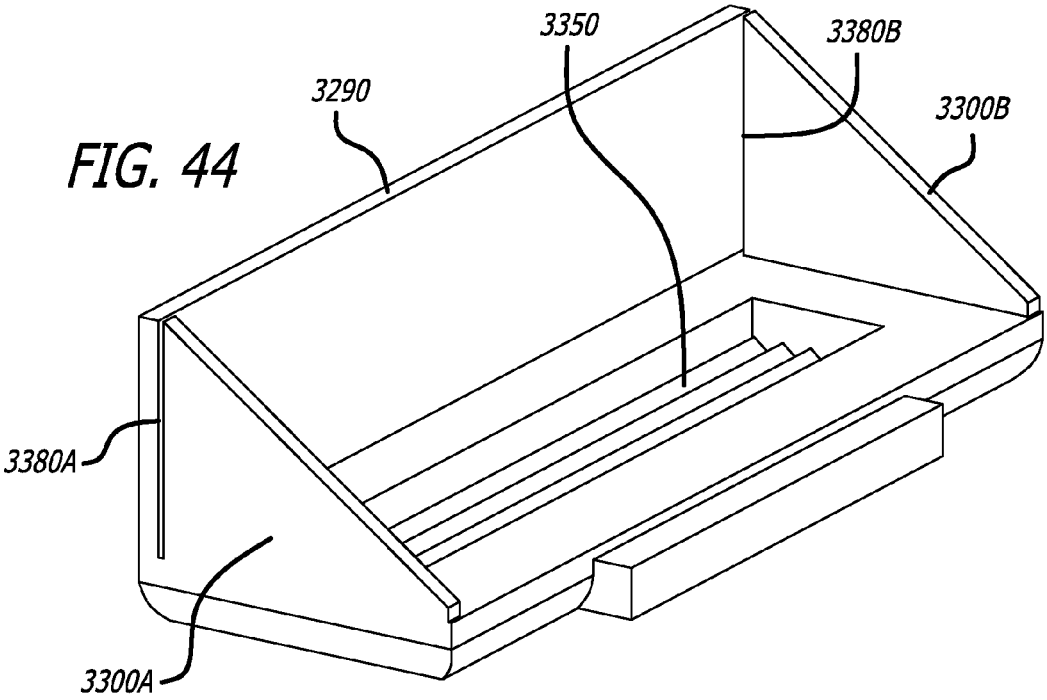
FIG. 44 is a side perspective view of the razor head of FIGS. 42 and 43, illustrating the collapsible scoop in a fully erect and operational configuration.

FIG. 44 is the same embodiment as in FIGS. 42 and 43, but in this configuration the distal wall 3290, as well as the two side walls 3300A and 3300B have been rotated (by a user) back along their "hinges" to fully-erect orientations. In this configuration, a complete and functional scoop has been formed and will direct water into the blade channel 3350.

After their rotations up to their "active" positions, each side wall can "snap" into position through the interaction of complementary tab and slot elements on the side and distal walls, e.g. located adjacent to the junctions 3380A and 3380B, and/or seams, between each side wall 3300A and 3300B, respectively, and the distal wall 3290. There are many other ways to "lock" such a scoop in its deployed and operational configuration, and all such methods and means as would be apparent to those skilled in the art are within the scope of this disclosure.

Figure 45:
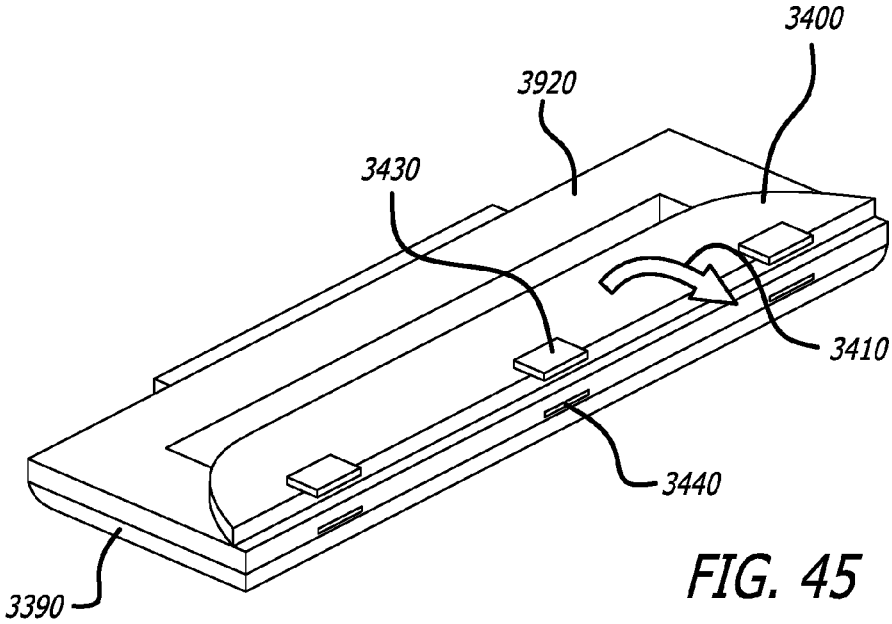
FIG. 45 is a side perspective view of a razor head of a razor of the present disclosure, illustrating a collapsible "back scoop wall" attached to a top portion of the razor head, and in a fully collapsed configuration.

FIG. 45 is an illustration of an embodiment 3390 of the present disclosure. In this embodiment, a distal barrier or wall 3400 of an irregular and/or open-channel scoop can be rotated (arrow 3410) back and/or up, and this illustration shows the distal wall 3400 in a collapsed, or folded-down, position and/or configuration, placing it adjacent to an upper surface 3420 of the cartridge 3390. The rotatable wall 3400 can be rotated (by a user) back 3410 along its "hinge" leading to a configuration illustrated in FIG. 46.

Note the presence of latching tabs 3430 and their complementary slots 3440. When the collapsed barrier wall 3400 is rotated up, the latches engage with their complementary slots and hold the distal wall 3440 in an erect orientation, i.e. they prevent the spontaneous collapse of the raised wall.

Figure 46:
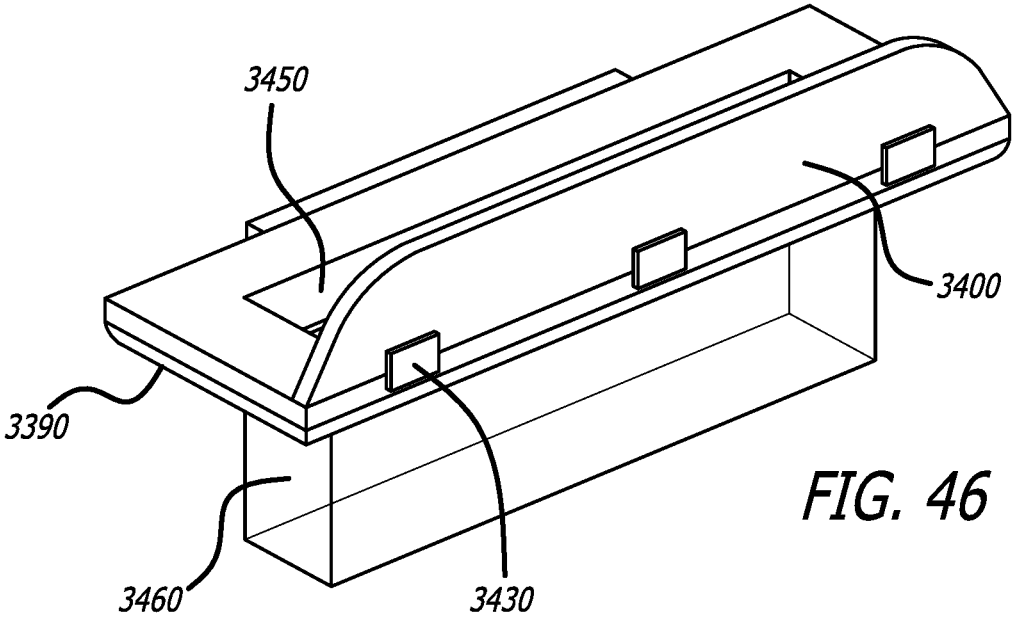
FIG. 46 is a side perspective view of the razor head of FIG. 45 illustrating the collapsible "back scoop wall" in a fully erect and operational configuration.

FIG. 46 is an illustration of the same embodiment illustrated in FIG. 45. However, in this illustration, and in this configuration of the embodiment 3390, the distal rotatable wall 3400 has been rotated (by a user) back along its "hinge" to a fully-erect orientation. In this configuration, a complete and functional irregular and/or open-channel scoop has been formed.

After its rotation up to its "active" position, the distal scoop wall 3400 can and will "snap" into position through the locking of latches 3430 into their complementary slots in the cartridge base 3390. There are many other ways to "lock" such a scoop wall in its deployed and operational configuration, and all such methods and means as would be apparent to those skilled in the art are included within the scope of this disclosure.

A significant portion of water flowing in a direction 3450 that leads it to collide with an upper surface of the cartridge 3390, and/or the barrier wall 3400 positioned at its distal end, will be redirected so as to flow through the blade channel and out 3460 of the outflow mouth of the blade channel.

Figure 47:
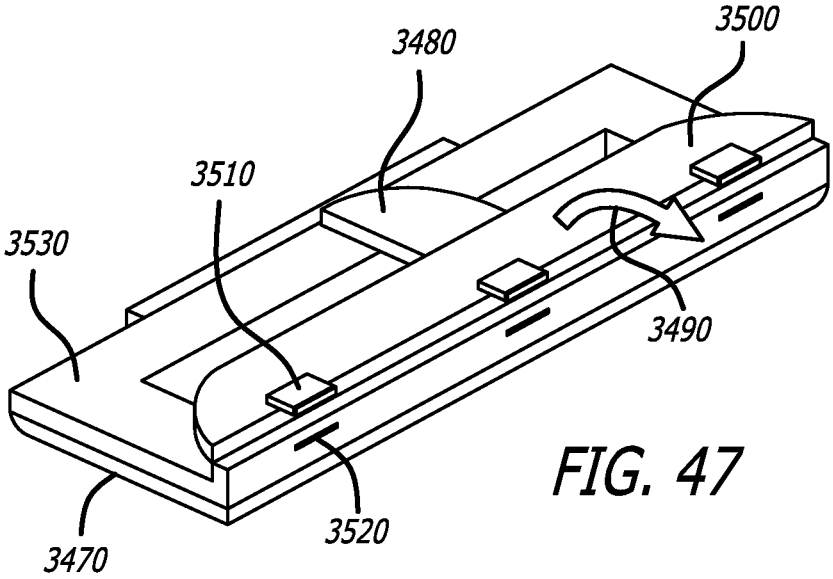
FIG. 47 is a side perspective view a razor head of a razor of the present disclosure, illustrating collapsible "back and central scoop walls" attached to a top portion of the razor head, and in a fully collapsed configuration.

FIG. 47 is an embodiment 3470 of the present disclosure. This embodiment is similar to the one illustrated in FIGS. 45 and 46, and to the one illustrated in FIG. 35. Like the embodiment illustrated in FIG. 35, this embodiment has a partition wall 3480 in its center. After a user rotates (arrow 3490) the distal barrier wall 3500 up, the latches 3510 will engage their complementary slots 3520 and hold the wall in a raised orientation. The user can then rotate the partition wall 3480 up, after which it will also lock into place such as through the engagement of at least one complementary pair of tab and slot.

Figure 48:
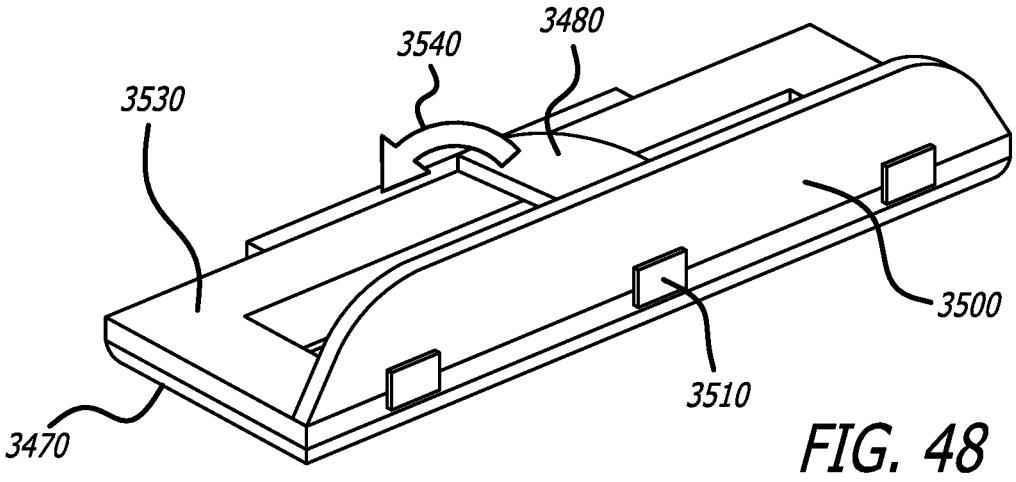
FIG. 48 is a side perspective view of the razor head of FIG. 47, illustrating the collapsible "back and central scoop walls" in a partially erect configuration.
Figure 49:
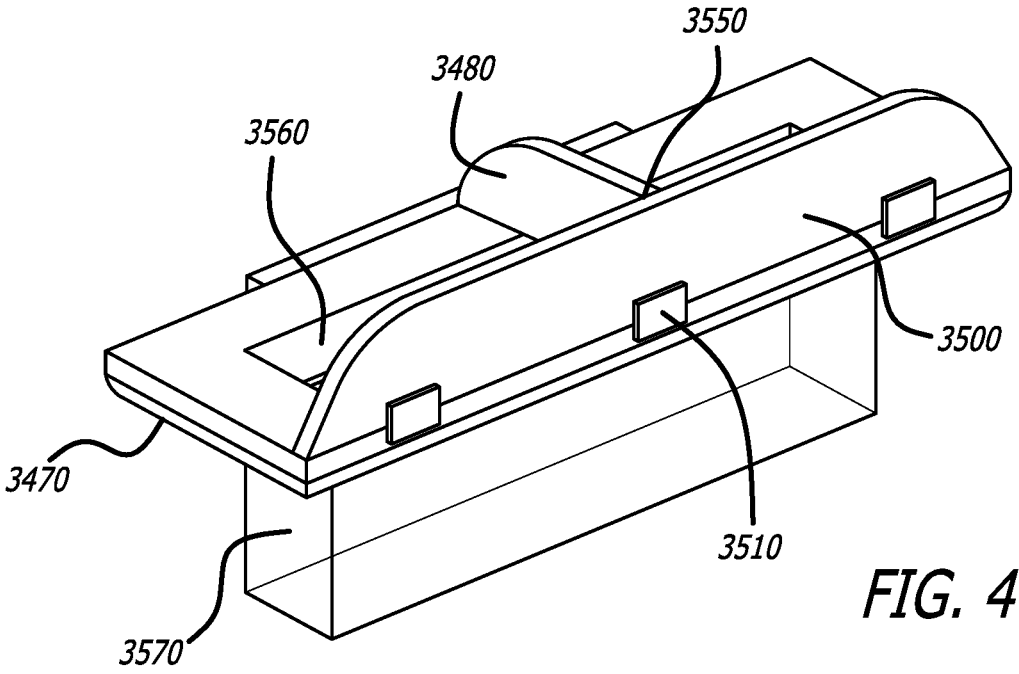
FIG. 49 is a side perspective view of the razor head of FIGS. 47 and 48, illustrating the collapsible "back and central scoop walls" in a fully erect configuration.

FIGS. 48 and 49 illustrate the raised configurations of this embodiment.

FIG. 48 illustrates the embodiment of FIG. 47 when the distal barrier wall 3500 is in its raised and operational position. The latches 3510 on the wall 3500 are engaged with their complementary slots in the cartridge base 3470, thereby preventing the spontaneous collapse of the wall. After rotating up, and raising, the distal barrier wall 3500, a user can rotate up 3540, and raise, the central partition wall 3480. It too will lock in place when raised.

FIG. 49 illustrates the embodiment of FIGS. 47 and 48 when both the distal barrier wall 3500 and the central partition wall 3480 are in their raised and operational positions. The distal barrier wall 3500 is locked in position by its latches 3510. And, the central partition wall is also locked in position, such as by a tab and slot at the upper portion of its junction 3550 with the barrier wall 3500.

A significant portion of water flowing in a direction 3560 that leads it to collide with an upper surface of the cartridge, and/or the barrier wall 3500 positioned at its distal end, will be redirected so as to flow through the blade channel and out 3570 of the outflow mouth of the blade channel.

Figure 50:
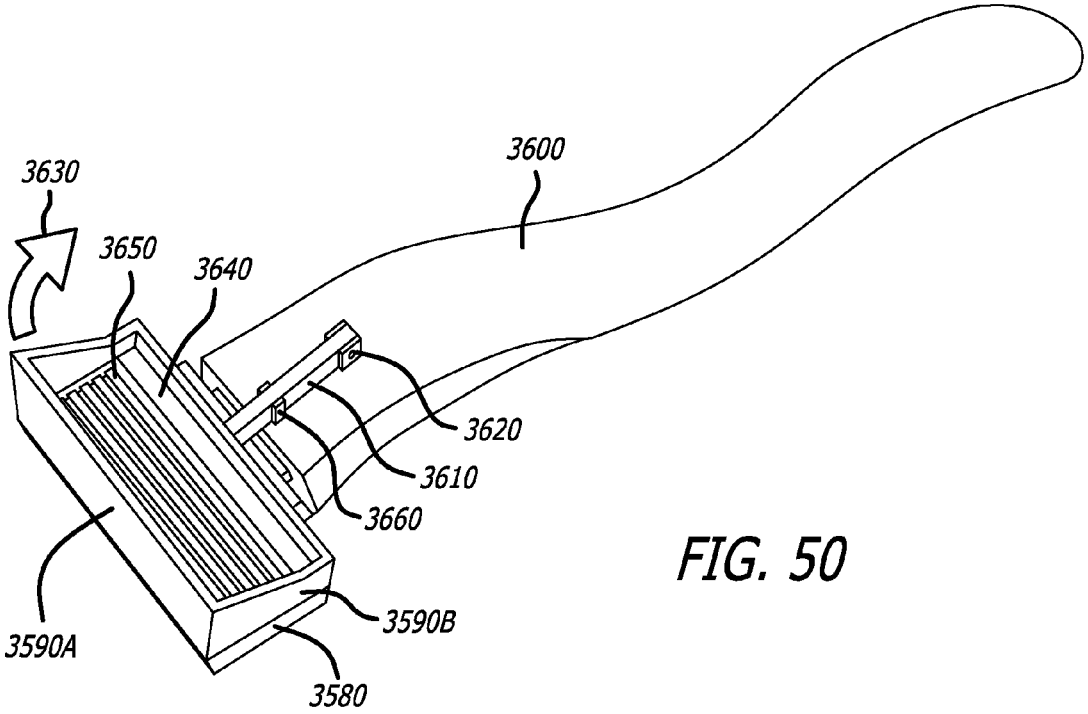
FIG. 50 is a side perspective view of a razor head of a razor of the present disclosure, wherein the razor handle incorporates and/or includes a pivotable scoop that may be rotated so as to be positioned adjacent to a cartridge and facilitate the flushing thereof, and that may be rotated as to be positioned away from a cartridge so as to facilitate the cartridge's removal and/or replacement.

FIG. 50 illustrates an embodiment 3580 of the present disclosure in which the scoop 3590 is permanently attached to the razor handle 3600. The scoop 3590 is attached to one end of an arm or shaft 3610. The other end of the shaft 3610 is attached to a fixture 3620 within which it is free to rotate.

The scoop can be rotated (arrow 3630) up and away from a cartridge 3580 allowing the cartridge to be replaced. After the cartridge is replaced, the rotatable scoop 3590, can be rotated back down to engage with an upper surface 3640 of the cartridge, and thereafter direct an inflowing stream of water into the blade channel 3650.

A "clip" 3660 holds the scoop in an operational position, against the underlying cartridge. After rotating the scoop back to its operational position, a firm push by a user "snaps" the arm 3610 into the clip, thereby securing it in the "lowered" position.

Figure 51:
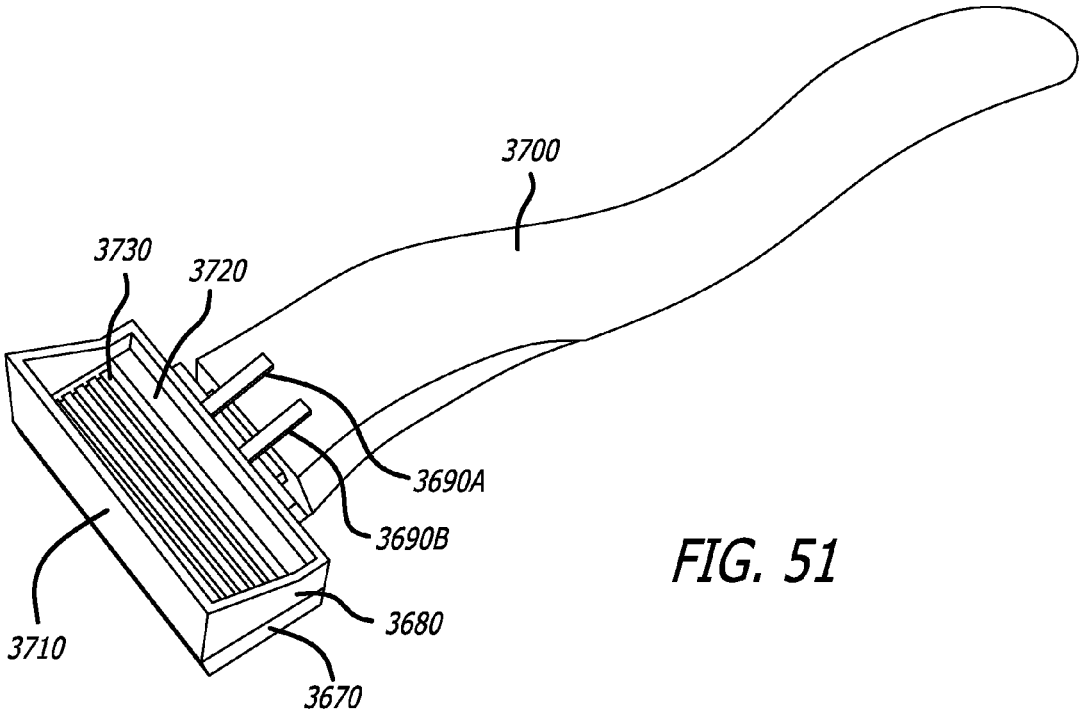
FIG. 51 is a side perspective view of a razor head of a razor of the present disclosure, wherein a scoop is rigidly attached to the handle but not to the underlying cartridge, thereby facilitating the removal and/or replacement of cartridges by their lateral sliding beneath the scoop.

FIG. 51 is an embodiment 3670 of the present disclosure that is similar to the embodiment illustrated in FIG. 50. However, this embodiment has a scoop 3680 that is firmly and permanently attached (in this embodiment, by struts 3690A and 3690B to a razor handle 3700). A user ejects, and inserts, cartridges by sliding (arrow 3710) them in and out beneath the overlying scoop 3680.

Figure 52:
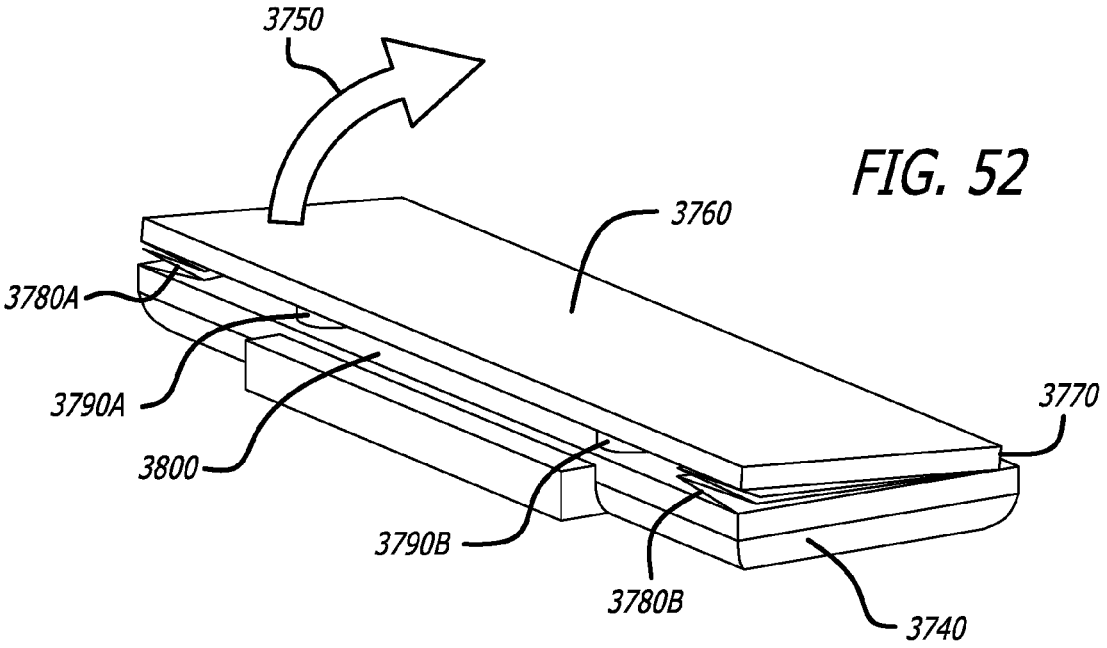
FIG. 52 is a side perspective view of a razor head of a razor of the present disclosure, illustrating a collapsible scoop incorporating flexible side walls and a hinged back wall, and in a fully collapsed configuration.

FIG. 52 illustrates an embodiment 3740 in which a rotatable (arrow 3750) barrier wall 3760 is attached to an underlying cartridge 3740 by a hinge 3770. Each side of the barrier wall is attached to a flexible membrane 3780A and 3780B that allows the wall 3760 to collapse, as well as to rotate up to a raised position.

The barrier wall 3760 is prevented from lying directly against the upper surface of the cartridge 3740 by posts 3790. When water flows 3800 into the gap between the rotatable wall 3760 and the upper surface of the cartridge, its kinetic energy forces the wall to rotate 3750 up and assume a raised position, which is illustrated in FIGS. 53 and 54.

Figure 53:
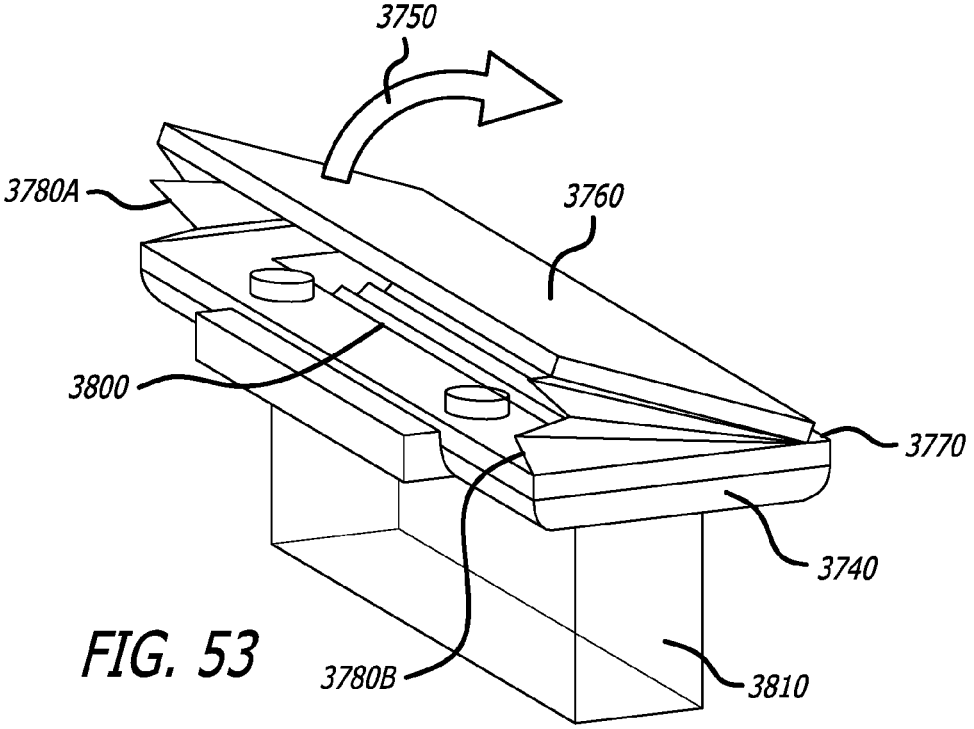
FIG. 53 is a side perspective view of the razor head of FIG. 52, illustrating a collapsible scoop incorporating flexible side walls and a hinged back wall, and in a partially erect configuration.

FIG. 53 is the same embodiment 3740 as in FIG. 52 but in this figure, the rotatable wall 3760 is partially raised in response to an inflow 3800 of water. The flexible membranes 3780A and 3780B are partially extended and/or expanded. This partially raised orientation allows an even greater stream 3800 of water to enter through what is now an aperture of even greater cross-sectional area. As more water flows 3800 in to the partially opened scoop, the rising of the distal wall 3760, and the further extension and/or expansion of the flexible walls 3780A and 3780B on the scoop's sides, accelerates.

Figure 54:
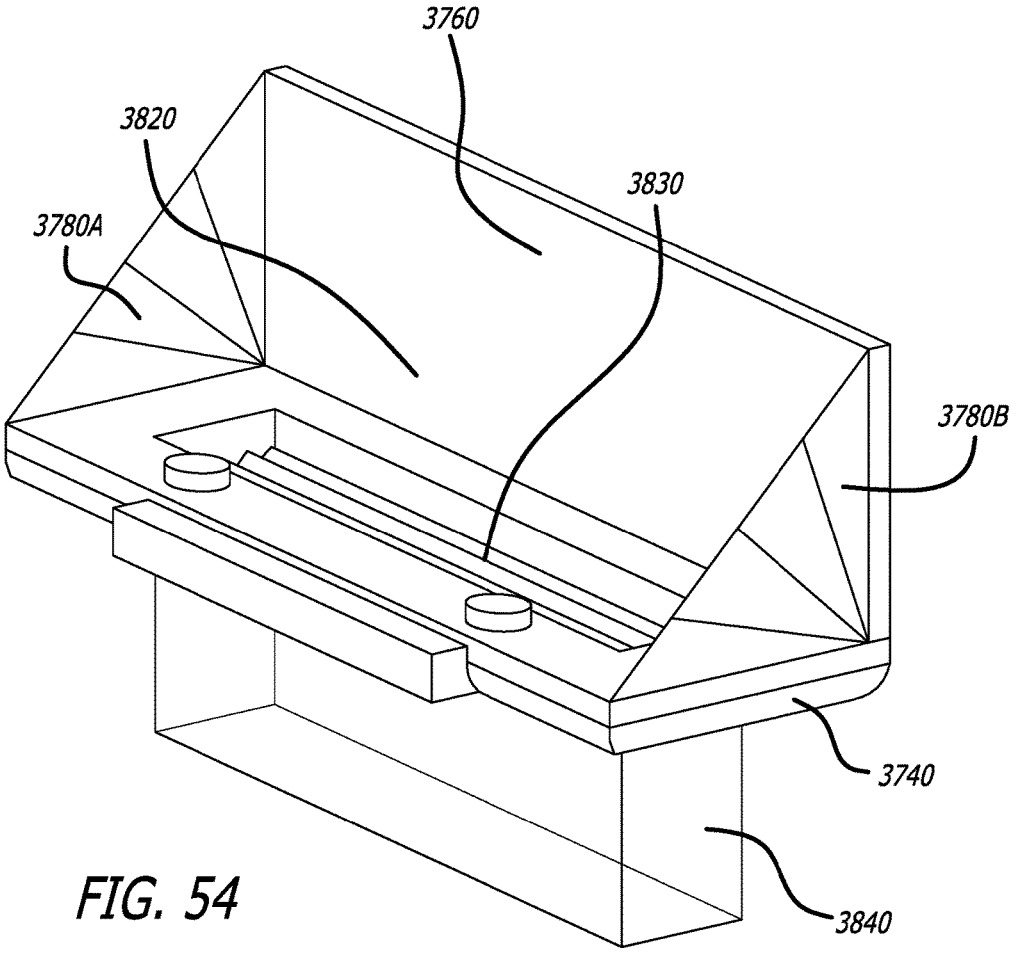
FIG. 54 is a side perspective view of the razor head of FIGS. 52 and 53, illustrating the collapsible scoop in a fully erect configuration.

FIG. 54 is the same embodiment 3740 illustrated in FIGS. 52 and 53. However, in this figure, the rotatable wall 3760 is fully raised, and the flexible side panels 3780A and 37806 are fully extended and/or expanded. Water flowing 3820 into the scoop 3780A and 3780B, and 3760, is redirected into the blade channel 3830 after which it flows out 3840 of the blade channel.

Collapsible embodiments herein offer the advantages of being more easily and efficiently packaged for storage, transportation and sale.

Figure 55:
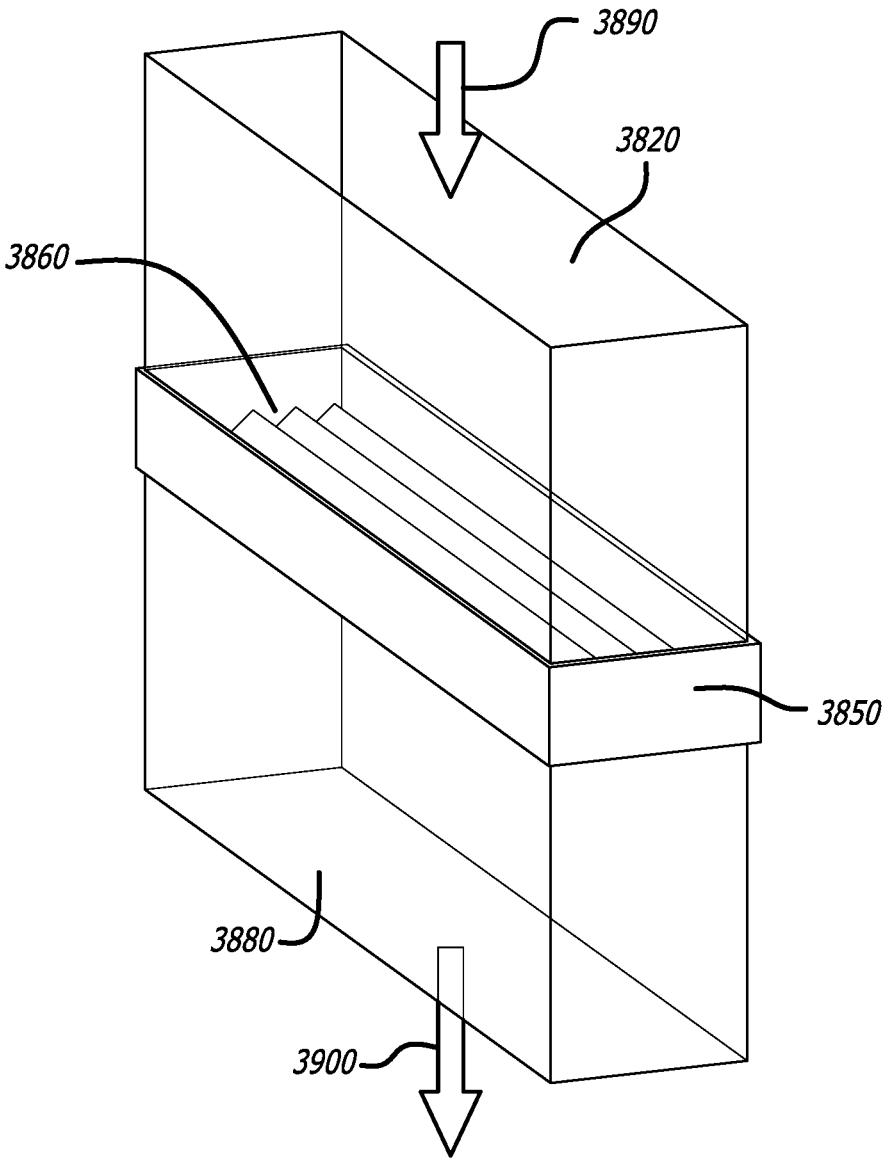
FIG. 55 (Prior Art)
FIG. 55 is a side perspective view of a blade channel of the prior art.

FIG. 55 is an illustration of the channel 3850 configuration typical of the prior art. Razor blade(s) 3860 are affixed within the channel 3850 in which the cross-sectional area 3870 of the influent (i.e. upper) mouth is approximately equal to the cross-sectional area 3880 of the effluent (i.e. lower) mouth. The influent mouth is able to capture, at most, a stream 3890 of water with a cross-sectional area 3870 equal to that of the influent mouth. The effluent mouth allows the outflow of a stream 3900 of water with a cross-sectional area 3880 equal to that of the effluent mouth. The channel 3850 would typically be embedded within the frame of a razor cartridge or a similar blade assembly within a solid razor.

Figure 56:
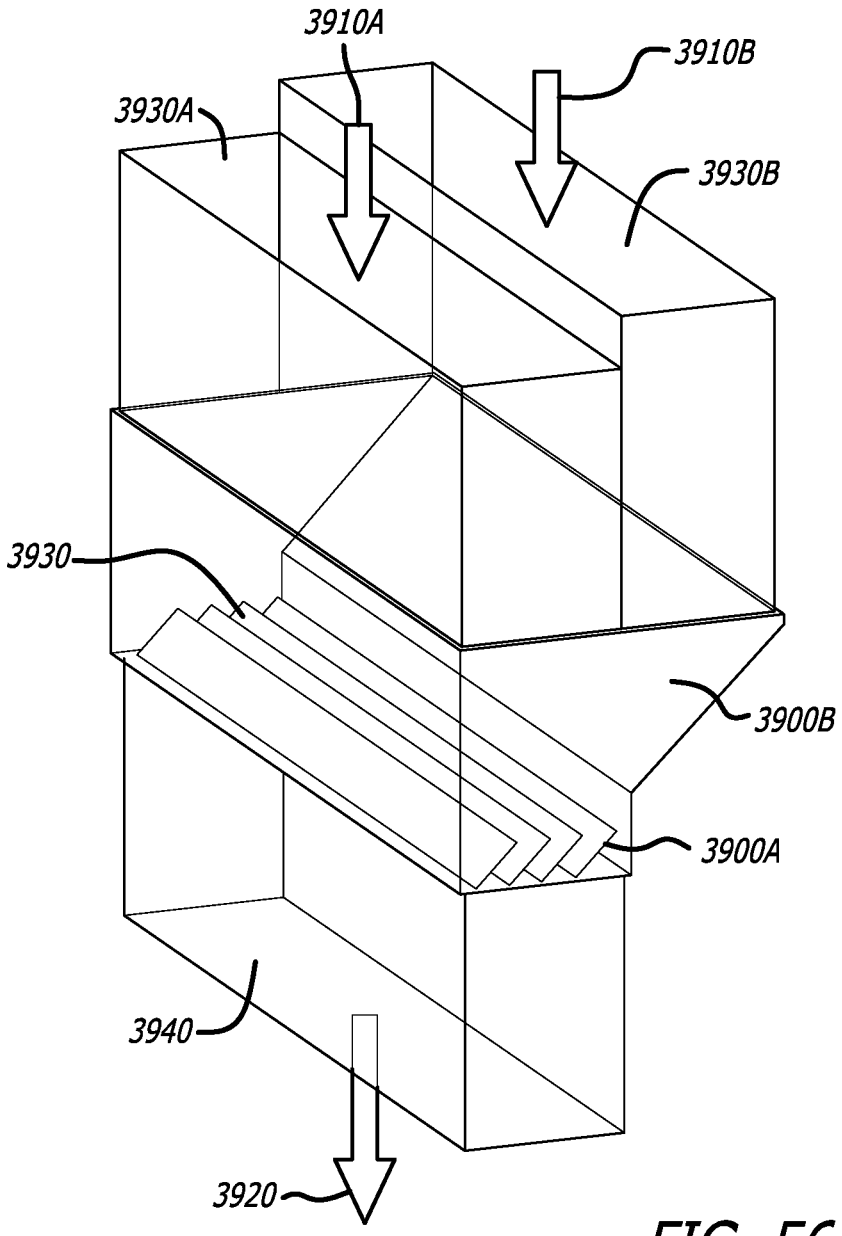
FIG. 56 is a side perspective view of a blade channel of the present disclosure.

FIG. 56 is an illustration a channel configuration consistent with the present disclosure. A channel is established by a tubular surface 3900A and 3900B. This channel has an upper, influent mouth into which water flows 3910A and 3910B, and a lower, effluent mouth from which water flows 3920. The channel has a constricted region 3900A in which the cross-sectional area of the channel is less than the cross-sectional area of at least one portion of the preceding channel 3900B.

Razor blade(s) 3930 are affixed within the constricted portion 3900A of the channel, and the blade(s) 3930 are adjacent to the effluent mouth.

In this illustration, the cross-sectional area (3930A and 3930B) of the influent mouth is twice that of the cross-sectional area 3940 of the effluent mouth. Likewise, the cross-sectional area of the stream that the influent mouth can capture is twice the cross-sectional area of the stream that flows out of the effluent mouth. The reduction in the cross-sectional area of the channel tends to create a Venturi effect which increases, and with respect to the illustrated channel would be expected to double, the speed of the water passing through the constricted portion 3900A of the channel, and over, around and between the blade(s) 3930.

Figure 57:
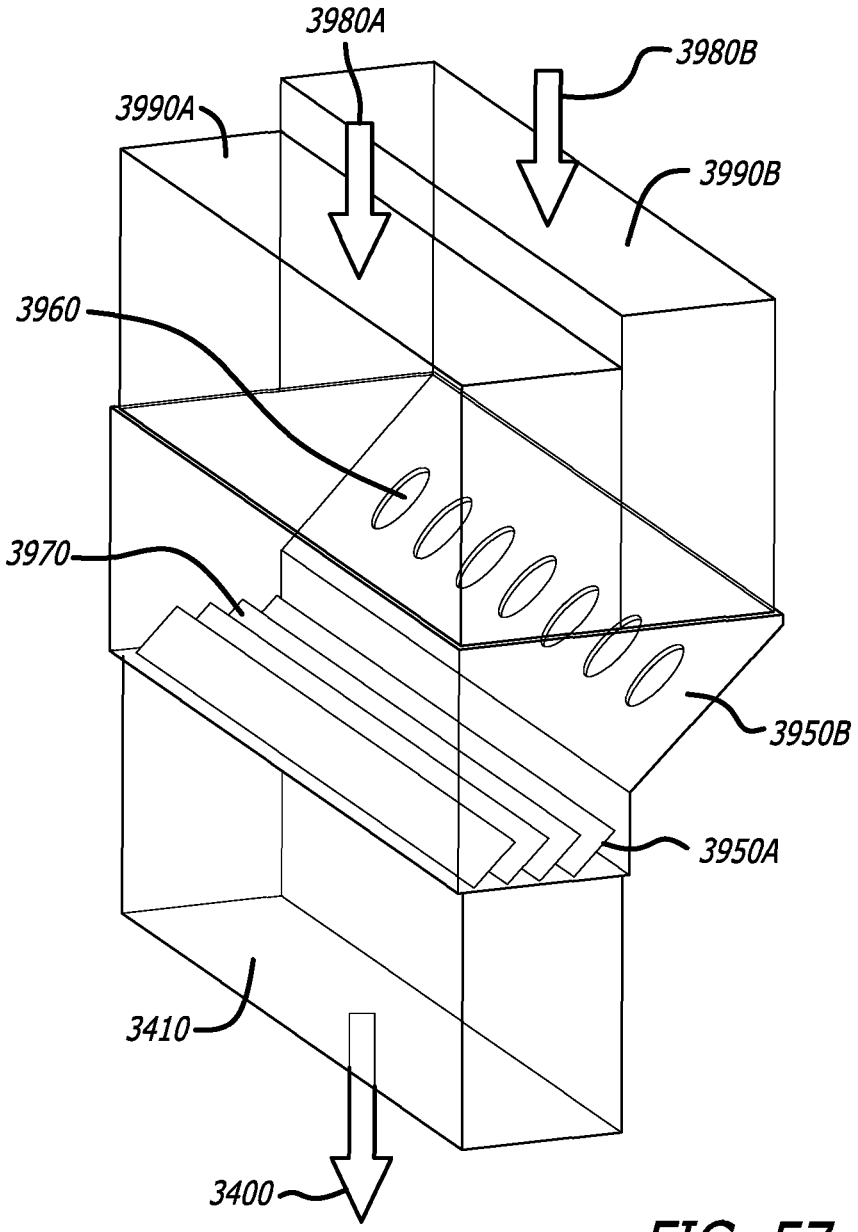
FIG. 57 is a side perspective view of a blade channel of the present disclosure in which the scoop is an "open" channel.

FIG. 57 is an illustration of the same channel configuration as shown in FIG. 56. However, in this configuration, one wall of the channel has been perforated with holes 3960 that allow approximately 10% of the water striking that wall to leave the channel (i.e. to "leak out") before reaching the constricted portion 3950A of the channel, and the blade(s) 3970 therein.

If the "efficiency" of a channel configuration is defined as being equal to the percentage of the volume and rate of flow of water captured and diverted to that portion of the channel in which the blade(s) are affixed, relative to the volume and rate of flow of water that flows out of the effluent mouth of the channel, then the "efficiency" of the channel configuration illustrated in FIG. 57, and typical of the prior art, is typically significantly less than 100%.

Likewise, with respect to this definition of "efficiency", the efficiency of the channel configuration illustrated in FIG. 56 is 200% since its influent mouth captures a stream with twice the cross-sectional area of the stream that flows out of the effluent mouth.

However, the efficiency of the channel configuration illustrated in FIG. 57 is less than 200% since some of the water that flows in to the influent mouth leaks out before reaching the effluent mouth.

In the configuration illustrated in FIG. 57 the influent mouth is able to capture a stream 3980A and 3980B that is twice as large as the stream captured by the influent mouth of the channel typical of the prior art such as is illustrated in FIG. 55. However, approximately and/or at least 10% of one half of that captured stream is lost when it leaks out of the perforations. Therefore, one might expect the overall efficiency of the illustrated channel configuration to be approximately 190%.

The channel configuration illustrated in FIG. 57 has an influent mouth with a cross-sectional area equal to that of the channel configuration illustrated in FIG. 56, but with an efficiency of 190%, instead of 200%, due to the perforations in the channel wall. However, from a functional perspective, the perforated channel configuration illustrated in FIG. 57 is equivalent to an un-perforated channel possessing an influent mouth with an "effective cross-sectional area" equal to 190% of the cross-sectional area of the un-perforated channel illustrated in FIG. 55.

The irregular and/or "open channel" illustrated in FIG. 57 is less efficient than a closed channel of similar dimensions, but is more efficient than the closed channel typical of the prior art as illustrated in FIG. 55. So, the present disclosure extends to irregular and/or "open channels," including simple single-wall barriers, which increase the "effective cross-sectional area" of an influent mouth of the channel in which a razor's blade(s) are affixed.

Figure 58:
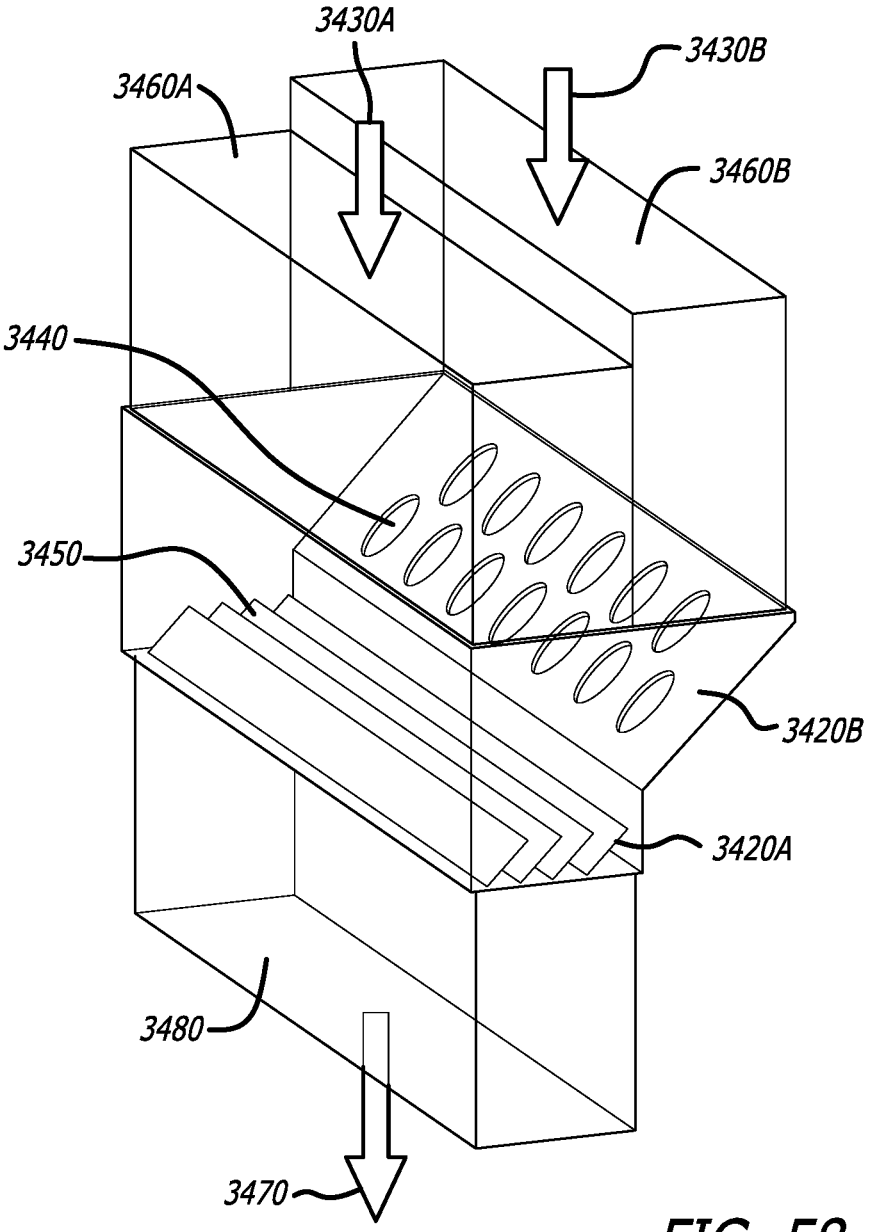
FIG. 58 is a side perspective view of a blade channel of the present disclosure in which the scoop is an "open" channel.

FIG. 58 illustrates a channel configuration similar to the one illustrated in FIG. 57. However, in this configuration the perforations 3440 in the angled wall 3420B of the channel are equal to 20% of its surface area and would therefore be expected to result in the leakage of approximately 20% of the water flowing in to the influent mouth in that portion 3430B of the inflowing stream that will collide with that angled wall 3420B.

In terms of the earlier definition of "efficiency," the channel configuration illustrated in FIG. 58 will have a total efficiency equal to the sum of the efficiencies associated with each half of the inflowing water and/or channel. Thus, the total efficiency of this channel configuration will equal 100% (for the portion of the stream 3430A flowing directly into the constricted portion 3420A of the channel) plus 80% (for the portion of the stream 3430B that will collide with the perforated channel wall 3420B or 180%.

Thus, as was discussed relative to FIG. 57 above, the channel configuration illustrated in FIG. 58 is equivalent to an un-perforated channel that possesses an influent mouth with an "effective cross-sectional area" of 180% of the cross-sectional area of the influent mouth of the channel characteristic of the prior art as illustrated in FIG. 55.

Figure 59:
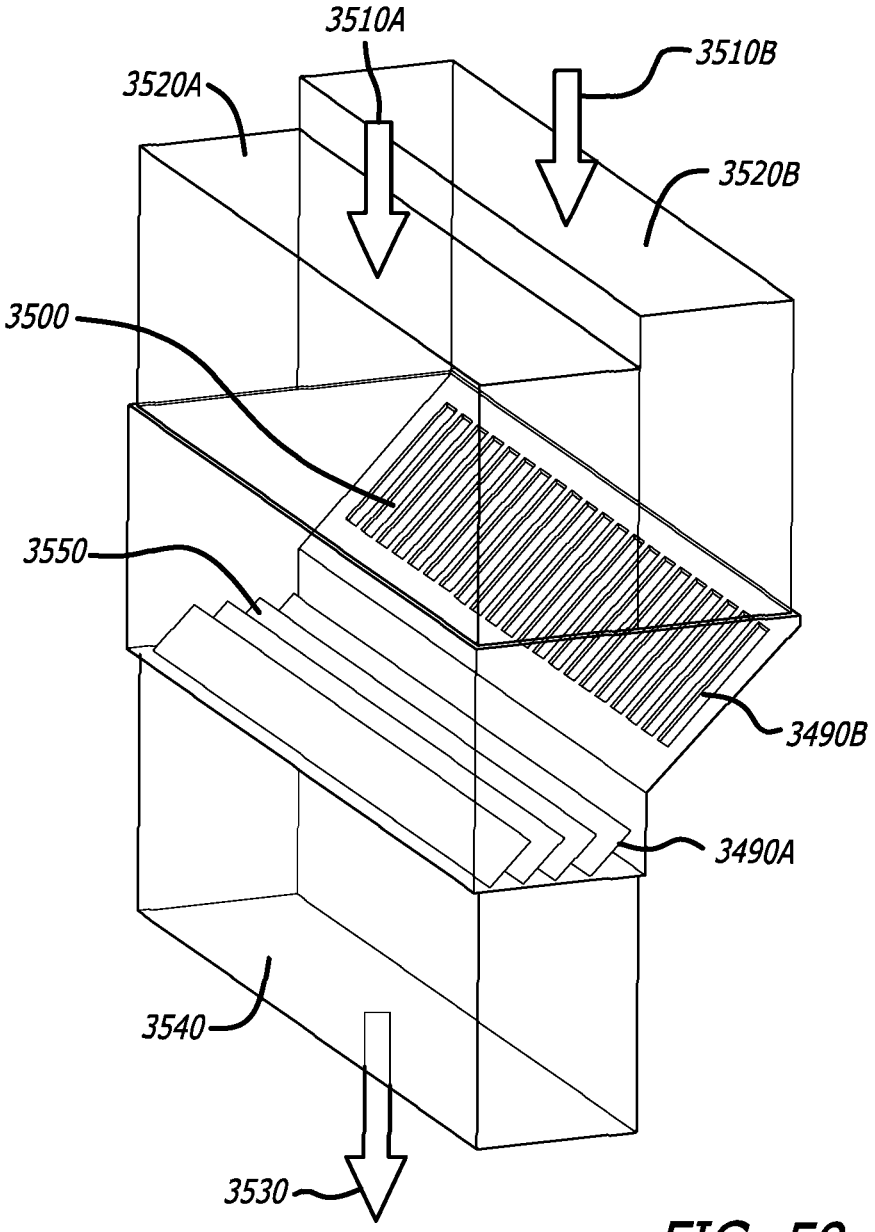
FIG. 59 is a side perspective view of a blade channel of the present disclosure in which the scoop is an "open" channel.

FIG. 59 illustrates a channel configuration similar to the ones illustrated in FIGS. 57 and 58. However, in this configuration the perforations 3500 (vertical slots instead of the circular holes illustrated in FIGS. 57 and 58) in the angled wall 3490B of the channel are equal to 40% of its surface area and would therefore be expected to result in the leakage of approximately 40% of the water flowing in to the influent mouth in that portion 35106 of the inflowing stream that will collide with that angled wall 3490B.

In terms of the earlier definition of "efficiency," the channel configuration illustrated in FIG. 59 will have a total efficiency equal to the sum of the efficiencies associated with each half of the inflowing water and/or channel. Thus, the total efficiency of this channel configuration will equal 100% (for the portion of the stream 3510A flowing directly into the constricted portion 3490A of the channel) plus 60% (for the portion of the stream 35106 that will collide with the perforated channel wall 3490B) or 160%.

Thus, as was discussed relative to FIGS. 57 and 58 above, the channel configuration illustrated in FIG. 59 is equivalent to an un-perforated channel that possesses an influent mouth with an "effective cross-sectional area" of 160% of the cross-sectional area of the influent mouth of the channel characteristic of the prior art and illustrated in FIG. 55.

Figure 60:
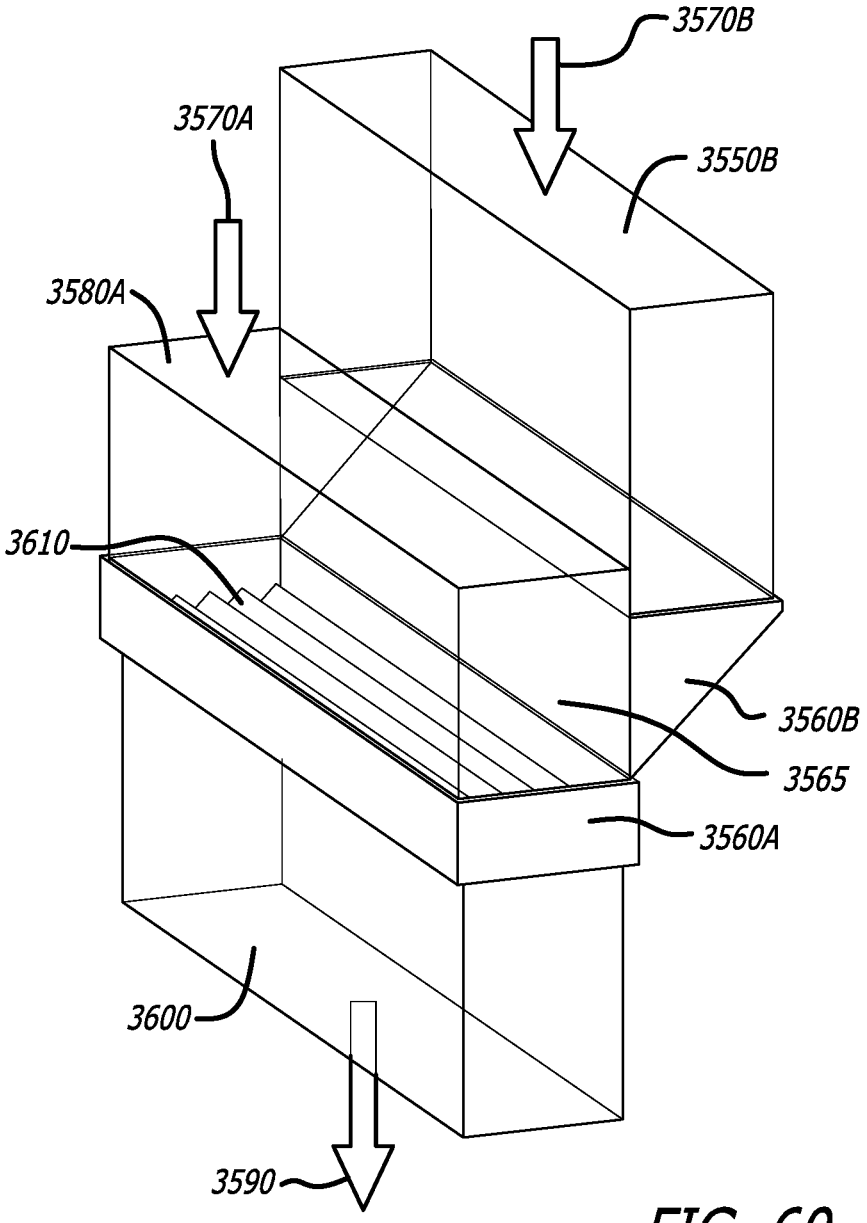
FIG. 60 is a side perspective view of a blade channel of the present disclosure in which the scoop is an "open" channel established by a single distal wall.

FIG. 60 illustrates an "irregular" and/or "open" channel configuration 3560 similar to the ones illustrated in FIGS. 57-59. However, in this configuration only the angled wall 3565 is present. The side walls that "closed" the rectangular portions of the channel are absent (e.g. there would have been a side wall at 3560A) in the configuration illustrated here. However, even in the absence of a proper channel wall, the angled wall 3560B will nonetheless obstruct the flow of water 3570B flowing toward it and direct at least a portion of that obstructed flow toward, and into, the "constricted" portion 3560A of the channel.

While it is not reasonable to estimate the "efficiency" of the channel configuration illustrated in FIG. 60, its efficiency will be greater than the efficiency of the equivalent channel configuration that lacks the angled wall, as illustrated in FIG. 55 which is typical of the prior art.

Thus, as was discussed relative to FIGS. 57-59 above, the channel configuration illustrated in FIG. 60 is equivalent to an un-perforated channel that possesses an influent mouth with an "effective cross-sectional area" greater than the cross-sectional area of the influent mouth of the channel characteristic of the prior art and illustrated in FIG. 55.

Figure 61:
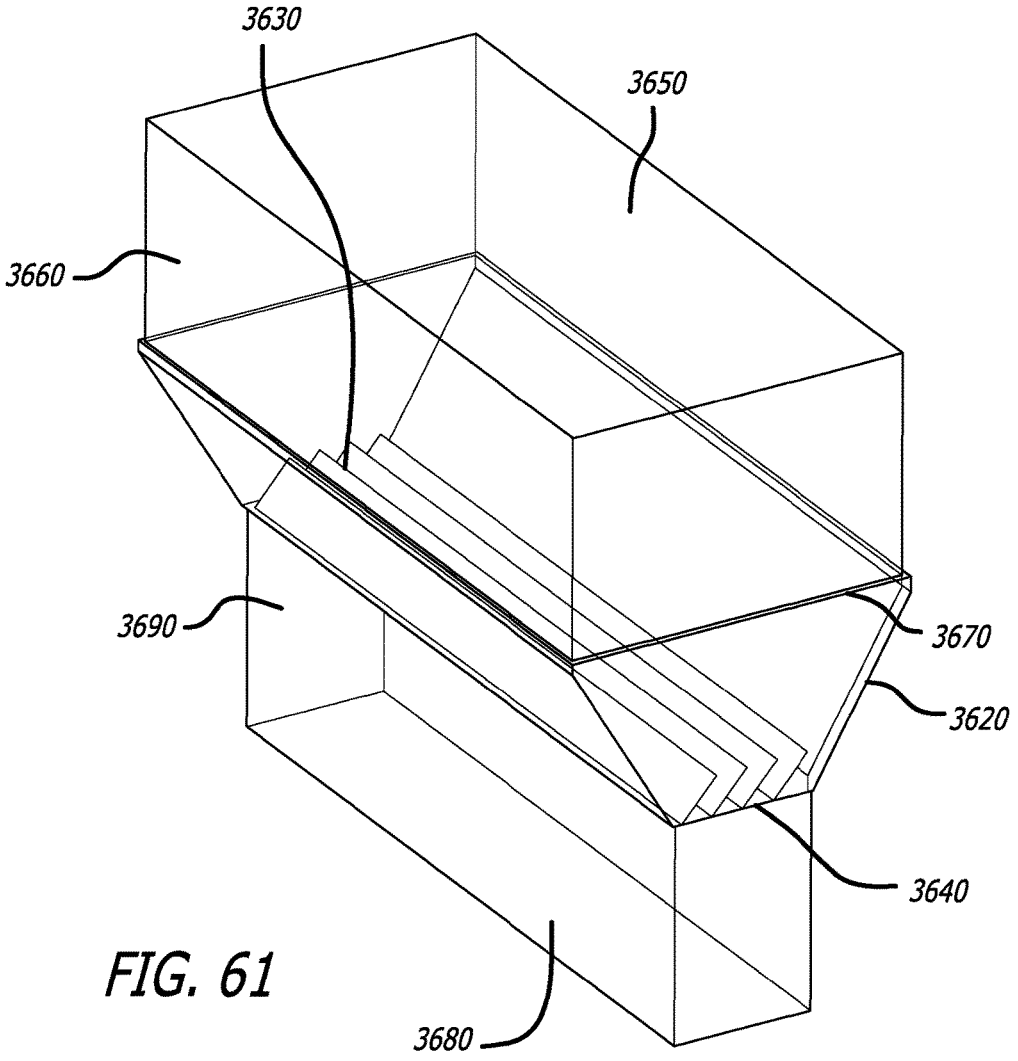
FIG. 61 is a side perspective view of a combined scoop and blade channel of the present disclosure in which the blades are affixed within the constricting channel of the scoop.

FIG. 61 illustrates an embodiment 3620 in which razor blades 3630 are affixed within a constricted portion of the channel 3620 and are adjacent to the effluent mouth 3640. The cross-sectional area 3650 of the stream 3660 that the upper, influent mouth 3670 can capture is greater than the cross-sectional area 3680 of the stream 3690 that the lower, effluent mouth 3640 emits.

Figure 62:
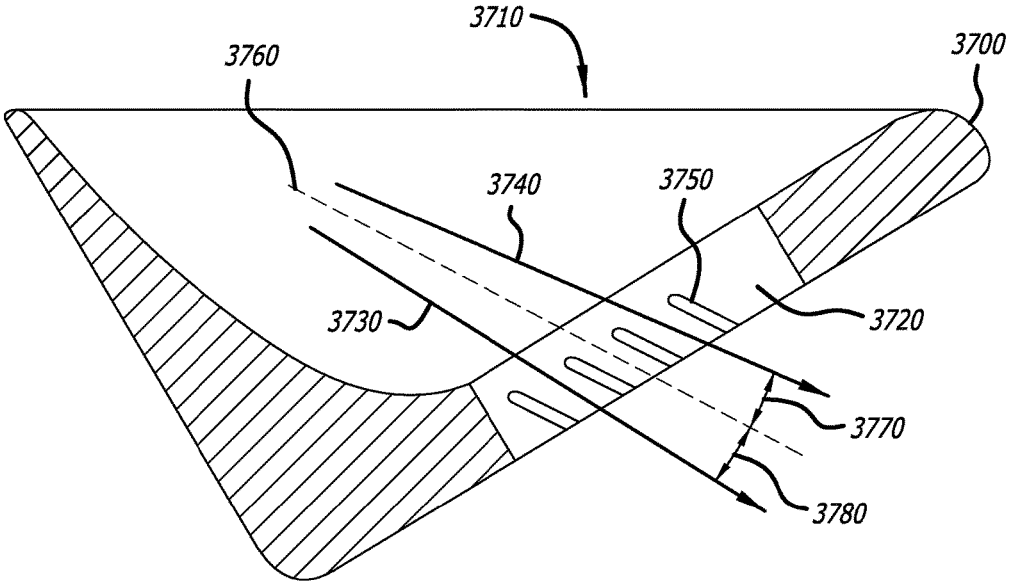
FIG. 62 is an enlarged cross-sectional view of a razor head of the present disclosure illustrating representative directions of water flow induced by the scoop, in which water is directed and/or guided so as to cause it to flow substantially parallel to the broad surfaces and/or sides of the blades within the blade channel.

FIG. 62 illustrates a cross-sectional view of a razor head embodiment of the present disclosure similar to the embodiment illustrated in FIGS. 1, 4 and 5. Water flowing 3710 into the scoop 3700 will be diverted, concentrated and/or converged, so as to be directed toward the blade channel 3720, and flow, e.g. 3730 and 3740, over and/or between the blades, e.g. 3750, therein. The water will optimally, though not always, flow between the blades in a direction 3760 and/or orientation approximately parallel to the broad surfaces of the blades, e.g. 3750. The flow will vary from parallel with respect to different angular orientations with which water flows into the scoop, with respect to different orientation of the scoop mouth relative to the upper and/or inflow mouth of the blade channel, etc. The expected actual angle at which flow is directed toward the blades, with respect to the angle that would cause the flow to be parallel to the broad surfaces of the blades, is illustrated as angles 3770 and 3780.

In some embodiments, the magnitudes of these angles will be relatively small, such as ranging from 0 to 10 degrees. In other embodiments, they may be larger, such as ranging from 0 to 50 degrees. Other embodiments may be characterized by different and/or unique ranges of typical angular deviations from parallel flow.

DETAILED EXPLANATION

The embodiments disclosed herein facilitate peoples' ability to shave themselves. The act of shaving with a manual razor (i.e. a razor that is manipulated "by hand" and which typically lacks electrical and/or electronic components, and containing one or more fixed blades that are dragged across a person's skin in order to remove unwanted hairs thereon) involves many inter-related actions. A user typically applies to his skin a lubricant of some kind in order to reduce unwanted cuts and pain. The user then typically drags the blade(s) of a razor across the skin, sometimes several times, removing hair and at least a portion of the lubricant thereon. Periodically, a user will remove, or attempt to remove, from the blade(s), and especially from between any pairs of blades, the lubricant and hairs that have accumulated there during the shaving process.

Removing the waste hair and lubricant from a razor's blades is typically a difficult and time consuming process.

And, this process is further complicated by the tendency of manufacturers of multi-bladed razors to position those blades in close proximity to one another. The narrow gaps between adjacent blades are easily blocked by waste lubricant and hairs. And, because of the narrowness of the gaps between them, these rows of blades are difficult to flush with water. A set of closely-spaced adjacent blades will only collide with a narrow slice of any stream of water directed against it. The rest of the water will either pass around the outer blades without removing any debris from the gaps between the blades, or it will splash off the fixture holding the blades and pass uselessly down a drain without effect.

Embodiments of the present disclosure solve this problem, and in so doing, satisfy a long-felt need which is commonly complained about by users of manual razors, and has apparently been complained about since the invention of the two- and multi-bladed razors. And, this is the first solution that is practical in terms of use, fabrication, and cost.

The razors, and/or the razor assemblies and/or cartridges disclosed herein incorporate an obstruction or a scoop or other "water gathering and channeling structure" so as to increase the volume and flow rate of water directed through a razor's blades. Moreover, many embodiments not only increase the volume of water that flows over and between a razor's blades, they also simultaneously direct the flow of that water so that it impinges upon those blades in a direction more parallel to the broad surfaces of the blades (i.e. so that it better flows between the blades). Furthermore, because the cross-sectional area of the mouth through which water enters the scoop exceeds the cross-sectional area of the mouth through which it exits the portion of the channel in which the blades are affixed, a Venturi effect tends to accelerate the speed of the water's flow around and between the blades resulting in a more effective dislodging of waste from those spaces.

Thereby the present disclosure can include the following:

1. a structure for capturing, accepting and/or gathering an inflowing stream of water;

2. a channel through which the captured influent stream is carried, at least in part, from the orifice through which it was captured, to the blades from which debris is to be flushed out;

3. a constriction, and/or a region of narrowing in the channel, such that the cross-sectional area of the channel is reduced in at least a portion of the channel in which at least a portion of at least one of the blades is affixed; and 4. an orifice through which the water that flowed through the channel, and/or around, over and/or between the blades, flows out.

The potential variety of structures and/or designs capable of satisfying the elements disclosed herein is large, and all such variations are included within the scope of this disclosure. A few embodiments are provided in the accompanying figures. These are provided as examples of the available variety of potential embodiments and are not limiting in any fashion. Many other embodiments, and variations of the embodiments illustrated in the figures, will be obvious to those skilled in the art, and are hereby included within the scope of this disclosure.

Embodiments of the present disclosure include, but are not limited to, embodiments which utilize a "closed-channel" scoop (see, e.g., FIGS. 1, 4-5, 10, 21-33, 36-41, 44, 50-54, 61, and 62);

- some of which may be attached to, and/or incorporated within, a removable razor cartridge (see, e.g., FIGS. 1, 4-5, 10, 21-33, 36-41, 44, 54, 61, and 62);
- some of which may be attached to, and/or incorporated within, a complete, integral, and/or disposable razor, containing a permanently attached handle (see, e.g., FIGS. 1, 4-5, 10, 21-33, 36-41, 44, 53-54, 61, and 62);
- some of which may utilize contoured inner surfaces to reduce turbulence and promote laminar flow (see, e.g., FIGS. 4-5, 21-23, 36-39, and 62);
- some of which may accept water flowing from a source above the scoop along an axis parallel to the flow axis (a longitudinal axis, and/or an axis typical of water flow through the blade channel) (see, e.g., FIGS. 1, 26-27, 32, 40-41, and 61);
- some of which may accept water flowing along an axis that has an included angle with the blade channel flow axis of up to ninety degrees and is inclined toward the razor's handle (see, e.g., FIGS. 1, 4-5, 10, 21-25, 28-29, 36-39, 44, 50-51, 54, and 62);
- some of which may accept water flowing along an axis that has an included angle with the blade channel flow axis of up to ninety degrees and is inclined toward the longitudinal axis of the razor head (i.e. from the side of the razor head) (see, e.g., FIGS. 30-31, and 33);
- some of which may have angled and/or constricting inner scoop surfaces and/or walls (see, e.g., FIGS. 4-5, 21-23, 26-31, 36-41, 61, and 62);
- some of which may have inner scoop surfaces and/or walls approximately normal to an upper surface of the razor head (e.g. box-like scoops) (see, e.g., FIGS. 1, 10, 24-25, 28-33, 44, 50-51, and 54);
- some of which may contain partitions that sub-divide the scoop (see, e.g., FIGS. 25, 27, 29, and 30-33);
- some of which may utilize rotatable, pivotable, and/or otherwise collapsible scoop walls (see, e.g., FIGS. 44, 50, and 54);
- some of which may utilize removable scoops, in which the scoops are attached to a cartridge by a connecting mechanism (e.g. clips) and/or are attached to razor handles rigidly, pivotably, and/or removably (see, e.g., FIGS. 40-41 and 50); and
- some of which may incorporate, include, and/or affix, blades, serrated edges, and/or other useful accessories, to and/or within one or more scoop walls. (see, e.g., FIGS. 38 and 39)

Embodiments of the present disclosure include, but are not limited to, embodiments which utilize a single distal wall and/or an otherwise irregular and/or "open-channel" scoop (see, e.g., FIGS. 34-35, 46, and 49):

- some of which may be attached to, and/or incorporated within, a removable razor cartridge (see, e.g., FIGS. 34-35, 46, and 49);
- some of which may be attached to, and/or incorporated within, a complete, integral, and/or disposable razor, containing a permanently attached handle (see, e.g., FIGS. 34-35, 46, and 49);
- some of which may use a single distal wall (see, e.g., FIGS. 34 and 46);
- some of which may use partitions that sub-divide the scoop (see, e.g., FIGS. 35 and 49);
- some of which may use rotatable, pivotable, and/or otherwise collapsible distal walls (see, e.g., FIGS. 46, and 49);
- some of which may use removable distal walls, in which the distal walls are attached to a cartridge by a connecting mechanism (clips, posts, etc.) and/or are attached to razor handles rigidly, pivotably, and/or removably; and some of which may incorporate, include and/or affix, blades, serrated edges, and/or other useful accessories, to and/or within the distal wall.

Alternative Embodiments

The present disclosure is made with respect to the improvement of elements of the prior art that are believed to be "typical" and/or representative. However, this present disclosure applies with equal force, and extends its scope to be inclusive of the application disclosed herein, to the improvement of related instances, variations, and embodiments of manual razors, their blades, blade assemblies, cartridges, etc.

This disclosure has application to, and is disclosed with respect to, manual razors and/or razor cartridges that possess any number of blades. Although the utility disclosed herein is especially great for razors and/or cartridges possessing two or more blades, it has application to, and provides a useful advantage for, users of single-blade razors.

This disclosure has application to, and is disclosed with respect to, both "solid" razors, i.e. those in which the blades and the handle are affixed within a common mechanical structure, and cartridge razors; that is, those in which the blade(s) are affixed to a removable blade assembly.

This disclosure includes elements related to "water capture" as well as "water channeling." Embodiments of the present disclosure may accomplish either or both of these element through the use of a closed channel, e.g. a "channel", or through the use of an open channel, e.g. free-standing barriers or walls that capture and/or alter the path of at least a portion of an incident stream of water. While an open channel may allow some water to escape, thus potentially lowering the efficiency of the channel in bringing water to a razor's blades and/or to increasing, by means of a Venturi effect, the speed of that water, it may also provide a useful compromise in terms of cost, packaging efficiency, and/or one or more other measures of practicality.

This disclosure encompasses, but is not limited to, embodiments in which the "water gathering" (i.e. scoop) element, and/or the "water channeling" element, are fabricated with, and/or employ, rigid structures, "foldable" rigid panels, moveable rigid structures, slideable rigid structures, flexible embodiments and/or embodiments incorporating flexible elements, as well as combinations thereof.

Embodiments incorporating rigid structures include, but are not limited to, those in which a scoop-like structure is a part of the same rigid structure to which the razor blades are affixed. Illustrative examples of embodiments that incorporate rigid structures include those illustrated in FIGS. 1 and 17-37.

Embodiments incorporating "foldable" rigid panels include, but are not limited to, those in which approximately flat, rigid panels are connected, by flexible means, to the same rigid structure to which the razor blades are affixed. These moveable rigid panels can then be moved from a relatively compact, folded, packed and/or storage configurations into a deployed, raised, and/or operational configuration. With respect to many, but not necessarily all, embodiments herein, the raising of the panels, and the conversion of the embodiment from its compact to its operational configuration, will be implemented, achieved, and/or realized by a user, or potential user, of the embodiment (e.g. after extracting the embodiment from its packaging and preparing it for use). Illustrative examples of embodiments that incorporate "foldable" rigid panels include those illustrated in FIGS. 38-45.

Embodiments incorporating moveable rigid structures include, but are not limited to, those in which rigid structural elements are moved into, and out of, operational orientations, typically, but not exclusively, by a user, or potential user, of the embodiment. Illustrative examples of embodiments that incorporate moveable rigid structures include those illustrated in FIGS. 38-45 and 46.

Embodiments incorporating flexible panels or membranes include, but are not limited to, those in which rigid structural elements are connected to, and/or interconnected with, foldable, flexible, stretchable, deformable, inflatable, semi-rigid, and/or malleable, elements. These elements might include, but are not limited to, panels, partitions, hinges, and channels. Embodiments incorporating flexible panels or membranes offer the advantage of simplified packaging, and the potential convenience of offering water-gathering and/or water-channeling elements that are "inflated" directly by the water directed into those structures by the user, i.e. they require no manual deployment steps by a user. Illustrative examples of embodiments that incorporate flexible panels or membranes include those in FIGS. 48-50.

This disclosure is also applicable to, inclusive of, and is disclosed with respect to, razors and/or razor cartridges that include a "comb" adjacent to the blades. The comb facilitates the shaving of relatively long hair. These types of razors are often used in medical facilities to shave patients prior to surgical procedures.

This disclosure encompasses, but is not limited to, embodiments in which the "water gathering" (i.e. scoop) element, and/or the "water channeling" element, are permanently attached and/or affixed to the razor blade assembly and/or to the handle assembly. However, it also encompasses, but is not limited to, embodiments in which the scoop, and/or "water channeling" element, removably attaches to, and detaches from, (e.g. "clips on to") the razor blade assembly, the handle assembly, and/or any other structural element or feature of a manual razor and/or a cartridge assembly thereof. Illustrative examples of embodiments that incorporate clip-on elements include those illustrated in FIGS. 36 and 37.

The dissolution and/or dislodging of debris from around and/or between razor blades within a manual razor can be facilitated through the addition of various chemical agents to the water used to "flush out" and thereby remove such debris. At least one embodiment incorporates within, coats, and/or affixes to, at least a portion of the "water gathering" and/or "water-channeling" structure(s) at least one such adjuvant debris-removing chemical agent. In at least one embodiment, the debris-removing chemical agent then dissolves, flows, "leaches," and/or is pumped, into the water entering and/or flowing through the water channel prior to its encounter and/or collision with the blades therein.

Differences with Respect to U.S. Pat. No. 5,335,417 (Genero)

Genero as discussed above discloses a razor (FIGS. 6-9) with a modified razor head 480. The razor head is that part and/or portion of a razor within which the blades are affixed. In integral "disposable razors," the razor head is at the distal end of the handle. In cartridge razors, the cartridge is the razor head.

Genero discloses a razor in which a circular orifice 510 and channel are incorporated within the upper part of the razor, adjacent to the razor head. The recommended method of operation is to removably connect the circular orifice to the exit aperture of a faucet, in much the same way as a nozzle is connected to the end of a garden hose. One might expect the connection of the circular orifice 510 of Genero to the end of a faucet from which water is flowing to create a pressurized flow of water through the channel connecting the orifice to the blade channel.

Another method of operation disclosed by Genero is the introduction of a free flow of water (see 720 in FIG. 9) into the circular orifice. However, without the ability to constrict the stream of water flowing out of the faucet, a detached Genero razor does not benefit from an ingress and/or trapping of relatively high-pressure water.

Freely-flowing water entering the device of Genero collides with a wall 530 beneath the orifice and must flow laterally (and forward) (FIGS. 7 and 8) in order to reach the blade channel. One would expect the collision of an inflowing stream of water, with the floor of the circular receiving chamber, to generate a significant amount of turbulence in the water therein. This turbulence would tend to diminish the speed at which the water flows forward into the blade channel, and would promote a turbulent flow (rather than a laminar flow) into that channel.

Furthermore, the device of Genero directs water received through the circular orifice toward, and/or into, a central portion of the blade channel. The lateral extremities of the blade channel receive only that water which fails to flow through the centermost portion of the blades and blade channel. This means that debris lodged near the sides of the blades in Genero will encounter a flushing stream of even lower speed and/or volume than will the debris lodged near the center.

By contrast, razors of the present disclosure utilize a receiving orifice (see, e.g., FIGS. 21-24, 26, 28, 34, 36-41, 44, 46, 50-51, and 54) that can span the full width of the razor's blade channel (see, e.g., 1190 of FIG. 21, 1300 of FIG. 24, 1460 of FIG. 26, 1600 of FIG. 28, 2040 of FIG. 34, 3350 of FIG. 44, and 3830 of FIG. 54).

In most embodiments of the present disclosure, at least a portion of the water (see, e.g., 2030 of FIG. 34, and 3910A of FIG. 56) entering the receiving orifice, is able to directly impact and pass through the blades. And, in most embodiments of the present disclosure, at least a portion of the water (see, e.g. 2060 of FIG. 34, and 3910B of FIG. 56) entering the receiving orifice, is directed into the stream that will directly enter and pass through the blade channel. The result is that all portions of a razor's blades and blade channel may be flushed with equal and/or full efficiency.

As mentioned above, a stream of free flowing water 720 entering the circular orifice 510 of Genero will encounter an obstacle (the bottom of the receiving chamber) and thereafter be directed (through an approximately ninety degree turn) to flow laterally in a forward direction to reach the blade channel. A portion of that water will then be redirected (through another approximately ninety degree turn) to flow laterally in a sideways direction so as to reach the lateral portions of the blade channel.

By contrast, a stream of free flowing water entering the scoop orifice of a razor of the present disclosure will, at most, be directed once through an angle typically no more than approximately forty-five degrees.

The multiple redirections in the path of the water flowing through Genero is likely not a serious problem when the device of Genero is connected to a faucet and an increase in water pressure drives the water through that device. However, such a large number of redirections of significant angular deviation will likely rob a stream of free flowing water of its energy as well as introducing and/or maintaining a high degree of turbulence. Such turbulence would be expected to exacerbate, and further reduce, the speed of such a flow through the razor of Genero. And, a flow of relatively low speed would not be expected to remove debris from between a razor's blade efficiently.

Genero tends to direct water into the blade channel so as to cause it to collide with the blades normal to their broad surfaces (FIGS. 7 and 8). This would tend to blunt and scatter the flow, reducing the likelihood that it will dislodge debris from between those blades. By contrast, razors of the present disclosure tend to direct water into the blade channel as to cause it to pass between the blades approximately parallel to their broad surfaces, or, at most, to collide with those broad surfaces at a relatively shallow angle, thereby promoting, or at least helping to preserve, laminar flow and higher speed of flow.

While Genero does not explicitly discuss or disclose the ratio of the cross-sectional area of his receiving orifice to that of his blade channel, his figures suggest that the cross-sectional area of his receiving orifice is approximately 70-80% of that of his blade channel (based on an analysis of FIGS. 1-3 from his patent). By contrast, the present disclosure discloses a scoop mouth with a cross-sectional area no less than the cross-sectional area of the blade channel, and preferably two or more times as great.

The incorporation of a receiving orifice with a smaller cross-sectional area than that of the blade channel, as well as the severe redirections of flow and resulting turbulence, and the direction of at least a portion of the flow directly into the sides of the blades, would all tend to promote a relatively low speed of water flowing through the blade channel of Genero, and between the blades therein. By contrast, the utilization of a scoop with a receiving orifice of cross-section equal to, if not significantly greater than, the cross-sectional area of the blade channel, the direction of flow parallel to, rather than normal to, the sides of the blades, and the avoidance of sharp redirections of flow, all tend to promote a relatively high-speed and laminar flow of water through the blade channel, and blades, of razors of the present disclosure.

A razor cartridge incorporating a scoop of the present disclosure is approximately, if not entirely, of no greater lateral extent than that of an equivalent unmodified cartridge. And it need not be of significantly greater height. Therefore, cartridges of the present disclosure may be designed and/or adapted so as to fit within packaging of similar dimensions and/or costs as that associated with unmodified cartridges. By contrast, although not disclosed by Genero, a cartridge modified to include a circular receiver or cup 500 of Genero would be much larger in width (i.e. the lateral dimension normal to the longitudinal axis of the cartridge, and/or the dimension in the plane containing the longitudinal axis of the handle). One might expect the packaging required to ship and/or sell cartridges modified with an aperture of the type disclosed by Genero, to be larger, more extensive, and more expensive, than that associated with unmodified cartridges.

The circular aperture 510 of Genero is disposed so as to allow a user to "press" the aperture against the outflow aperture of a faucet. Presumably for structural reasons, the handle 490 is angled down (e.g. rather than having a longitudinal axis normal to the longitudinal axis of the water that would flow out of the faucet). Referring to FIG. 9, this requires a user who wishes to direct a free-flowing stream of water 720 from a faucet to position his or her hand 750 into the sink 740 into which the water would normally flow. Holding a Genero razor under a faucet may require a user to bend his or her wrist by a relatively sharp angle 760 if it is to remain detached from the faucet (and receive freely-flowing water therefrom).

By contrast, many, if not all, embodiments of the present disclosure, allow the razor to be held such that the handle is relatively horizontal (FIG. 10), if not pointing downward 820.

Concluding Remarks

Embodiments disclosed herein perform the useful function of better and more efficiently cleaning (rinsing) the blades, and the gaps between and around the blades, of a razor and/or a razor cartridge. By so doing, shaving with a manual razor, which incorporates the novel water-capture and/or water-channeling features disclosed herein, is made easier, faster and more satisfying, thus providing a useful benefit for its users.

The descriptions, illustrations, claims, and/or other specifications, related to the invention disclosed and provided herein should not be interpreted, and are not intended, to denote, specify, and/or suggest, any limitation with respect to the details, variety, and/or modalities of its implementation. Neither are they intended to, and nor should they be interpreted as, being limiting, either explicitly or implicitly, with respect to the variety of alternative embodiments that are consistent with the inherent and/or fundamental functionalities, objectives, methods, and/or results, of the present disclosure, and/or the scope of its claims.

What is claimed is:

1. A razor cartridge comprising:

first and second opposed trough walls partially defining an inlet, and an outer edge of the first and second trough walls partially defining an open end of the inlet;

third and fourth opposed walls partially defining an opening;

an inner edge of the first and second trough walls being coincident with an inner edge of a respective one of the third and fourth walls, thereby defining communication between the opening and the inlet;

a plurality of spaced blades defining gaps retained in the opening; and wherein a liquid is able to be received in the open end of the inlet and travel unobstructed through the inlet to the opening and pass through the gaps defined by the blades.

2. The razor cartridge of claim 1, wherein at least one of the first and second opposed trough walls have a concave profile.

3. The razor cartridge of claim 2, wherein the third and fourth walls have a straight profile.

4. The razor cartridge of claim 2, wherein the outer edge of the first trough wall extends away from the opening at a greater distance than the outer edge of the second trough extends away from the opening.

5. The razor cartridge of claim 4, wherein each of the blades has a cutting edge that is angled towards the second trough wall.

6. The razor cartridge of claim 1, wherein both the first and second opposed trough walls have a concave profile.

7. The razor cartridge of claim 1, wherein the first trough wall and second wall are asymmetric.

* * * * *